US006337956B1

(12) United States Patent
Sato et al.

(10) Patent No.: US 6,337,956 B1
(45) Date of Patent: Jan. 8, 2002

(54) DEVELOPING DEVICE HAVING TONER AGITATION MEMBER AND CLEANING MEMBER CLEANING LIGHT TRANSMISSION WINDOW

(75) Inventors: Shougo Sato; Masahiro Ishii; Yoshiteru Hattori; Hideaki Deguchi, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/506,699

(22) Filed: Feb. 18, 2000

(30) Foreign Application Priority Data

| | | |
|---|---|---|
| Feb. 24, 1999 | (JP) | 11-047183 |
| Mar. 9, 1999 | (JP) | 11-062235 |
| Mar. 9, 1999 | (JP) | 11-062236 |
| Mar. 9, 1999 | (JP) | 11-062237 |
| Mar. 9, 1999 | (JP) | 11-062238 |
| May 31, 1999 | (JP) | 11-152722 |
| Jun. 21, 1999 | (JP) | 11-174028 |

(51) Int. Cl.[7] ..... G03G 15/18; G03G 15/00
(52) U.S. Cl. ..... 399/27; 399/254
(58) Field of Search ..... 399/27, 30, 61, 399/64, 754; 430/110

(56) References Cited

U.S. PATENT DOCUMENTS

| | | | | |
|---|---|---|---|---|
| 4,646,679 A | | 3/1987 | Ohno et al. | |
| 5,036,358 A | | 7/1991 | Yoshida | 399/64 |
| 5,064,074 A | * | 11/1991 | Yasuda et al. | 430/120 |
| 5,499,077 A | | 3/1996 | Endo et al. | |
| 5,532,790 A | | 7/1996 | Akazawa | |
| 5,557,368 A | | 9/1996 | Endo et al. | |
| 5,649,264 A | | 7/1997 | Domon et al. | 399/30 |
| 6,042,979 A | * | 3/2000 | Ohishi et al. | 430/45 |

FOREIGN PATENT DOCUMENTS

| | | | |
|---|---|---|---|
| JP | 5-72900 | * | 3/1993 |
| JP | 5-165331 | * | 7/1993 |
| JP | A-7-56431 | | 3/1995 |
| JP | A-9-34238 | | 2/1997 |
| JP | 11-102110 | * | 4/1999 |

OTHER PUBLICATIONS

Patent Abstracts of Japan, vol.96, No. 2, Feb. 29, 1996, JP 07287442A, (Canon, Inc.) Oct. 31, 1995, Abstract.*

* cited by examiner

*Primary Examiner*—Joan Pendegrass
(74) *Attorney, Agent, or Firm*—Oliff & Berridge, PLC

(57) ABSTRACT

A developing device having a toner container in which a toner agitator and a cleaning member is provided. The toner agitator agitates the toner in the toner container and transport the toner into a developing chamber. The toner container has a pair of light transmission windows through which light passes. If no toner exist between the light transmission windows, the light passes through the two windows to provide a signal indicative of exchange of the developing device with a new device. If toner exists therebetween, light cannot pass through two windows. The cleaning member wipes off the toner from the surface of the windows.

77 Claims, 29 Drawing Sheets

FIG. 13

| TONER | | TEST RESULTS | | |
|---|---|---|---|---|
| EXTERNAL ADDITIVE CONDITIONS | FLUIDITY | UNEVENNESS IN TONER LEVEL | FILMING | RESIDUAL AMOUNT AT EMPTY |
| BET150 : 1.0wt% | 89 | MODERATE | △ | 60g |
| BET150 : 1.0wt%<br>BET 50 : 1.0wt% | 80 | NONE | ○ | 70g |
| BET 50 : 1.0wt% | 66 | GREAT | ○+ | 50g |
| BET150 : 1.0wt%<br>BET100 : 1.0wt% | 90 | SLIGHT | ○- | 65g |

△ : SOME SLIGHT FILMING

○ : ALMOST NO FILMING

DEVELOPING DEVICE HAVING TONER AGITATION MEMBER AND CLEANING MEMBER CLEANING LIGHT TRANSMISSION WINDOW

BACKGROUND OF THE INVENTION

The present invention relates to a developing device, a process cartridge including the developing device, and an image forming device including the developing device.

Normally, conventional image forming devices include a toner holding chamber or a toner container where toners are contained therein and a developing chamber where a developing roller is provided. An opening is formed at a boundary between the toner holding chamber and the developing chamber, so that the toners are transferred through the opening into the developing chamber. The conventional image forming devices are configured to detect the remaining amount or toner in a developing unit, and once the remaining amount has reached a predetermined value of less, urge the user to replenish the toner. There are many different ways to detect the amount of remaining toner. In one exemplary method, light transmission windows are provided in the toner holding chamber of a developing unit. A light emitting element and a light receiving element are provided, one in confrontation with each of the light transmission windows. The amount of remaining toner in the toner holding chamber is detected by emitting light from the light emitting element so that the light passes through both the light transmission windows. The amount of remaining toner will correspond to the amount of light received by the light receiving element.

However, with this method, it becomes impossible to accurately detect the amount of remaining toner when toner clings to the light transmission windows. Therefore, a cleaning member for cleaning the light transmission window is provided in the toner holding chamber. The cleaning member is configured to slide across and clean the light transmission window while rotating integrally with a toner agitation/transfer member. The toner agitation/transfer member is provided in the toner holding chamber, in order to agitate and transport the toner in the toner holding chamber.

The devices disclosed in Japanese Patent-Application Publication (Kokai) No. HEI-7-56431 or Japanese Patent-Application Publication (Kokai) No. HEI-9-34238 measure the time from when the cleaning member cleans the light transmission window to when the light path is blocked by toner that falls from the toner agitation/transfer member. However, as described in Japanese Patent-Application Publication (Kokai) No. HEI-7-56431, the fluidity of toner changes with changes in environmental conditions and with the length of use. Consequently, the toner falls from the toner agitation/transfer member at various timings, depending on the fluidity of the toner, so that it is impossible to stably detect the remaining amount of toner.

The length of time from when the light transmission windows are wiped until the light transmission windows are covered by toner depends on the amount of toner that drops from the agitator (after the agitator passes by the opening), and on the amount of the toner that billows up into a cloud-like condition in the chamber. However, these amounts will change with changes in the fluidity of the toner. Therefore, the amount of remaining toner can only be detected with extreme instability and inaccuracy.

Also, conventional image forming devices have a problem in that the toner is not always evenly distributed through the toner chamber. For example, when a laser beam printer is transported or when a developing cartridge is taken out and inserted into the laser beam printer for replacement, the toner tends to collect in one end of the toner chamber, so that it is impossible to accurately detect the remaining amount of the remaining toner. Also, when the opening from the toner chamber into the developing chamber is narrower than the developing chamber itself, or when narrow width sheets, such as envelops or postcards, are consecutively printed in large numbers, then toner is consumed unevenly from the toner chamber. The toner will be distributed unevenly in the toner chamber as a result. For this reason, it is difficult to properly detect how much toner remains in the toner chamber.

When a sheet-shaped member is provided to rotate in the toner chamber to agitate the toner, the ends of the sheet-shaped member can slidingly contact against the light transmission windows provided at both end walls of the toner chamber. In such a situation, the sheet shaped member damages the surface of the light transmission windows so that detection of remaining amount of toner cannot be properly performed.

To prevent damage to the light transmission windows, the sheet shape member can be formed shorter than the length of the toner chamber, so that the ends of the sheet shaped member are separated from the walls of the toner chamber. However, with this configuration, toner can accumulate in the space between the side walls of the toner chamber and the ends of the sheet shaped member, so that it is impossible to prevent uneven distribution of toner in certain areas of the toner chamber.

Some image forming device include a screw member to agitate the toner in the toner chamber. The screw member positively transports toner in the toner chamber along the lengthwise direction of the toner chamber. With this configuration, it is difficult to uniformly distribute the toner on both upstream and downstream sides of the transport direction along the screw member. As a result, deviation in the toner accumulation may occur.

In another aspect, when using the developing system that uses non-magnetic single-component toner, the toner must be scraped between a layer thickness regulating member and the developing roller in order to uniformly charge the toner. In conventional devices, the layer thickness regulating blade is usually made from stainless steel and the like in order to reduce production costs. Where the layer thickness regulating blade abuts against the developing roller, the layer thickness regulating blade applies a large pressure onto external additive of the toner. This can force the external additive to become embedded into the base particle of the toner, thereby reducing the fluidity of the toner. When such toner with reduced fluidity is returned from the developing chamber to the toner holding chamber with circulation of toner between toner developing chamber and the toner holding chamber, the time required after the toner with reduced fluidity is agitated by the agitator until the toner settles on the floor of the toner holding chamber may fluctuate depending on how long the toner has been used. This makes it difficult to stably detect the amount of remaining toner. When the amount of the toner with reduced fluidity in the toner holding chamber increases, the toner can become unevenly distributed in the toner holding chamber so that reliable and accurate remaining toner detection cannot be performed.

In still another aspect, the conventional image forming devices need to reliably agitate toner throughout the entire toner holding chamber by provision of a toner agitation/transfer member. The toner agitation/transfer member is disposed to slide against the inner floor surface of the toner holding chamber, with its tip in a bent condition. Also, the toner agitation/transfer member is formed to a width sufficient to substantially contact both walls at lengthwise ends of the toner chamber.

However, when the agitation/transfer member contacts both side surfaces of the toner holding chamber while rotating, the light transmission windows will be scraped off by the agitation/transfer member, in addition to being cleaned off by the cleaning member. Accordingly, the agitation/transfer member removes toner from the light transmission windows at a timing that matches the rotation cycle of the agitation/transfer member, so that light will sometimes, depending on the amount of friction, pass through the light transmission windows at this unwanted timing. Because light passes through the light transmission windows in an unstable manner, improper detection of remaining toner may occur.

Further, in the conventional developing devices, components of the toner can be spread in a thin film onto the light transmission window. This phenomenon is referred to as "filming". Filming reduces the precision of remaining toner detection because it obstructs light from passing through the light transmission windows even directly after the cleaning member wipes off the light transmission windows. When insufficient light passes through the light transmission windows, then detection results will appear as though toner fills the toner holding chamber, regardless of whether any toner is actually positioned between the two light transmission windows or not.

Further, sometimes in the conventional developing devices, the light receiving element generates an output signal because a light path is opened between the light generating element and the light receiving element when the agitation/transfer member agitates the toner in the toner holding chamber. Even if the agitation/transfer member is sufficiently separated from the light transmission windows so it does not contact the light transmission windows, the toner near the light transmission windows can be transported with the toner agitated by the agitation/transfer member if the fluidity of the toner has changed because the toner has been used for a long time, or because of environmental conditions such as high temperature and high humidity. Therefore, erroneous output from the light receiving element cannot be completely prevented. For this reason, sometimes the light receiving element receives a light at a timing where it should not normally receive the light. As a result, the remaining amount of toner cannot be stably detected.

SUMMARY OF THE INVENTION

It is an object of the present invention to provide an image forming device, or a developing device used in an image forming device, that is capable of stably detecting remaining amount of toner, regardless of the fluidity of the toner.

Another object of the present invention is to provide such image forming device with light transmission windows that are used during detection of remaining amount of toner, and to such developing device used in such an image forming device, wherein toner can be reliably distributed evenly in the toner holding chamber and wherein the remaining amount of toner can always be accurately detected.

Still another object of the present invention is to provide the image forming device, and the developing device used in the image forming device, that is capable of performing stable detection of remaining toner even when non-magnetic single-component toner is used.

Still another object of the present invention is to provide the developing device capable of detecting amount of remaining toner with a high degree of precision, and capable of properly cleaning off the light transmission window while maintaining the toner in the toner holding chamber in a properly agitated condition.

Still another object of the present invention is to reliably prevent filming of the toner on the light transmission window so that the amount of remaining toner can be detected with high precision in the developing device that detects the amount of remaining toner using light transmission windows.

These and other objects of the present invention will be attained by providing a developing device including an improved combination of a developing housing, a developing agent container, a light transmission window, a cleaning member, and a developing agent agitating and transferring member. The developing agent container is connected to and positioned beside the developing housing and is formed with an opening in communication with the developing housing. The developing agent container has a container wall and an inner surface defining an developing agent accumulation space. The light transmission window is provided at the container wall to permit a detection light to pass through the light transmission window so as to detect an amount of the developing agent in the developing agent container. The cleaning member is disposed in the developing agent container and is rotatable at a constant angular velocity about a rotation axis in a direction to move upward when passing beside the opening. The cleaning member is movable to a cleaning position in sliding contact with the light transmission window for cleaning the light transmission window. The developing agent accumulation space is divided into an imaginary first region and an imaginary second region by an imaginary vertical plane passing through the rotation axis and extending in an axial direction of the rotation axis. The imaginary first region is in communication with the opening, and the imaginary second region is positioned opposite the opening with respect to the imaginary vertical plane. The developing agent agitating and transferring member is disposed in the developing agent container for agitating the developing agent in the developing agent container and transferring the developing agent to the developing housing. The developing agent agitating and transferring member includes a blade movable with respect to the inner surface of the developing agent container. The blade is rotatable about the rotation axis of the cleaning member at a constant angular velocity equal to the angular velocity of the cleaning member. The blade is spaced away from the cleaning member in such a manner that the blade is positioned in the imaginary second region when the cleaning member is in the cleaning position.

In another aspect of the present invention, there is provided a developing device including the developing housing, the developing agent container, the light transmission window, the cleaning member, and a developing agent agitating and transferring member. The developing agent agitating and transferring member is disposed in the developing agent container for agitating the developing agent in the developing agent container and transferring the developing agent to the developing housing. The developing agent agitating and transferring member includes a blade movable with respect to the inner surface of the developing agent container. The blade is rotatable about the rotation axis of the cleaning member at a constant angular velocity equal to the angular velocity of the cleaning member. The light transmission window is positioned in the imaginary first region, and the blade is spaced away from the cleaning member in such a manner that the blade is positioned higher than the light transmission window when the cleaning member is in the cleaning position.

In still another aspect of the invention, there is provided a developing device including a developing housing, a developing agent container connected to and positioned beside the developing housing and formed with an opening in communication with the developing housing, the developing agent container having a container wall and an inner surface defining an developing agent accumulation space, a light transmission window provided at the container wall to permit a detection light to pass through the light transmission window so as to detect an amount of the developing agent in the developing agent container, a cleaning member disposed in the developing agent container and movable to a cleaning position in sliding contact with the light transmission window for cleaning the light transmission window, and a developing agent agitating and transferring member disposed in the developing agent container for agitating the developing agent in the developing agent container and transferring the developing agent to the developing housing, the developing agent agitating and transferring member comprising a blade movable with respect to the inner surface of the developing agent container, the developing agent container having a width extending in a widthwise direction of an image recording sheet, and the light transmission window having a window plane extending in a direction perpendicular to the widthwise direction, the developing agent agitating and transferring member being positioned spaced away from the light transmission window by a predetermined distance in the widthwise direction.

In still another aspect of the invention, there is provided a developing device including a developing housing, a developing agent carrying member disposed in the developing housing and having a longitudinal length extending in a widthwise direction of an image recording sheet, the developing agent comprising polymerized toners produced by polymerization method, a developing agent container connected to and positioned beside the developing housing and formed with an opening in communication with the developing housing, the developing agent container having a container wall and an inner surface defining an developing agent accumulation space, the opening having a length corresponding to the longitudinal length of the developing agent carrying member, and a light transmission window provided at the container wall to permit a detection light to pass through the light transmission window so as to detect an amount of the developing agent in the developing agent container, the container wall of the developing agent container including confronting side walls at widthwise ends in the widthwise direction, the light transmission window being disposed at each side wall to allow the detection light to pass through the respective light transmission windows.

In still another aspect of the invention, there is provided a developing device including a developing housing, a developing agent carrying member disposed in the developing housing and having a longitudinal length extending in a widthwise direction of an image recording sheet, the developing agent comprising polymerized non magnetic single component toners produced by polymerization method, a developing agent container connected to and positioned beside the developing housing and formed with an opening in communication with the developing housing, the developing agent container having a container wall and an inner surface defining an developing agent accumulation space, the opening having a length corresponding to the longitudinal length of the developing agent carrying member, the developing agent carrying member carrying thereon the developing agent supplied from the developing agent container into the developing housing through the opening, a light transmission window provided at the container wall to permit a detection light to pass through the light transmission window so as to detect an amount of the developing agent in the developing agent container, the container wall of the developing agent container including confronting side walls at widthwise ends in the widthwise direction, the light transmission window being disposed at each side wall to allow the detection light to pass through the respective light transmission windows, and a thickness regulation member disposed in confrontation with the developing agent carrying member to regulate a thickness of a layer of the developing agent formed on the developing agent carrying member, the thickness regulation member having a pressing segment formed of a rubber pressing against the developing agent carrying member.

In still another aspect of the invention, there is provided a developing device including a developing housing, a developing agent container connected to and positioned beside the developing housing and formed with an opening in communication with the developing housing, the developing agent container having a container wall and an inner surface defining an developing agent accumulation space, a light transmission window provided at the container wall to permit a detection light to pass through the light transmission window so as to detect an amount of the developing agent in the developing agent container, and a cleaning member disposed in the developing agent container and movable to a cleaning position in sliding contact with the light transmission window for cleaning the light transmission window, the light transmission window protruding inwardly with respect to the container wall toward a center of the developing agent accumulation space.

In still another aspect of the invention, there is provided a developing device including a developing housing, a developing agent container connected to and positioned beside the developing housing and formed with an opening in communication with the developing housing, the developing agent container having a container wall and an inner surface defining an developing agent accumulation space, the developing toner comprising a non magnetic single component toner, a developing agent carrying member disposed in the developing housing for carrying thereon the developing agent supplied from the developing agent container into the developing housing through the opening, a light transmission window provided at the container wall to permit a detection light to pass through the light transmission window so as to detect an amount of the developing agent in the developing agent container, and a thickness regulation member disposed in confrontation with the developing agent carrying member to regulate a thickness of a layer of the developing agent formed on the developing agent carrying member, the thickness regulation member having a pressing segment formed of a rubber pressing against the developing agent carrying member.

In still another aspect of the invention there is provided a developing device including a developing agent container having a container wall and an inner surface defining an developing agent accumulation space, a light transmission window provided at the container wall to permit a detection light to pass through the light transmission window so as to detect an amount of the developing agent in the developing agent container, a cleaning member rotatably provided in the developing agent container and performing cleaning to the light transmission window at a predetermined cycle, a developing agent agitating and transferring member rotatably provided in the developing agent container for agitating the developing agent in the container and transferring the developing agent, and a shielding member movably disposed in the developing agent container and shielding the light transmission window for a predetermined period in timed relation with the predetermined cycle.

In still another aspect of the invention, there is provided a process cartridge detachably assembled in a cartridge accommodation space of an image recording device, the cartridge including a latent image carrying member, a developing agent carrying member positioned in confrontation with the latent image carrying member, and the developing device as described above, the latent image carrying member and the developing agent carrying member being disposed in the developing housing. The developing agent carrying member is positioned in confrontation with the latent image carrying member.

In the process cartridge, the developing agent container can be detachable from a case of the cartridge. In other words, the developing agent container disposing therein the cleaning member and the developing agent agitating and transferring member and containing therein the developing agent can be one unit which is separate from the developing agent carrying member and the latent image carrying member. When the developing agent container is assembled to the case of the cartridge, the process cartridge results.

In still another aspect of the invention, there is provided an image recording device including means for detecting a residual amount of a developing agent, and the developing device described above. The detecting means detects the residual amount of the developing agent accumulated in the developing agent container and including a light emitting element and a light receiving element positioned in alignment with the light transmission window.

BRIEF DESCRIPTION OF THE DRAWINGS

In the drawings:

FIG. 13 is a table showing results of experiments for determining toner fluidity, evenness in toner level, filming, and accuracy of toner empty detection, when toner with different types of external additive are used during printing;

DETAILED DESCRIPTION OF THE PREFERRED EMBODIMENTS

Figure 1:
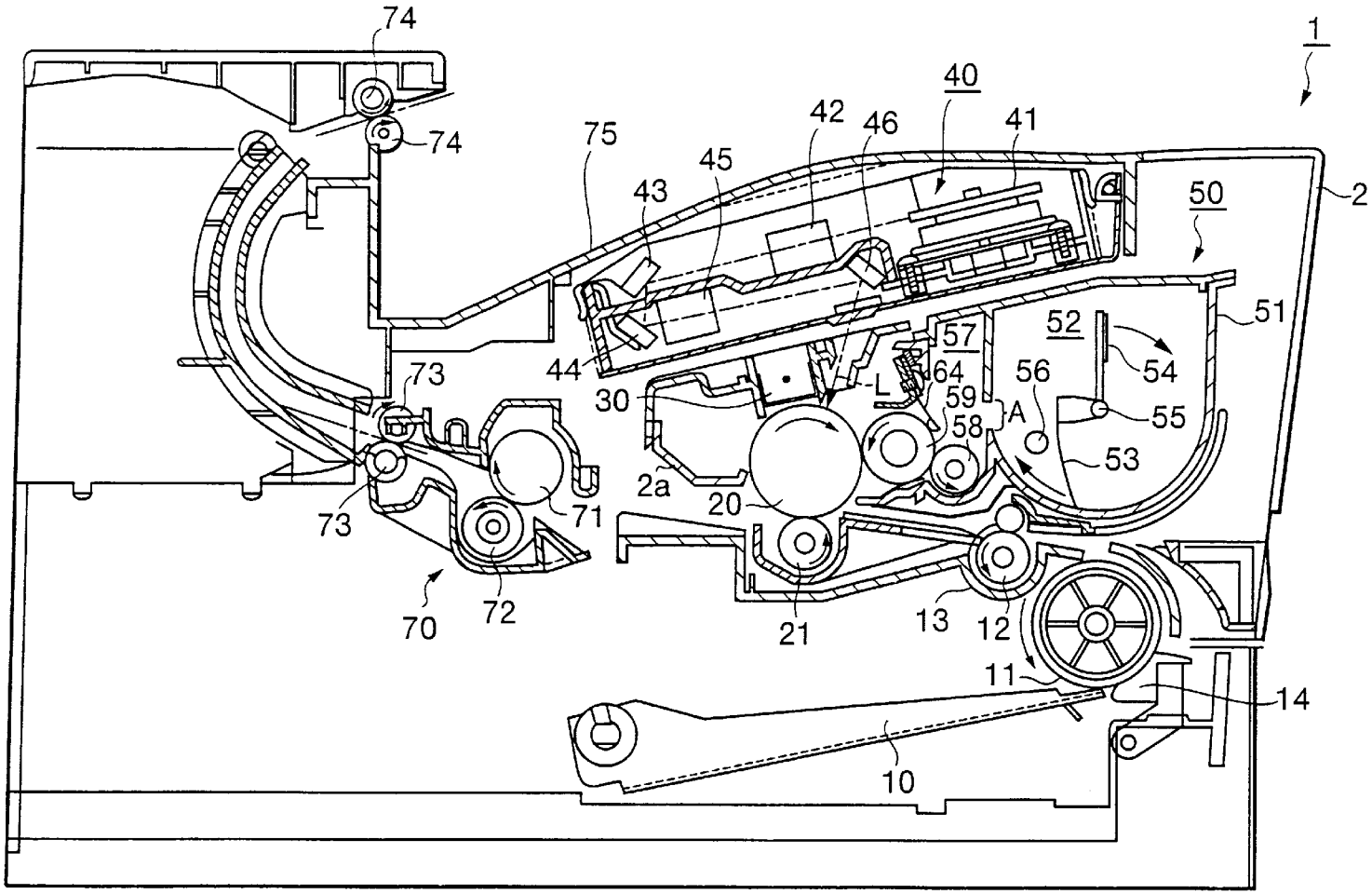
FIG. 1 is a cross-sectional view showing a laser beam printer according to a first embodiment of the present invention.

A laser beam printer 1 according to a first embodiment the present invention is shown in FIG. 1. The laser beam printer 1 includes a case 2, and a feeder unit for supplying sheets (not shown) at the bottom portion of the case 2. The feeder unit includes a friction separation member 14, a sheet supply roller 11, and a sheet pressing plate 10 that is pressed upward by a spring (not shown). The sheet pressing plate 10 presses the sheets upward against the sheet supply roller 11. Rotation of the sheet supply roller 11 separates the uppermost sheet at a position between the sheet supply roller 11 and the friction separation member 14, to supply sheets at a predetermined timing.

A pair of register rollers 12 and 13 are rotatably supported at a position downstream along the pathway which sheets are transported by rotation of the sheet supply roller 11 in the direction indicated by an arrow in FIG. 1. The pair of register rollers 12 and 13 transports sheets at a predetermined timing to a transfer position, which is defined by a photosensitive drum 20 and a transfer roller 21.

The photosensitive drum 20 is rotatably supported on the case 2, and driven to rotate in a direction indicated by an arrow by a drive means (not shown). The photosensitive drum 20 is formed from a positively charging material, such as an organic photosensitive member whose main component is positively charging polycarbonate. In concrete terms, the photosensitive drum 20 is configured from a hollow drum with an aluminum cylindrical sleeve as its main body. A photoconductive layer is formed on the outer peripheral surface of the cylindrical sleeve to a predetermined thickness of, for example, about 20 $\mu$m. The photoconductive layer is formed by dispersing a photoconductive resin in polycarbonate.

A charge unit 30 is configured from, for example, a positively charging scorotoron charge unit that generates a corona discharge from a charge wire, which is formed from tungsten for example.

A laser scanner unit 40 includes a laser generator (not shown), a polygon mirror (five surfaced mirror) 41 that is driven to rotate, a pair of lenses 42 and 45, and reflection mirrors 43, 44, and 46. The laser generator generates a laser light L to form an electrostatic latent image on the photosensitive drum 20.

A developing unit 50 includes a case 51 formed with a toner holding chamber 52 serving as a developing agent container and a developing chamber 57. An agitator (developing agent agitating and transferring member) 53, and two cleaning members 54 are provided in the toner holding chamber 52 in rotation around a rotational shaft 55. Since both cleansing members 54 have the same configuration, only one will be referred to during explanation in the following text. According to the present embodiment, the toner held in the toner holding chamber 52 is a non-magnetic singlecomponent toner that has a positively charging nature and electrically insulating properties. Also, two light transmission windows 56*a,* 56*b,* also referred to generically as light transmission window 56 hereinafter, are provided in the inner walls of the toner holding chamber 52, one adjacent to each end of the rotational shaft 55.

The developing chamber 57 is formed nearer the photosensitive drum 20 than the toner holding chamber 52. A toner supply roller 58 and developing roller 59 are rotatably supported in the developing chamber 57. A layer thickness regulating blade 64 having a resilient thin shape is disposed in the developing chamber 57, for regulating toner on the developing roller 59 to a predetermined thickness. The toner is then supplied by rotation of the developing roller 59 to develop the electrostatic latent image on the photosensitive drum 20.

The transfer roller 21 is configured from a resilient foam body having electrical conductivity. The resilient foam body is formed from silicon rubber or urethane rubber, for example, and is freely rotatably supported. The transfer roller 21 is applied with a voltage, so that the toner image on the photosensitive drum 20 is reliably transferred to a sheet transported between the photosensitive drum 20 and the transfer roller 21.

A fixing unit 70 is provided further downstream in a sheet transport pathway, which extends from the register roller 12 and 13 to where the photosensitive drum 20 and the transfer roller 21 pressingly contact each other. The fixing unit 70 includes a heat roller 71 and a pressing roller 72. The heat roller 71 and the pressing roller 72 press and heat the toner image transferred onto the sheet, thereby fixing the toner image onto the sheet. A pair of transport rollers 73 and a pair of discharge rollers 74 for transporting the sheet are each provided downstream in the sheet transport pathway from the pressing roller 72. A discharge tray 75 is provided downstream from the discharge rollers 74.

It should be noted that the transfer roller 21, the charge unit 30, and the developing unit 50 are housed in a process cartridge 2*a,* which is detachable from the laser beam printer 1. Further, the developing unit 50 is freely detachable from the process cartridge 2*a,* and functions as a developing unit cartridge.

In the laser beam printer 1 according to the embodiment described above, the surface of the photosensitive drum 20 is uniformly charged by the charge unit 30. Then the laser light L is emitted from the laser scanner unit 40 as modulated according to image information, to form the electrostatic latent image on the surface of the photosensitive drum 20. The latent image is developed into a visible image by toner from the developing unit 50. The visible image formed on the photosensitive drum 20 is transported toward the transfer position by rotation of the photosensitive drum 20. In the meantime, the sheet supply roller 11 and the register rollers 12 and 13 supply a sheet to the transfer position. The visible toner image on the photosensitive drum 20 is transferred onto the sheet by a transfer bias applied to the transfer roller 21. It should be noted that any toner remaining on the photosensitive drum 20 after transfer is collected into the developing chamber 57 by the developing roller 59. Next, the sheet with the toner image is transported to the fixing unit 70. The sheet is transported between the heat roller 71 and the pressing roller 72 of the fixing unit 70, so that the visible image on the sheet is pressed and heated, and fixed onto the sheet. The sheet is discharged onto the discharge tray 75 by the pair of the transport rollers 73 and the pair of the discharge rollers 74. This completes image formation operations.

Toner in the toner holding chamber 52 is consumed during image forming operations. Toner must be replenished in a timely manner to prevent reduction in quality caused by insufficient toner. The developing unit 50 according to the present embodiment is provided with configuration for determining whether toner needs to be replenished, by detecting reduction in toner amount at an appropriate timing. Detailed configuration will be described for the developing unit 50 and configuration for detecting the amount of remaining toner while referring to FIGS. 2 to 7.

Figure 2:
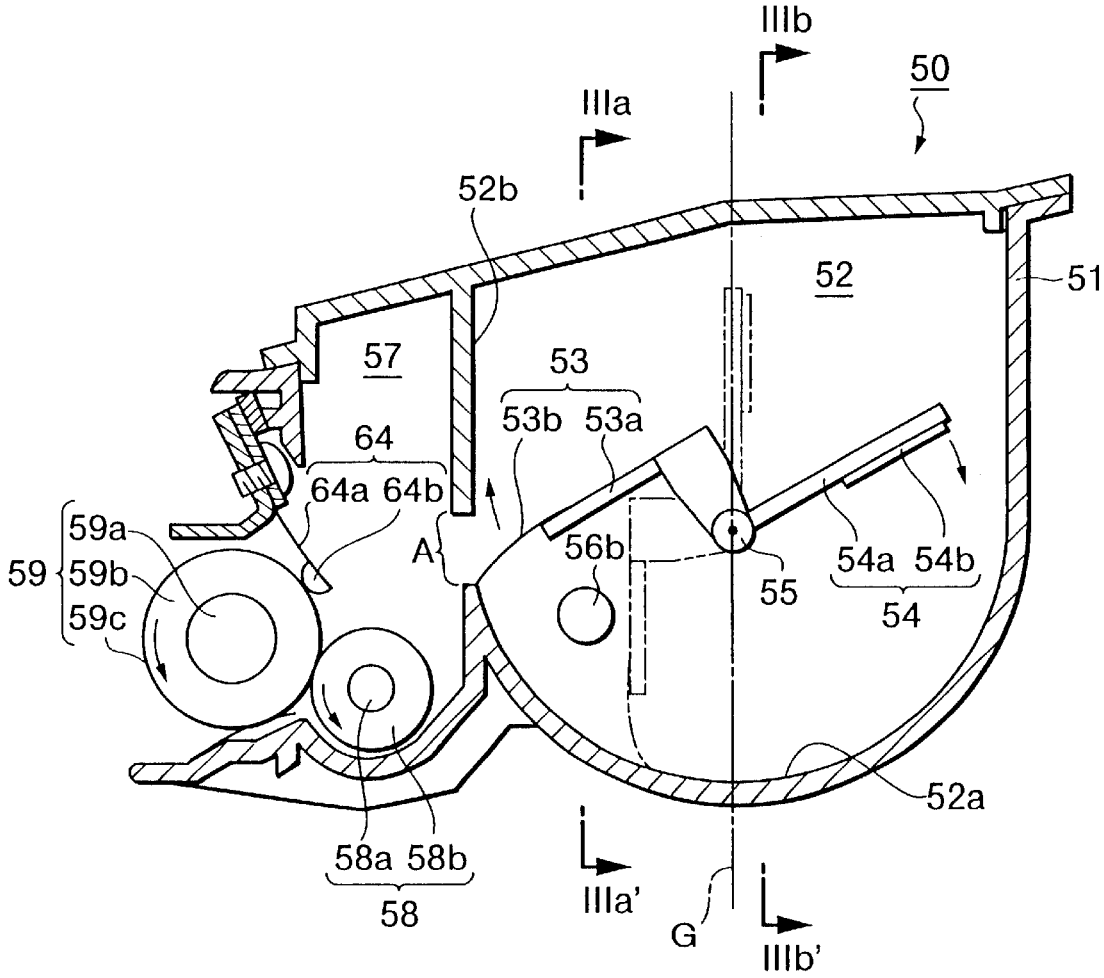
FIG. 2 is a cross-sectional view taken along line II–II' of FIG. 3.
Figure 3:
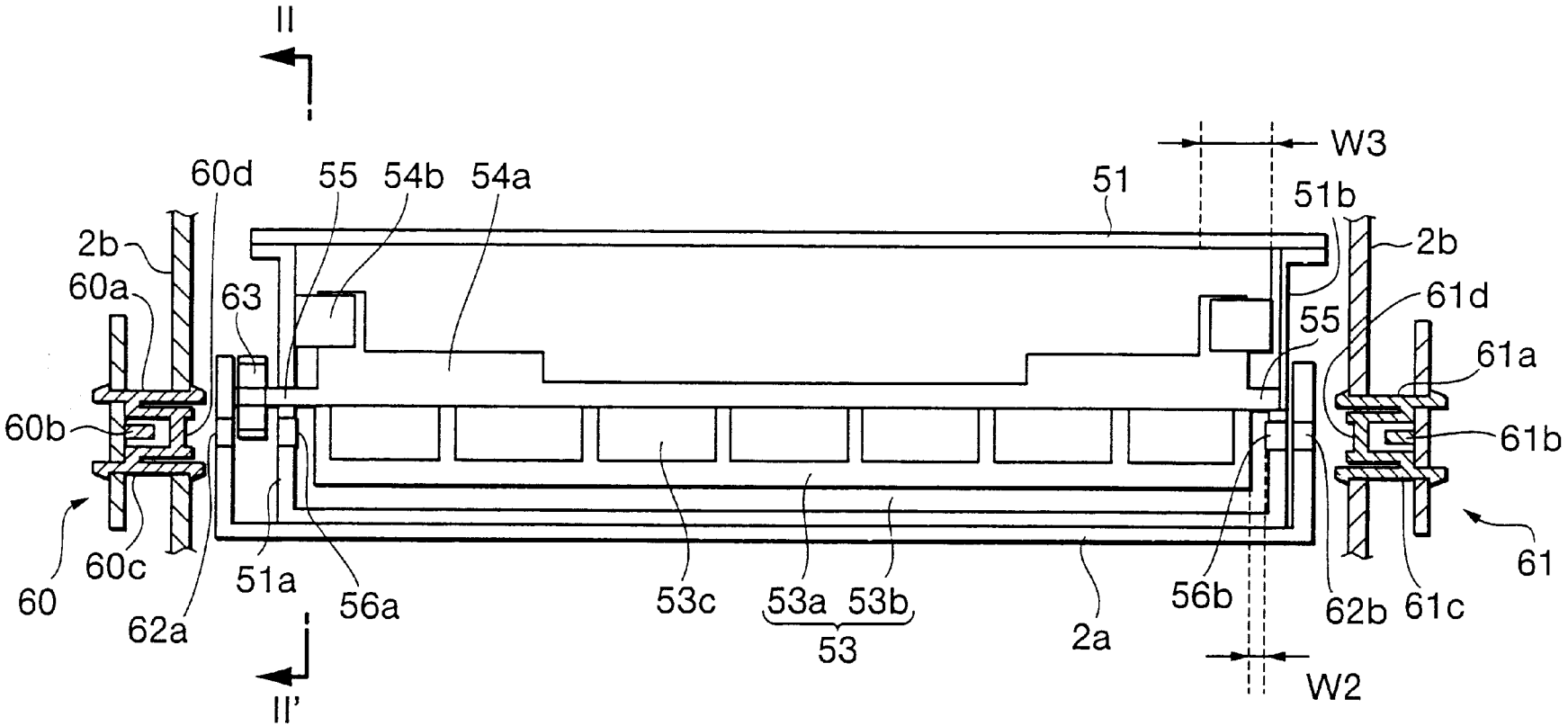
FIG. 3 is a cross-sectional view particularly showing light emitting and receiving elements of FIG. 2 taken along line IIIa–IIIa' of FIG. 2, and the developing device of FIG. 2 taken along line IIIb–IIIb' of FIG. 2.
Figure 4:
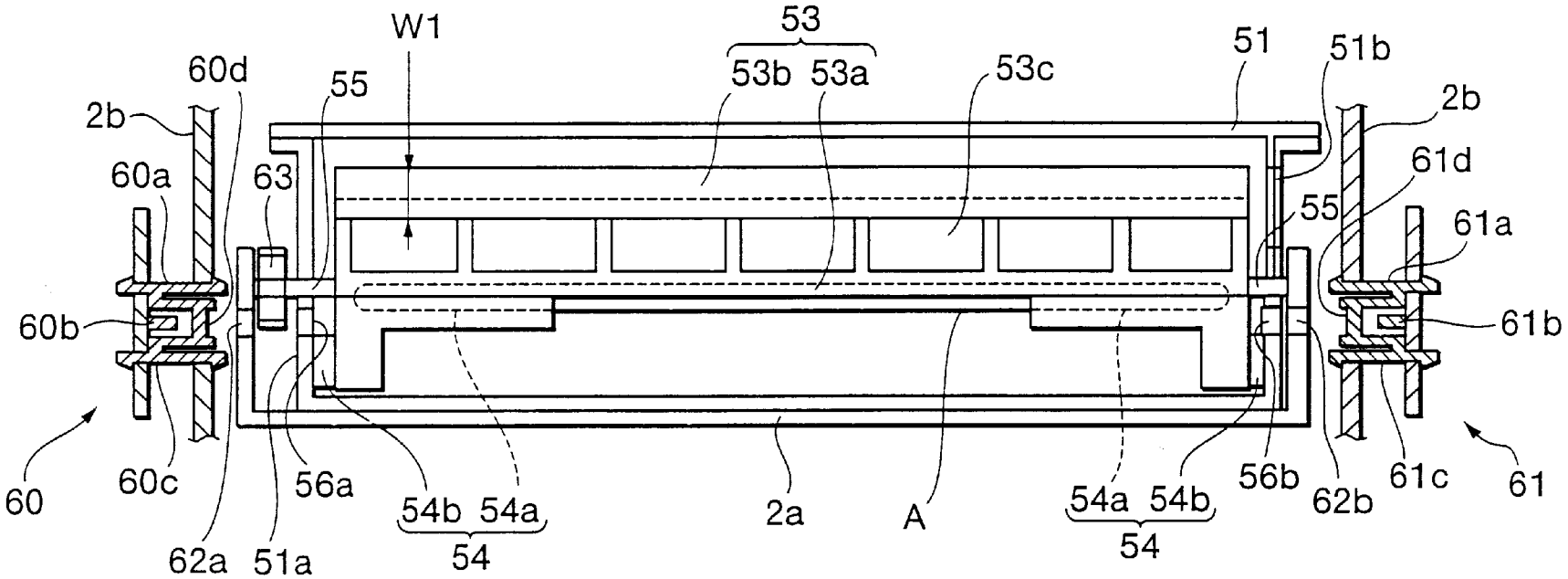
FIG. 4 is a cross-sectional view showing the developing device as viewed in FIG. 3, but with an agitator and cleaning member rotated 180°.

FIGS. 2 to 4 are cross-sectional views of the developing unit 50 of the first embodiment, wherein FIG. 3 is a view taken when the agitator 53 and the cleaning member 54 are positioned as indicated by the dotted chain line in FIG. 2. The case 51 forms the toner holding chamber 52 and the developing chamber 57, and also functions as a frame for supporting various elements so that the developing unit 50 can be removed and mounted in the drum cartridge 2*a* shown in FIGS. 3 and 4 while the various components shown in FIG. 2 are provided within the case 51.

The developing roller 59 serving as a developing agent carrying member has a sleeve member 59*b* provided on a metal core 59*a*, which is formed from stainless steel for example. The sleeve member 59*b* is formed from electrically conductive silicon rubber that includes electrically conductive carbon particles. A coat layer 59c of rubber material or resin containing fluorine is formed on the sleeve member 59*b*. It should be noted that the developing roller 59 need not have a base member configured from electrically conductive silicon rubber. Instead, the base member can be configured from electrically conductive urethane rubber. Although not shown in the drawings, a power source is provided for applying a predetermined voltage to the developing roller 59 to provide a predetermined potential difference between the developing roller 59 and the photosensitive drum 20.

The layer thickness regulating blade 64 includes a support portion 64*a* formed from stainless steel and the like and a contact portion 64*b*. The support portion 64*a* has its base fixed to the case 51 of the developing unit 50. The contact portion 64*b* is fixed on the tip end of the support portion 64*a*, and is formed from electrically insulating or conductive silicon rubber, electrically insulating or conductive fluororubber, or electrically insulating or conductive urethane rubber. The contact portion 64*b* is pressed against the developing roller 59 by resilient force of the support portion 64*a*. The contact portion 64*b* according to the present embodiment is formed in a protruding, approximately semicircular shape in cross section as shown in FIG. 2. However, the contact portion 64*b* could be formed in a plate shape.

The toner supply roller 58 includes a cylindrical base member 58*b* formed on a metal core 58*a*, which is formed from stainless steel for example. The cylindrical base member 58*b* is formed from an electrically conductive sponge material. The toner supply roller 58 is disposed so as to pressingly contact the developing roller 59 by resilient force of the sponge. It should be noted that other appropriate materials, such as electrically conductive silicone rubber or urethane rubber can be used to form the toner supply roller 58.

It should be noted that the toner contained in the toner holding chamber 52 is a positively chargeable, non-magnetic, single-component toner. The toner base particles have a particle diameter of between 6 microns and 10 microns, and an average particle diameter of 8 microns. The toner base particles are formed by adding a well-known coloring agent, such as carbon black, and a charge control agent, such as nigrosine, triphenylmethane, and quaternary ammonium salt, to styrene acryl resin that has been formed in spheres by suspension polymerization. The toner is configured by adding silica as an outer additive to the surface of the toner base particles. The silica is processed by well-known hydrophobic processes, such as by silane coupling agent. Silica with a BET value of 150 is added in quantities of 1% by weight of the toner base particle and silica with a BET value of 50 is added in 0.5% by weight of the toner base particle.

The BET value represents the specific surface area measured by forced adsorption of nitrogen, and is indicated as surface area per unit weight in units of $m^2/g$. Accordingly, the larger the BET value, the smaller the particle diameter and the smaller the BET value, the larger the particle diameter. According to the present embodiment, the BET value was measured by a normal BET measuring method, using a FlowSorb2-2300, which is a specific surface area measuring device produced by Shimadzu Corporation.

The toner is suspension polymerization toner with a shape extremely near to being completely spherical. Also, the toner has extremely excellent fluidity because silica that was processed by hydrophobic processes and that has a BET value of 150 is added as an outer additive in the amount of 1% by weight of the toner base particle. For this reason, the toner can be sufficiently charged by friction charging. Therefore, high toner transfer efficiently results, so that extremely high quality images can be formed. Although silica having a BET value of 50 increases fluidity of toner less than does silica having a BET value of 150, the larger diameter silica having a BET value of 50 prevents smaller diameter silica with a BET value of 150 from becoming embedded into the toner base particle over long period of use. Therefore, by also adding the larger diameter silica having a BET value of 50, good fluidity can be maintained over a longer period of time, so that transfer efficiency is good and extremely high quality images can be formed.

The agitator 53, which serves as agitation/transfer member, includes a support member 53*a* and a sheet shaped slide contact member or a blade 53*b*, which is attached to the tip end of the support member 53*a*. The support member 53*a* is formed from resin, for example ABS (acrylonitrile butadiene styrene) resin. The slide contact member 53*b* is formed from PET (polyethylene terephthalate). As shown in FIGS. 3 and 4, the support member 53*a* is formed integrally with a rotational shaft 55, which is axially supported between side walls 51*a*, 51*b* of the case 51. Also, as shown in FIG. 4, the slide contact member 53*b* has a transport surface with a width W1, that is, a length in the rotational radial direction of the rotational shaft 55. With this width W1, as shown in FIG. 2, the slide contact member 53*b* bends when in sliding contact with the toner holding chamber 52, at least with the cylindrically-shaped base surface portion 52*a* of the toner holding chamber 52. A gear 63 is fixed to one axial end of the rotational shaft 55 so that when rotational drive force from a motor (not shown) is transmitted to the gear 63, the agitator 53 rotates in the direction indicated by an arrow in FIG. 2. At this time, the slide contact member 53*b* slidingly contacts against the base surface portion 52*a* of the toner holding chamber 52 in a bent condition and pushes toner up into the opening A using the transport surface having the width W1.

Because both the slide contact member 53*b* and the support member 53*a* push the toner upward, opening portions 53*c* are formed in the support member 53*a* as shown in FIGS. 3 and 4 to decrease resistance received from the toner on the surface of the support member 53*a* during rotation. Also, the support member 53*a* and the slide contact member 53*b* are formed shorter than the case 51. As shown in FIG. 3, the support member 53*a* and the slide contact member 53*b* are separated from the light transmission windows 56*a*, 56*b* by a distance W2, so they do not contact the light transmission windows 56*a*, 56*b*. The distance W2 is set to a value that strikes a good balance between providing proper agitation of the toner, and not adversely effecting detection of remaining toner amount to enable sufficient detection precision. According to the present embodiment, it is desirable to set the distance W2 to a value within the range of 3 mm to 10 mm.

The opening A is formed in the case 51 to fluidly connect the toner holding chamber 52 and the developing chamber 57. The opening A extends substantially along the entire length of the toner holding chamber 52 and the developing chamber 57, that is, along the entire widthwise direction as viewed in FIG. 3. With this configuration, toner is supplied uniformly by the agitator 53 to the developing chamber 57 across the entire width of the toner holding chamber 52 and the developing chamber 57.

Figure 5:
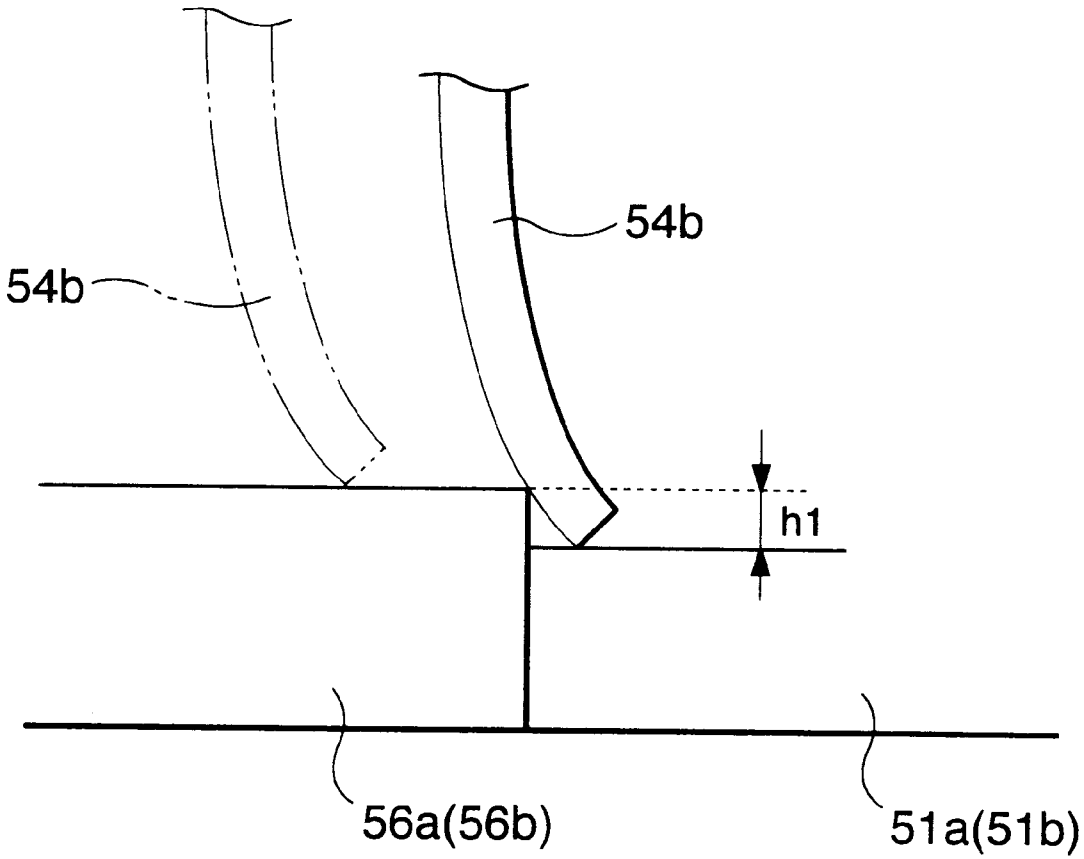
FIG. 5 is a schematic view showing the edge of a wiper in contact with a side wall of the toner holding chamber (as indicated in solid line) and in contact with a light transmission window (as indicated in two-dot chain line)

The light transmission windows 56 are transparent members formed from glass that has silicon oxide as its main component. The light transmission windows 56*a*, 56*b* can be formed from any transparent or opaque material, for example, acryl, polycarbonate, or polypropylene. As shown in FIGS. 3 and 4, the light transmission windows 56 include a light transmission window 56*a* and a light transmission window 56*b*. The light transmission window 56*a* is attached to a side wall 51*a* of the case 51 nearer the light generating means 60. The light transmission window 56*b* is attached to a side wall 51*b* of the case 51 nearer the light receiving means 61. Also, as shown in FIG. 5, the light transmission windows 56*a* and 56*b* protrude slightly into the interior of the toner holding chamber 52. With this configuration, a step with a height h1 is formed between the inner wall of the toner holding chamber 52 and the light transmission windows 56*a*, 56*b*. In the present embodiment, the height h1 is set to about 1 mm. The step is formed to a substantial right angle between the side surface of the light transmission windows 56*a*, 56*b* and inner wall surface of the toner holding chamber 52. Also, each of the light transmission windows 56*a*, 56*b* is formed with a substantial right angle between its side surface and its upper surface.

Also, the wiper 54*b* of the cleaning member 54 is configured to reliably wipe the surface of the light transmission windows 56*a*, 56*b*. Also, as shown in FIG. 2, the light transmission window 56*b* (56) is positioned nearer the opening A than a plane G, which extends vertically and includes the rotational center axis of the agitator 53 and the cleaning member 54. The plane G will be referred to as the vertical line G hereinafter. In other words, the toner holding chamber 52 is divided by the plane G into an imaginary first region (left side of the plane G in FIG. 2) and an imaginary second region (right side of the plane G in FIG. 2), and the light transmission windows are positioned in the imaginary first region. Further, as shown in FIGS. 3 and 4, the drum cartridge 2*a* is formed with opening portions 62*a*, 62*b* at positions corresponding to the light transmission windows 56*a*, 56*b*. The opening portion 62*a* enables transmission of light through the light transmission window 56*a* into the toner holding chamber 52, and the opening portion 62*b* enables transmission of light from the light transmission window 56*b* out of the toner holding chamber 52.

The cleaning member 54 is configured from a support member 54*a* and a wiper 54*b*. The support member 54*a* is formed integrally with the support member 53*a* of the agitator 53. As shown in FIG. 4, the wiper 54*b* is attached to a side edge of the support member 54*a*. The support member 54*a* of the cleaning member 54 has a phase angle of 180 degrees with the support member 53*a* of the agitator 53. Therefore, the support member 54*a* of the cleaning member 54 extends from the rotational shaft 55 in parallel with, but in the opposite direction of, the support member 53*a* of the agitator 53. The wiper 54*b* is formed from urethane rubber and is positioned so that, as indicated by two-dotted chain line in FIG. 5, it contacts the surface of the light transmission window 56*a* (56*b*) in a bent condition with a predetermined pressure by resilient force of the urethane rubber. Accordingly, by positioning the wiper 54*b* to press against the surface of the light transmission windows 56*a* (56*b*) with a predetermined pressure, then the wiper 54*b* will not bend as much when in contact with the inner surface of the side wall 51*a* (51*b*) of the toner holding chamber 52 as indicated by a solid tine in FIG. 5. The wiper 54*b* is formed with a length and hardness of rubber material so that it contacts the light transmission windows 56*a*, 56*b* with a corner edge, that is, rather than with a flush surface-to-surface contact. With this configuration, the wiper 54*b* slides against the surface of the light transmission windows 56*a*, 56*b* in association with the rotation of the support member 54*a*, and wipes toner off the surface of the light transmission window 56*a* (56*b*).

As shown in FIG. 3, the cleaning member 54 has a lateral width W3 from the edge in contact with the light transmission window 56*a* (56*b*), that is, while the wiper 54*b* is positioned in contact with the light transmission windows 56, to the other edge in a lengthwise direction of the toner holding chamber 52. The width W3 is greater than the space W2 described above.

As shown in FIGS. 3 and 4, the light emitting means 60 and the light reception means 61 are positioned on opposite sides of the developing unit 50 in correspondence with the light transmission windows 56*a*, 56*b*. The light emitting means 60 is configured from a plastic holder 60*a* attached to the frame 2*b*, a base plate 60*b* supported on the holder 60*a*, and a light emitting element 60*c* provided on the base plate 60*b*. A plastic lens 60*d* is formed integrally with the holder 60*a* in the side facing the light transmission window 56*a*. A light emitting diode is used as the light emitting element 60*c*. In the same way, the light reception means 61 is configured from a plastic holder 61*a* attached to the frame 2*b*, a base member 61*b* supported on the holder 61*a*, and a light receiving element 61*c* provided on the base member 61*b*. A plastic lens 61*d* is formed integrally with the holder 61*a* in the side facing the light transmission window 56*b*. A phototransistor is used as the light receiving element 61*c*.

As shown in FIGS. 3 and 4, the above-described light emitting element 60*c*, the plastic lens 60*d*, the opening portion 62*a* of the drum cartridge 2*a*, the light transmission window 56*a*, the light transmission window 56*b*, the opening portion 62*b* of the drum cartridge 2*a*, the plastic lens 61*d*, and the light receiving element 61*c* are aligned substantially linearly. Light emitted from the light emitting element 60*c* has its rays aligned parallel by the plastic lens 60*d* and falls incident on the light transmission window 56*a* by passing through the opening portion 62*a*. Accordingly, when no toner exists between the light transmission window 56*a* and the light transmission window 56*b*, light passing through the light transmission window 56*a* falls incident on the light transmission window 56*b* on the other side. The light passes through the light transmission window 56*b* and falls incident on the plastic lens 61*d* after passing through the opening portion 62*b*. The incident light is condensed by the plastic lens 61*d* and is received by the light receiving element 61*c*. Accordingly, even if the toner holding chamber is fairly wide, the light can be used to efficiently detect remaining amount of toner.

Figure 6:
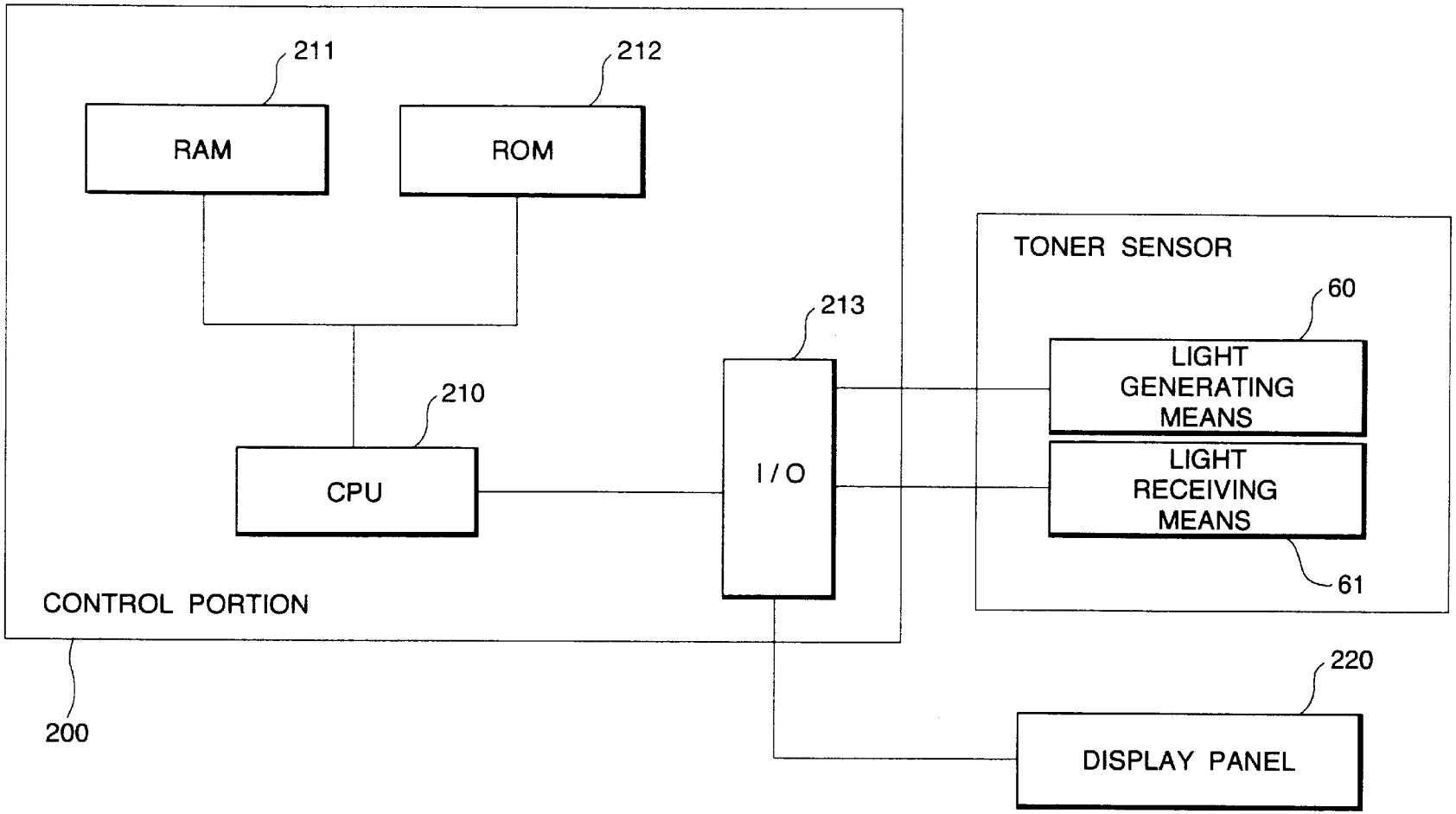
FIG. 6 is a block diagram schematically showing electrical configuration of the laser printer according to the first embodiment.
Figure 7:
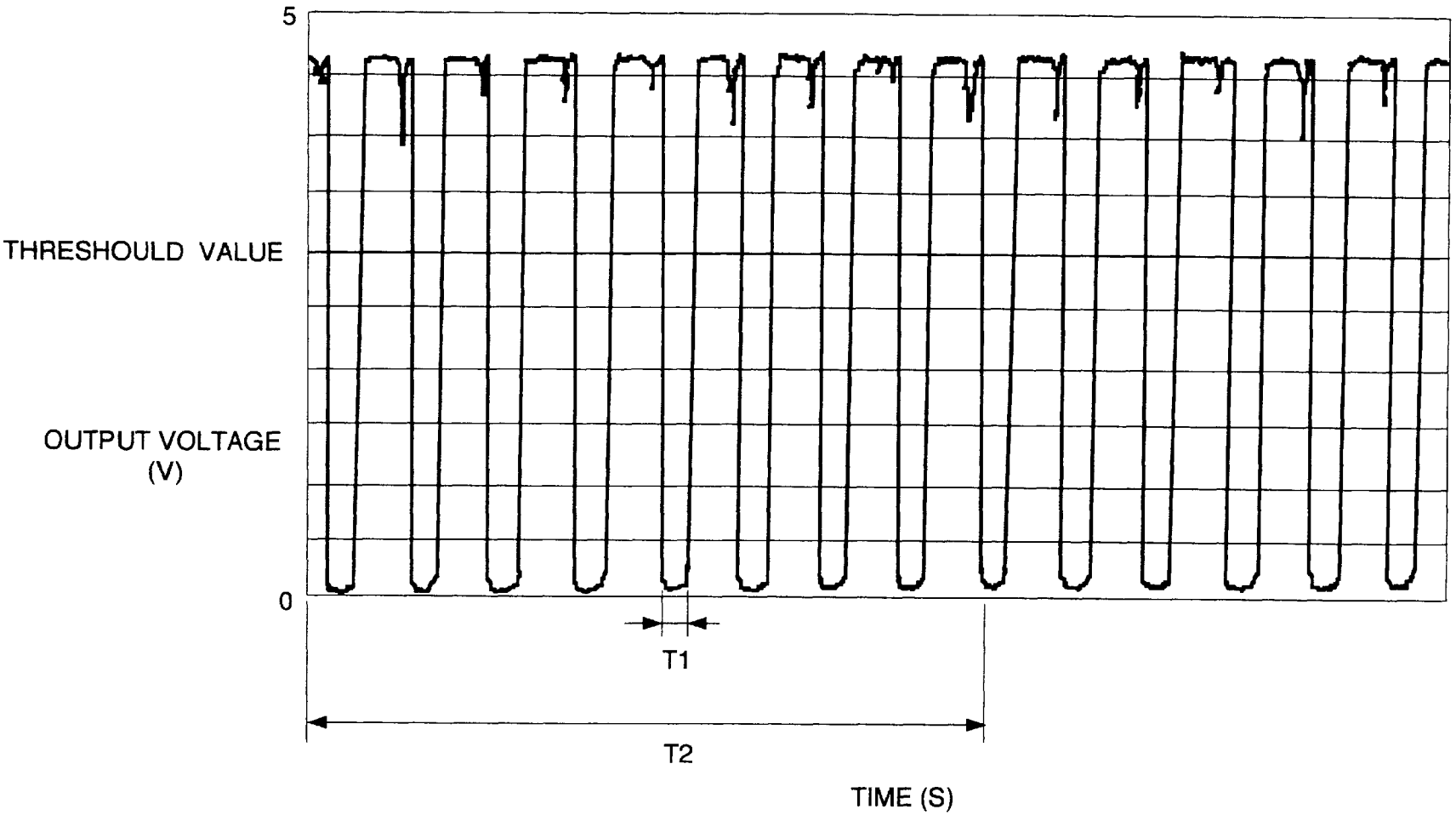
FIG. 7 is a graph representing changes in voltage output from a light receiving element, caused by rotation of the wiper that wipes toner off the light transmission windows.

As shown in FIG. 7, the light receiving element 61*c* outputs a voltage that changes in accordance with the amount of light received by the light receiving element 61*c*. According to the present embodiment, the light receiving element 61*c* outputs a voltage value of near 5V when it receives the minimum light amount, and outputs a voltage value of nearly 0V when it receives a maximum light amount. The output voltage value changes within this range according to the received light. In the present embodiment, remaining amount of toner is detected in the following manner. Output from the light receiving element 61*c* described above is read by a control portion 200 shown in FIG. 6. The control portion 200 is formed from a microprocessor and the like, and judges that output from the light receiving element 61*c* is at a high level when the output voltage value from the light receiving element 61*c* is greater than a predetermined set threshold value, and judges that output from the light receiving element 61*c* is at a low level when the output voltage value from the light receiving element 61*c* is less than the threshold value. The total time of all low level periods T1 during a measured unit period T2 is used to calculate the ratio of low level in the measured unit period T2. Using this calculation, the amount of remaining toner is detected. Because the device of the present embodiment uses the plastic lenses 60*d*, 61*d*, even if the toner holding chamber 52 is fairly wide, light irradiated from the light emitting element 60*c* can be effectively received to detect the amount of remaining toner, so the amount of remaining toner can be detected with a high degree of accuracy.

FIG. 6 is a block diagram showing schematic configuration of the control portion 200 according to the present embodiment. The control portion 200 includes a CPU 210, a RAM 211 for storing data, a ROM 212 for storing programs, and an input/output (I/O) interface 213. The ROM 212 and the RAM 211 are connected to the CPU 210. The CPU 210 monitors output from the light receiving element 61*c* through the I/O interface 213. According to the programs stored in the ROM 212, the CPU 210 measures the width of the pulse signal outputted from the light receiving element 61*c* over the I/O 213, interface and stores the width in the RAM 211. The CPU 210 judges whether or not the pulse width value stored in the RAM 211 has exceeded the predetermined threshold value. When it is determined that the pulse width value has exceeded the predetermined threshold value, the CPU 210 outputs a notification command for urging additional supply of toner, over the I/O interface 213, so that for example, a display panel 220 displays a message urging the user to replenish the toner.

A detailed explanation of example operations according to the first embodiment will be described below centered on operations for detecting remaining toner amount, and operations of the agitator 53 and the cleaning member 54.

First, an explanation will be provided for when a sufficient amount of toner fills the toner holding chamber 52, so that, as indicated by the upper dotted line in FIG. 8(A), the uppermost surface of the remaining toner (referred to as "toner surface" hereinafter) is extremely higher than the position of the light transmission windows 56*a*, 56*b*. By rotation of the agitator 53, the slide contact member 53*b* slidingly contacts the wall surface of the toner holding chamber 52 while agitating the toner in the toner holding chamber 52. Moreover, the slide contact member 53*b* of the agitator 53 transports toner from the toner holding chamber 52 into the developing chamber 57 when the slide contact member 53*b* reaches the opening A as indicated in solid line in FIG. 2 and passes by the opening A. On the other hand, although the wiper 54*b* of the cleaning member 54 operates to wipe off the surface of the light transmission windows 56*a*, 56*b*, the surface of the light transmission windows 56*a*, 56*b* that are wiped by the wiper 54*b* will be promptly covered over again by the surrounding toner because sufficient toner remains between the light transmission windows 56*a*, 56*b*. Accordingly, light emitted from the light emitting element 60*c* will not pass through the toner holding chamber 52, so the output from the light receiving element 61*c* will not fluctuate.

Next, an explanation will be provided for when the amount of remaining toner drops until, as indicated by a solid line in FIG. 8(A), the toner surface approaches the position of the light transmission windows 56*a*, 56*b*. In this case, the light transmission windows 56*a*, 56*b* will not be covered by toner immediately after being wiped off by the wiper 54*b*. Because the detection light from the light emitting element 60*c* has an optical axis that traverses across the toner holding chamber 52, the detection light falls incident on and passes through the light transmission window that is provided in the widthwise opposite side surface of the toner holding chamber, whereupon it is received by the light receiving element 61*c*.

Figure 8:
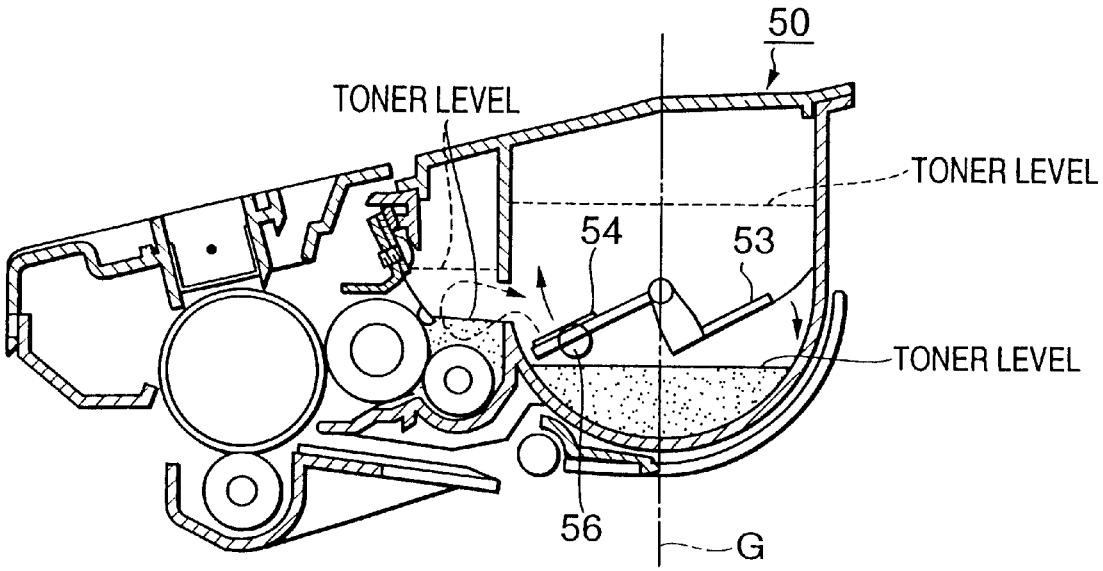
FIG. 8(A) is a cross-sectional view showing operation of the wiper when different levels of toner remain in the toner holding chamber.
FIG. 8(B) is a schematic view indicating position of an agitator in the toner holding chamber when the wiper is wiping the light transmission window.
Figure 8:
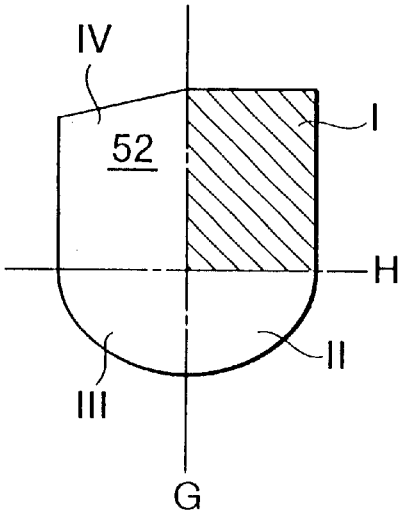
Figure 9:
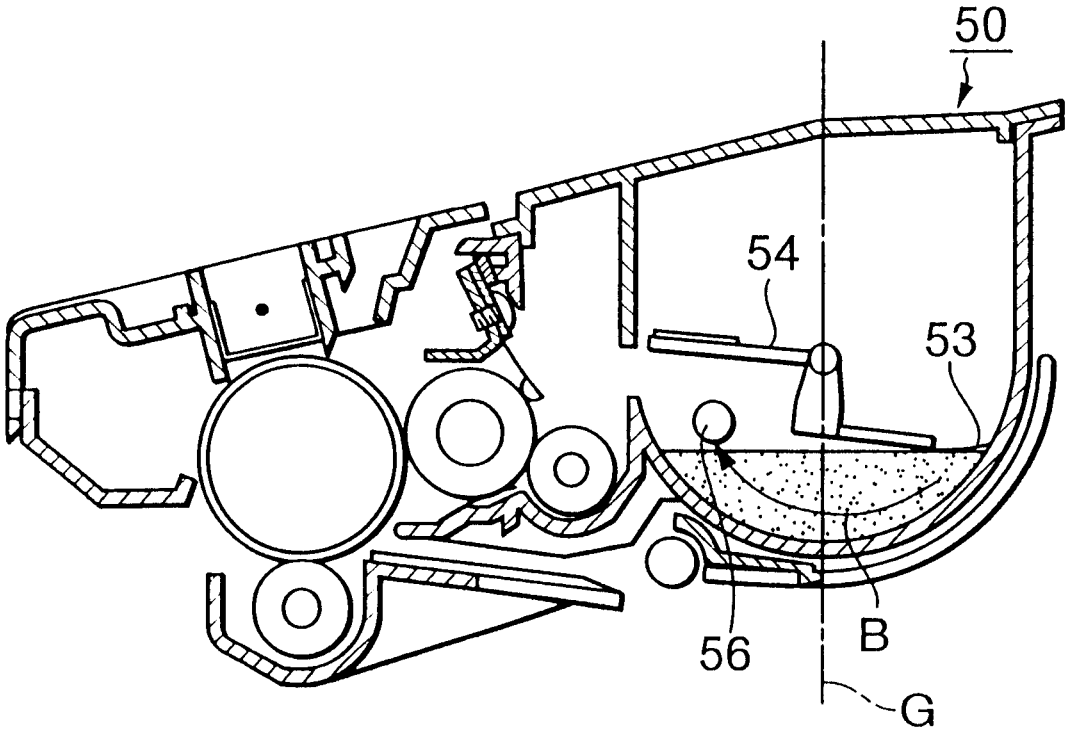
FIG. 9 is a cross-sectional view showing relative positions of the wiper and the agitator directly after the wiper wipes toner off the light transmission window.

When the wiper 54*b* rotates from the position indicated in FIG. 8(A) to the position shown in FIG. 9, the slide contact member 53*b* of the agitator 53 deformingly presses side wall of the toner holding chamber 52. In association with further rotation of the agitator 53, the slide contact member 53*b* enters into the toner housed at the bottom of the toner holding chamber 52, while slidingly contacting the bottom surface portion 52*a* of the toner holding chamber 52 in a bent posture. Therefore, the transport surface of the slide contact member 53*b* presses the toner in the direction indicated by an arrow B in FIG. 9, so that the toner covers the light transmission windows 56*a*, 56*b*. How long the transmission windows 56*a*, 56*b* remain uncovered before the slide contact member 53*b* presses the toner to cover the light transmission windows 56*a*, 56*b* depends on the amount of toner remaining in the toner holding chamber 52. That is to say, the greater the amount of remaining toner, the less time will elapse before the light transmission windows 56*a*, 56*b* are covered. The less the amount of remaining toner, the longer the time until the light transmission windows 56*a*, 56*b* are covered. Accordingly, the greater the toner amount, the shorter the time that the light receiving element 61*c* outputs the low level period Ti shown in FIG. 7. The lower the toner amount, the longer that the light receiving element 61*c* outputs the low level period T1 shown in FIG. 7. According to the present embodiment, the above described control portion 200 samples the output voltage value from the light receiving element 61*c* at a predetermined sampling cycle and stores the sampling values. When the ratio of the total low level period T1 during the predetermined measuring unit period T2 exceeds the predetermined ratio, a judgment falls "toner empty".

As described above, in the developing unit 50 according to the first embodiment, stable detection of remaining toner is performed by using the wiper 54*b* of the cleaning member 54 to wipe the surface of the light transmission window 56 while using the agitator 53 to agitate and transport the toner in the toner holding chamber 52.

In particular, according to the present embodiment, the light transmission window 56 is disposed on side of the vertical plane G nearer the opening A, i.e., the light transmission window 56 is positioned in the imaginary first region described above). In addition, the wiper 54*b* and the agitator 53 are configured so that at the time that the wiper 54*b* is actually wiping the light transmission window 56 as shown in FIG. 8(A), the agitator 53 is positioned opposite from the opening A with respect vertical plane G, i.e., the agitator 53 is positioned at the above described imaginary second region, and is positioned above a horizontal plane H passing through a center of the light transmission window 56. "H" will be referred to as the light transmission window horizontal plane H hereinafter. That is, if the interior of the toner holding chamber 52 is divided into four regions I to IV by the vertical plane G and the light transmission window horizontal plane H as shown in FIG. 8 (B), then the agitator 53 is positioned in region I as indicated by hatching in FIG. 8(B) when the wiper 54*b* is wiping the light transmission window 56. With this configuration, detection of remaining toner can be performed extremely stably over a long period of use.

Next, the relative positional relationship of the light transmission window 56, the agitator 53, and the cleaning member 54 according to the first embodiment will be described in detail.

First, when the agitator 53 is rotated from the position shown in FIG. 9, that is, from the position opposite from the opening A with respect to the vertical plane G, to the position adjacent the opening A as shown in FIG. 2, the transport surface of the slide contact member 53*b* pushes and moves the toner in the direction indicated by the arrow B in FIG. 9. When the slide contact member 53*b* of the agitator 53 reaches the position shown in FIG. 2, a pile of toner will be piled onto the transport surface of the slide contact member 53*b*. Although the resilient PET slide contact member 53*b* is positioned to bend when contacting the circular surface portion of the toner holding chamber 52, the bending of the slide contact member 53*b* is released when the slide contact member 53*b* reaches the opening A. When the slide contact member 53*b* reverts to its original straight shape by resilient force of the PET rubber, the toner that is piled on the transport surface of the slide contact member 53*b* is supplied energetically into the developing chamber 57.

A portion of the toner will remain on the surface of the support member 53*a* of the transport surface of the slide contact member 53*b*. After the slide contact member 53*b* passes the opening A, and is rotated beyond a horizontal posture, then the remaining toner will fall down off the surface of the support member 53*a* and the transport surface of the slide contact member 53*b*.

Also, directly after the agitator 53 passes by the opening A, the slide contact member 53*b* of the agitator 53 will be in sliding contact in a bent condition against a forward wall 52*b* shown in FIG. 2. However, when the agitator 53 rotates further, the slide contact member 53*b* separates from the forward wall 52*b*, so that the bending is again released. At this time, toner clinging to the transport surface of the slide contact member 53*b* and the support member 53*a* will scatter. Because the toner is an extremely fine powder as described above, when the bending of the slide contact member 53*b* is released, the toner will billow up into a cloud-like condition in the toner holding chamber 52 when the toner falls from the support member 53*a* and the transport surface of the slide contact member 53*b*. However, by the agitator 53 rotates to the opposite side of the opening A with respect to the vertical plane G, the toner will already have settled and the toner surface level will be in horizontal condition. The toner surface is particularly level according to the first embodiment, because polymerized toner is used, which has excellent fluidity. When rotation of the agitator 53 progresses further to reach the position indicated in FIG. 8(A), the wiper 54*b* of the cleaning member 54 reaches the surface of the light transmission window 56. By this time, the toner is in a stable condition as described above, so that the light transmission window 56 is not contaminated by toner once wiped by the wiper 54*b*. It should be noted that a timing of release of deformation of the slide contact member 53*b* only occur when the slide contact member 53*b* is in the imaginary first region. Therefore, when the slide contact member 53*b* is in the imaginary second region, toner scattering does not happen to provide a stable condition of the toners.

Although polymerized toner tends to easily billow up into a cloud as described above, it also has a small angle of rest on the slide contact member 53*b* and on the support member 53*a*, so only a small amount of toner remains thereon. Accordingly, the toner will have sufficiently settled by the time the agitator 53 has rotated to the position opposite from the opening A with respect the vertical plane G, even if the fluidity of the toner changes over a long period of use so that it takes longer for the toner to settle after billowing up. Therefore, the light transmission window 56 will remain clean after being wiped off by the wiper 54*b*.

According to the first embodiment, the light transmission window 56 is provided on the same side of the vertical plane G as the opening A. Also, the slide contact member 53*b* of the agitator 53 is positioned on the opposite side of the vertical plane G than the opening A and at a position higher than the light transmission window at the time when the wiper 54*b* is wiping the light transmission window 56. That is, the slide contact member 53*b* is positioned in region I as indicated by hatching shown in FIG. 8(B). Therefore, even if a slight amount of toner clings to the sliding contact portion 53*b* and falls off when the cleaning member is cleaning the light transmission window, it will not fall on the light transmission window(because the light transmission windows are not positioned immediately below the sliding contact portion 53*b* in this phase), so the freshly cleaned light transmission window will remain clean.

As mentioned previously, the duration of time from when the wiper 54*b* finishes wiping the light transmission window 56 until the slide contact member 53*b* pushes toner to cover the light transmission window 56, depends on the amount of toner existing in the rotational orbit of the slide contact member 53*b*. That is, the greater the remaining amount of toner, the longer the time period during which the light transmission window 56 is covered by the toner, and the smaller the amount of toner, the shorter that time period.

The output from the light receiving element indicates how much light the light receiving element receives. In other words, if the output value of the light receiving element reaches a predetermined value or greater, then it is judged that the amount of light received from the light transmission window has reached a predetermined value or greater. The length of time that the output value is equal to or greater than the predetermined value corresponds to the length of time between a light reception condition and a non-light reception condition, that is, the time duration from when the cleaning member cleans the light transmission window to when the toner pressed up by the slide contact member 53*b* covers the light transmission window 56. The length of time depends on the amount of toner remaining in the toner holding chamber. Accordingly, by measuring the time that the voltage output from the light receiving element is the predetermined value or greater, then the remaining amount of toner can always be stably detected, without any variation due to change in the fluidity of the toner. Also, because the time that the output from the light receiving element is the predetermined value or greater corresponds to the amount of remaining toner, reduction in amount of remaining toner can be determined not only in a binary determination of whether toner exists or not, but also in a step-like manner.

Further, since the light transmission window 56 is positioned in the imaginary first region, and since the slide contact portion 53*b* of the wiper is positioned higher than the light transmission window 56 when the wiper 54*b* is at its cleaning position, time period until the toner covers the light transmission window 56 after the wiping operations depends only on the amount of settled toner. Therefore, detection of remaining toner can be accurately and stably performed over a long period of time. In particular, the fluidity of the toner is extremely high because substantially spherical polymerized toner is used as the toner, and also silica with a small particle diameter (BET value of 150) is used as outer additive. Thus, the uniform mobility of the toner results when the toner is pressed out by the slide contact member 53*b*.

According to the present embodiment, large diameter silica with BET value of 50 is also added to the toner in addition to the small diameter silica with BET value of 150. If only external additive with a small particle diameter was added, the external additive become embedded in the toner base particle, so that fluidity of toner would gradually dropped. However, the large diameter silica with BET value of 50 functions as a spacer so that the small diameter silica with BET value of 150 is prevented from becoming imbedded into the toner base particle. Therefore, fluidity of the toner can be maintained in a good condition until a toner empty condition is judged. That is, although adding the large diameter silica with BET value of 50 results in a toner fluidity that is initially lower than if only small diameter silica with BET value of 150 were, in the long run, small diameter silica with BET value of 150 can be prevented from becoming imbedded in the toner base particle, so that the toner fluidity can be constantly maintained in a good condition. The mobility of toner can be uniform over the entire toner area when pushed up by the slide contact member 53*b*. Accordingly, less toner remains on the slide contact member 53*b* of the agitator 53 that is not supplied to the toner holding chamber 52 through the opening A to the developing chamber 57. Therefore, less toner will fall from the slide contact member 53*b* when pressed up to and above the opening A by the slide contact member 53*b*. As a result, the output from the light receiving element will be less distorted by falling toner and the amount of remaining toner can be detected even more accurately. The time required for the pushed up toner to settle to the bottom of the toner holding chamber 52 is always maintained to a fixed time. In this way, the behavior of the toner that is pushed up by the slide contact member 53*b* is stable and the remaining amount of toner can be stably and accurately detected over long periods of time.

In the first embodiment, the light transmission window 56 is positioned at the imaginary first region. However, it is possible to position the light transmission window 56 at the imaginary second region, i.e., opposite from the opening A with respect to the vertical plane G. In this case, it is necessary that the slide contact member 53*b* is positioned in the imaginary second region when the wiper 54 is in confrontation with the light transmission window.

With this arrangement, toner that is pushed up by the slide contact member 53*b* would not cover the light transmission windows. However, with this configuration, the light transmission windows would be contaminated by toner that scatters around the toner holding chamber 52 or that billows up into a cloud when it drops from the slide contact member 53*b*. However, with the configuration of the present modification, the wiper 54 does not clean the light transmission window 56 when toner is falling or is scattered. Instead, the wiper 54 cleans the light transmission window when the slide contact member 53*b* has rotated into a region that is on the opposite side of the vertical plane G from the opening A. By this time, the toner will have settled to the lower position of the toner holding chamber 52. Even if a small amount of toner clings to the slide contact member 53*b*, the toner will be flung off by resilient force of the slide contact member 53*b*, so that no toner will cling to the slide contact member 53*b* when the slide contact member 53*b* rotates to the side of the vertical plan G opposite from the opening A. Accordingly, even if the fluidity of the toner changes so that it does not easily fall off the slide contact member 53*b*, which changes the time that the toner disrupts the toner holding chamber, the toner will be in a sufficiently stable condition by the time the slide contact member 53*b* rotates into the imaginary second region. Also, even if the agitator 53 is positioned immediately above the light transmission window 56, the light transmission window that was cleaned by the wiper 54 will not be dirtied by toner because the toner will not fall off the slide contact member 53*b*.

According to the first embodiment, by forming the slide contact member 53*b* of the agitator 53 from a flexible member, the toner is agitated and transported well. Also, the cleaning member 54 cleans the light transmission window 56 after toner that was moved by the agitator 53 has settled into a stable condition. Therefore, the amount of remaining toner can always be detected accurately, without varying with changes in fluidity of the toner.

The agitator 53 does not positively move the toner in the toner holding chamber 52 in the lengthwise direction (widthwise direction of the image recording sheet) of the toner holding chamber, but moves the toner in the frontward-rearward and radial directions of the toner holding chamber 52. Moreover, polymerized toner, which provides high fluidity in nature, is used as toner. Therefore, any unevenness in distribution of toner within the toner holding chamber 52 can be quickly removed by merely rotating the agitator 53 within the toner holding chamber 52. Accordingly, the toner surface can be quickly returned to a flush condition even if toner in the toner holding chamber 52 temporality accumulates unevenly in certain areas of the toner holding chamber 52, for example, when the laser beam printer 1 is moved around or the developing cartridge is removed from and placed back into the laser beam printer 1. Unevenness in the toner in the toner holding chamber 52 can be prevented so that the amount of remaining toner can always be reliably detected.

The opening A, which connects the toner holding chamber 52 and the developing chamber 57, extends across the entire width of the toner holding chamber 52 and the developing chamber 57 so that toner is transported by the agitator 53 from the toner holding chamber 52 to the developing chamber 57 uniformly in the widthwise direction of the toner holding chamber 52 and the developing chamber 57, thereby preventing any uneven transport of toner. Accordingly, unevenness of toner in the toner holding chamber 52 can be even more reliably prevented so that accurate detection of remaining toner amount is possible.

Further, because the agitator 53 agitates the toner in the toner holding chamber 52, even if a large quantity of narrow-width printing targets, such as envelops or postcards, are printed on in succession, unevenness of the toner in the toner holding chamber 52 can be reliably prevented. That is to say, when a large quantity of narrow-width printing targets, such as envelopes or postcards, are printed in succession, toner tends to be locally consumed at portions of the toner holding chamber 52 that correspond to the narrow width of the printing targets. However, because the agitator 53 uniformly distributes the unevenly consumed toner, and because the polymerized toner has a high fluidity, any unevenness in distribution of toner in the toner holding chamber 52 will be quickly corrected. According to the laser beam printer 1 of the present embodiment, unevenness in distribution of toner in the toner holding chamber 52 can be reliably prevented not only when the toner is unevenly distributed because the laser beam printer itself is moved around or a developing cartridge is moved from or inserted into the laser beam printer 1, but also when a large quantity of narrow width printing targets, such as envelops and postcards, are printed in succession. Therefore, the amount of remaining toner can be always reliably detected.

Toner supplied from the toner holding chamber 52 through the opening A into the developing chamber 57 is applied with an electric charge by friction generated where the toner supply roller 58 and the developing roller 59 press against each other. The toner is then borne on the developing roller 59 by static electricity. Rotation of the developing roller 59 transports the toner borne on the developing roller 59 to where the contact portion 64*b* of the layer thickness regulation blade 64 presses against the developing roller 59. The toner, which includes an external additive, is applied with further electric charge by contact with the contact portion 64*b* of the layer thickness regulation blade 64 and the developing roller 59. The external additive receives the pressure from the contact portion 64*b* and the developing roller 59. However, because the contact portion 64*b* of the layer thickness regulation blade 64 is formed from a resilient rubber material, the contact portion 64*b* deforms slightly to match the form of the external additive, which slightly protrudes out from the toner base body of the toner. Also, because the developing roller 59 is similarly formed from a resilient rubber material as described above, the developing roller 59 also deforms to match the protruding form of the external additive. As a result, pressure applied to the external additive is reduced, thereby reducing the amount that the external additive becomes embedded in the toner base body.

After being applied with a sufficient electric charge by friction at the contact portion between the layer thickness regulation blade 64 and the developing roller 59, the toner passes by the pressure portion between the layer thickness regulation blade 64 and the developing roller 59 and reaches the developing region in confrontation with the photosensitive drum 20. A portion of the toner transported to the developing region selectively clings to the surface of the photosensitive drum 20 according to the electrostatic latent image formed on the surface of the photosensitive drum 20. The remaining toner is returned to the toner holding chamber 52 after following a toner circulation route indicated by a dotted line arrow in FIG. 8, by rotation of the developing roller 59 and the toner supply roller 58. That is, the remaining toner is returned to the developing chamber 57 by rotation of the developing roller 59, and returned to the toner holding chamber 52 from the developing chamber 57 through the opening A.

Because the pressing force between the layer thickness regulation blade 64 and the developing roller 59 does not embed the external additive into the base body of the toner to be returned to the toner holding chamber 52, even if the toner is used for a long period of time, the fluidity of the toner in the toner holding chamber 52 will not be reduced. Therefore, toner pressed up by the agitator 53 will again settle to the bottom of the toner holding chamber 52 after a predetermined time elapses. Because the fluidity of the toner is not reduced, the time required for the toner to settle in the toner holding chamber 52 will remain unaffected by fluidity of the toner, from when use of the toner first starts until a toner empty condition is judged. As a result, the developing device 50 of the present embodiment can accurately and stably detect remaining amount of toner.

In particular, the contact portion 64*b* of the layer thickness regulation blade 64 of the present embodiment is formed from silicone rubber, and so has excellent characteristics for charging toner by friction. Therefore, layer thickness regulation blade 64 properly charge the toner by using a lower pressing force than a layer thickness regulation blade formed from some other rubber material. Because only a relatively small pressing force is required, the external additive can be prevented from becoming embedded into the toner base particle with even greater reliability.

If the contact portion 64*b* of the layer thickness regulation blade 64 is formed from fluorine containing rubber or urethane rubber, the charge characteristic of fiction charging the toner is reduced in comparison with the employment of the silicone rubber. In this case, the layer thickness regulation blade 64 needs to be pressed against the developing roller 59 with a greater force than when silicone rubber is used. However, even when the pressing force is increased in this way, the contact portion 64*b* deforms by resilient force of the rubber material to match the protruding form of the external additive. Therefore, the amount that external additive is embedded into the toner base particle can be suppressed to a only slight amount compared to when the contact portion is formed from a metal, such as stainless steel. The amount of embedment can be suppressed to a sufficiently low amount so that the toner remains highly fluid, and the remaining toner amount can be stably detected.

Further, it is difficult to completely remove toner from the light transmission windows 56 using a wiper or other cleaning member, when spherical polymerized toner is used as toner. A small amount of the toner may remain on the window even by the wiping. When the wiper passes over the toner, the toner may be frictionally moved relative to the window 56, thereby generating filming.

Because the wiper 54*b* is configured to slide with a weak pressing force along the inner surface of the toner holding chamber 52 before sliding against the light transmission windows 56*a*, 56*b*, some external additive and fine toner particles can work under the wiper 54*b* when sliding against the inner wall of the toner holding chamber 52. The wiper 54*b* moves along the inner surface of the toner holding chamber 52 while scraping such external additive and fine toner particles against the toner holding chamber 52. If the wiper 54*b* were to continue sliding across the surface of the light transmission windows 56*a*, 56*b* with toner or external additive in this condition, the external additive or fine toner would also scrape against the surface of the light transmission windows 56*a*, 56*b*, and filming would be easily generated.

However, according to the present embodiment, a step with a predetermined height is provided between the inner surface of the toner holding chamber 52 and the upper surface of the light transmission windows 56*a*, 56*b* as shown in FIG. 5. Moreover, because the step portion is formed with a substantially right angle, any external additive or fine toner particles that is caught between the wiper 54*b* and the inner wall of the toner holding chamber 52 as the wiper 54*b* slides along the inner surface of the toner holding chamber 52 will be largely removed at the step portion and the right angular portion of the step portion. Therefore, filming on the inner surface of the light transmission windows 56*a*, 56*b* can be reliably prevented.

Because the light transmission windows 56*a*, 56*b* protrude toward the inside of the toner holding chamber 52 from the inner surface of the toner holding chamber 52, the wiper 54*b* bends to a greater degree when sliding across the light transmission windows 56*a*, 56*b* than when sliding across the inner surface of the toner holding chamber 52. Therefore, the wiper 54*b* slides across the surface of the light transmission windows 56*a*, 56*b* with a predetermined pressure derived from this resilient bending. Accordingly, by setting the pressing force of the wiper 54*b* against the light transmission windows 56*a*, 56*b* to an appropriate value, the wiper 54*b* will press with a smaller force against the inner surface of the toner holding chamber 52, which is positioned lower than the light transmission windows 56*a*, 56*b*. As a result, the load generated by friction between the wiper 54*b* and the inner wall of the toner holding chamber 52 when the wiper 54*b* slides against the inner wall of the toner holding chamber 52 can be reduced. Also, small diameter toner components, which are the cause of filming, can be prevented from accumulating on the wiper 54*b* when the wiper 54*b* scrapes against the inner surface of the toner holding chamber 52. As a result, filming on the light transmission windows 56*a*, 56*b* can be even more greatly reduced.

In order to prevent external additive and fine toner particles from scraping against the inner surface of the toner holding chamber 52, which is a cause of filming, it is conceivable to design the wiper 54*b* and the toner holding chamber 52 so that the wiper 54*b* does not contact the inner surface of the toner holding chamber 52 at all. However, when the wiper 54*b* and the inner surface of the toner holding chamber 52 are in non-contacting condition, when the wiper 54*b* wipes off the surface of the light transmission windows 56*a*, 56*b* and rotates toward the opening A, toner can fall through the gaps between the wiper 54*b* and the inner surface of the toner holding chamber 52. These falling toner particles may dirty the surface of the light transmission windows 56*a*, 56*b* immediately after the light transmission windows 56*a*, 56*b* are wiped off. According to the present embodiment, the wiper 54*b* slides across the inner surface of the toner holding chamber 52. However, the pressing force of the wiper 54*b* against the inner surface of the toner holding chamber 52 is set weak, but strong enough to prevent toner from falling between the wiper 54*b* and the inner surface of the toner holding chamber 52. With this configuration, toner can be reliably prevented from falling onto the light transmission windows 56*a*, 56*b* after the light transmission windows 56*a*, 56*b* have are wiped off.

According to the present embodiment, the wiper 54*b* is formed from urethane rubber, which has sufficient resistance against abrasion. Also, the edge portion of the wiper 54*b* slides against the inner surface of the toner holding chamber 52 and the surface of the light transmission windows 56*a*, 56*b*. Therefore, polymerized toner, which is spherical and difficult to pick up, can be easily picked up. Therefore, no thin layer of polymerized toner will remain on the surface of the light transmission windows 56*a*, 56*b*, so the amount of remaining toner can be reliably detected. Also, because the wiper 54*b* is formed from urethane rubber, the edge of the wiper 54*b* will not be abraded down into a curve over long periods of use. As a result, the ability of the wiper 54*b* to properly collect toner can be maintained, and the amount of remaining toner can be reliably detected, over long periods of time.

According to the present embodiment, external additives with a large diameter is used in addition to external additive with a small particle diameter for contributing to fluidity of the toner. The external additive with a large particle diameter operates as a polishing agent to even more reliably prevent filming on the surface of the light transmission windows 56*a*, 56*b*. Even if a small amount of polymerized toner gets under the edge portion of the wiper 54*b* and is scraped against the surface of the light transmission windows 56*a*, 56*b*, the external additive with a large particle diameter operates as a polishing agent and so reliably removes the toner by scraping onto the light transmission windows 56*a*, 56*b*. Accordingly, the surface of the light transmission windows 56*a*, 56*b* can be scraped off well without changing the light transmission characteristic of the light transmission windows 56*a*, 56*b*. Therefore, the amount of remaining toner can be reliably detected. Also, according to the present embodiment, the light transmission windows 56*a*, 56*b* are formed from glass that contain silicon oxide as its main component. Therefore, the surface of the light transmission windows 56*a*, 56*b* will not be scratched or otherwise damaged, even when external additive with a large particle diameter that is formed from a hard material, such as silica, contacts the surface of the light transmission windows 56*a*, 56*b*. Because the surface of the light transmission windows 56*a*, 56*b* remains smooth, detection light will not be scattered, and detection of the remaining toner amount can be performed with high precision. It should be noted that although in the present embodiment, the light transmission windows 56*a*, 56*b* are formed entirely from glass, the present invention is not limited to such a configuration. It is sufficient to form at least the portion of the light transmission windows 56*a*, 56*b* that is contacted by the wiper 54*b* is formed from glass.

As described above in the present embodiment, the side end of the support member 53*a* and the side end of the slide contact member 53*b* are spaced away from the light transmission window 56*a*, 56*b* by the space W2 in the lengthwise direction of the toner holding chamber 52, i.e., in the widthwise direction of the image recording sheet. Therefore, as will be described hereinafter, they will not adversely affect detection of remaining toner amount when transporting and agitating the toner in the toner holding chamber 52.

Assuming that if the distance W3 is zero, when the agitator 53 rotates and approaches the light transmission windows 56*a*, 56*b*, the side ends of the support member 53*a* and the slide contact member 53*b* would contact the light transmission windows 56*a*, 56*b* and wipe off the surface of the light transmission windows 56*a*, 56*b*. In such a case, if the light transmission window 56 is covered with toner in accordance with the rotation of the agitator 53 after wiping operation by the wiper 54, there is a danger that light will be transmitted through the light transmission windows 56*a*, 56*b* in the instant the agitator 53 wipes off the window 56. This will appear as noise in the signal from the light receiving element, that is a temporary low level output from the light receiving element when the output should be at a high level.

Further, because the slide contact member 53*b* of the agitator 53 is formed from PET, it has a relatively small friction coefficient with respect to the light transmission windows 56, if the windows 56 is formed from acryl or polycarbonate. Accordingly, if no space W2 where provided, then when the slide contact member 53*b* contacts the light transmission windows 56*a*, 56*b*, the toner may not be sufficiently wiped off so that light is not transmitted uniformly through the light transmission windows 56*a*, 56*b*. This will appear as random noise. It is difficult to cancel out such noise by attempting to predict how the agitator 53 will affect transmission of light. Therefore, it is impossible to avoid degradation and precision of detection of remaining toner amount.

In contrast to this, because the space W2 is provided according to the present embodiment so that the agitator 53 does not wipe off the light transmission windows 56*a*, 56*b*, the above-described problems do not occur. That is to say, noise is not generated in the output voltage from the light receiving element 61*c* in association with rotation of the agitator 53. Thus, it is possible to stably and reliably detect the amount of remaining toner.

According to the present embodiment, the space W2 is set within the range of 3 mm to 10 mm. Because the space W2 is sufficiently small, i.e., not more than 10 mm, the slide contact member 53*b* of the agitator 53 properly agitates the toner even at end portions of the toner holding chamber 52 in the lengthwise direction of the toner holding chamber 52.

On the other hand, the space W2 is sufficiently large, i.e., not less than 3 mm to prevent the force of the agitator 53 passing nearby the light transmission windows 56*a*, 56*b* from removing toner that clings to the light transmission windows 56*a*, 56*b*. Therefore, problems described above for the hypothetical situation of when the agitator 53 contacts the light transmission windows 56*a*, 56*b* will not occur.

Further, because the above-described width W3 of the cleaning member 54 is greater than the space W2. Even if the slide contact member 53*b* does not agitate toner in the space W2, the region of the cleaning member 54 and the region of the slide contact member 53 will overlap as the wiper 54*b* and the slide contact member 53*b* rotate so that the toner in the space W2 is properly agitated by the wiper 54*b*.

The wiper 54*b* is desirably provide high friction coefficient with respect to the light transmission windows 56*a*, 56*b* so that the wiper 54*b* of the cleaning member 54 will properly clean toner from the surface of the light transmission windows 56*a*, 56*b*. That is to say, when the wiper 54*b* has a small friction coefficient with respect to the light transmission windows 56*a*, 56*b*, then some toner will remain incompletely wiped off. The remaining toner on the light transmission windows 56*a*, 56*b* can interfere with the transmission of light through the light transmission windows 56*a*, 56*b*. The wiper 54*b*, which is formed from urethane rubber, has a sufficiently large friction coefficient with respect to the light transmission windows 56*a*, 56*b* and also with respect to clinging toner. As a result, the wiper 54*b* can wipe off most of the toner clinging to the light transmission windows 56*a*, 56*b* by scraping against the light transmission windows 56*a*, 56*b*. The light transmission windows 56*a*, 56*b* can be cleaned to a degree that does not interfere with detection of remaining toner amount. It should be noted that friction coefficient referred herein describes friction coefficient per unit area.

In contrast to this, it is desirable that the slide contact member 53*b* have a lower friction coefficient with respect to the floor portion 52*a* of the toner holding chamber 52 than the wiper 54*b* has with respect to the light transmission windows 56*a*, 56*b*. This is because the slide contact member 53*b* must have a small friction coefficient with respect to the floor portion 52*a* and to the toners so that the slide contact member 53*b* can smoothly agitate and transport toner in the toner holding chamber 52. That is, if the sliding resistance is reduced, then the torque required to the agitator 53 can be reduced, and also damage to the toner itself can be reduced. Because the slide contact member 53*b* is formed from PET, the slide contact member 53*b* has a sufficiently low friction coefficient with respect to toner and to the floor portion 52*a* of the toner holding chamber 52. Therefore, the above-described potential problem does not occur.

In the case of the present embodiment, the wiper of the cleaning member 54 and the slide contact member 53*b* of the agitator 53 are formed from different materials. However, it is conceivable to form both from the same material. In this case, it can be difficult to achieve the abovedescribed relationships in friction coefficient for both the wiper 54*b* and the slide contact member 53*b*. To this effect, pressing force of both the wiper 54*b* and the slide contact member 53*b* can be adjusted to meet these requirements. That is, configuration can be adjusted to increase the pressing force of the wiper 54*b* against the light transmission windows 56*a*, 56*b* and to reduce the pressing force of the slide contact member 53*b* against the floor member 52*a* to less than the pressing force of the wiper 54*b* against the light transmission windows 56*a*, 56*b*. It should be noted that the pressing force referred herein refers to press force applied per unit area.

In concrete terms, pressing force of the wiper 54*b* can be sufficiently increased for example by increasing the bending amount when scraping against the light transmission windows 56*a*, 56*b* or by increasing the resiliency itself of the wiper 54*b*. With such configurations, the toner clinging to the light transmission windows 56*a*, 56*b* is easily wiped off. On the other hand, the pressing force of the slide contact member 53*b* can be sufficiently reduced by, for example, reducing the bending amount of the slide contact member 53*b* when scraping against the floor portion 52*a* of the toner holding chamber 52 or by reducing the resiliency of the slide contact member 53*b*. With such configurations, damage to the toner and increase in torque which can occur when sliding resistance is increased can be avoided.

As described above, according to the present embodiment, detection of remaining toner amount can be performed stably with higher precision without sacrificing capability of properly agitating the toner.

Experiment 1

Figure 10:
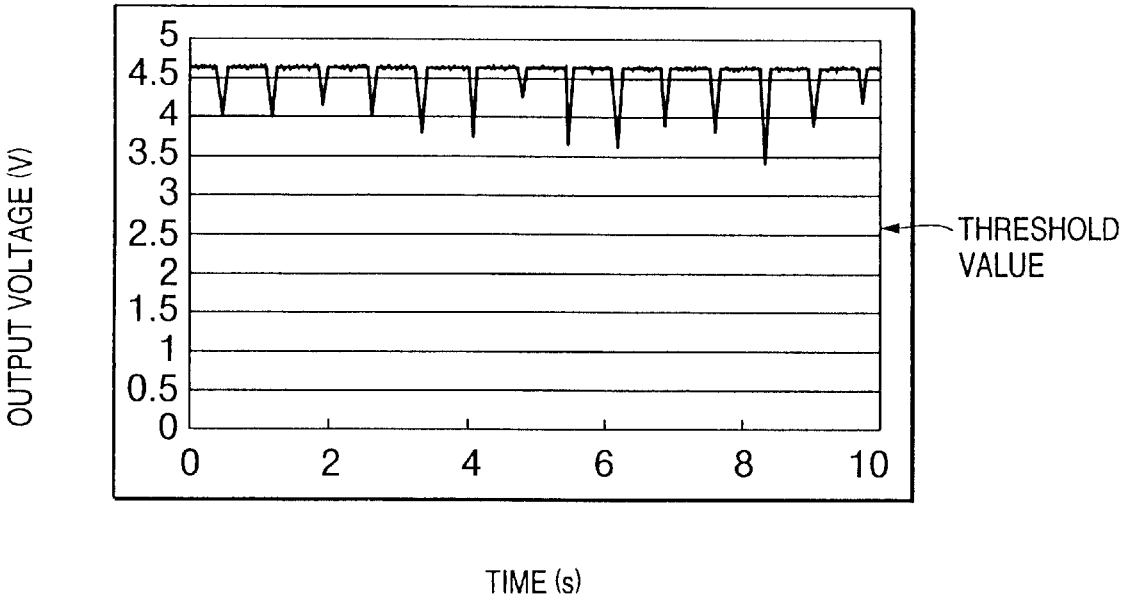
FIG. 10(A) is a graphical representation showing change in voltage output from the light receiving element, caused by rotation of the wiper when a fairly large 90 g of toner remain in the toner holding chamber.
FIG. 10(B) is a cross-sectional view showing level of toner in the toner holding chamber when 90 g of toner remain in the toner holding chamber.
Figure 10:
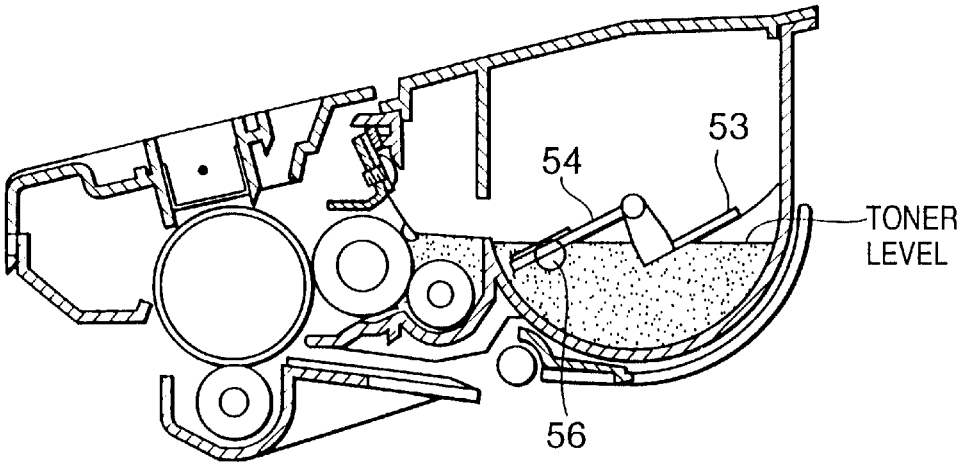
Figure 11:
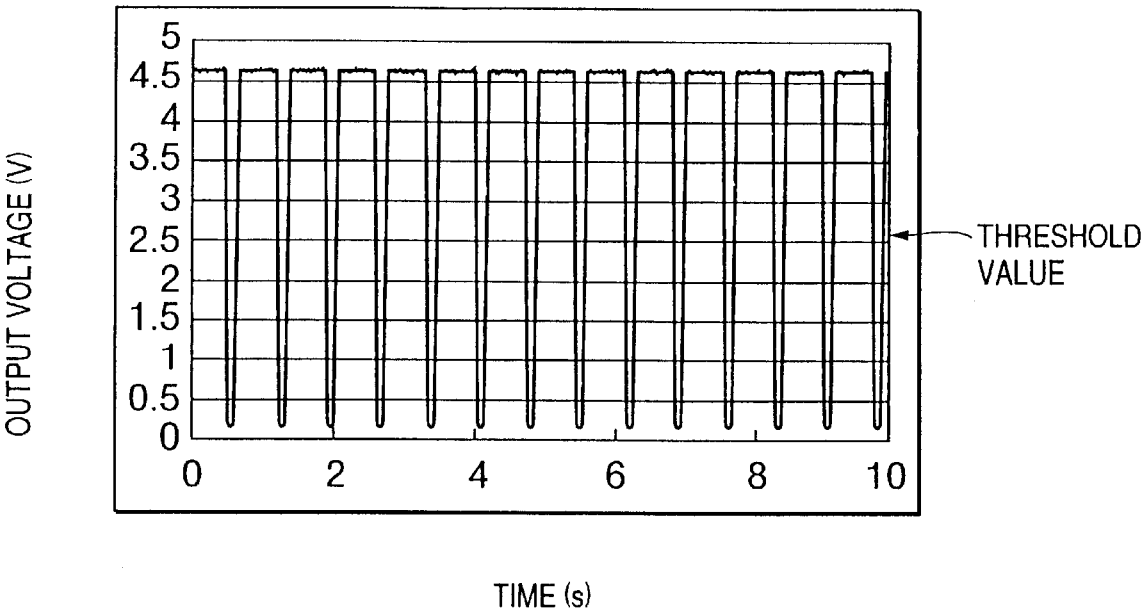
FIG. 11(A) is a graphical representation showing change in voltage output from the light receiving element, caused by rotation of the wiper when 80 g of toner remain in the toner holding chamber.
FIG. 11(B) is a cross-sectional view showing level of toner in the toner holding chamber when 80 g of toner remain in the toner holding chamber.
Figure 11:
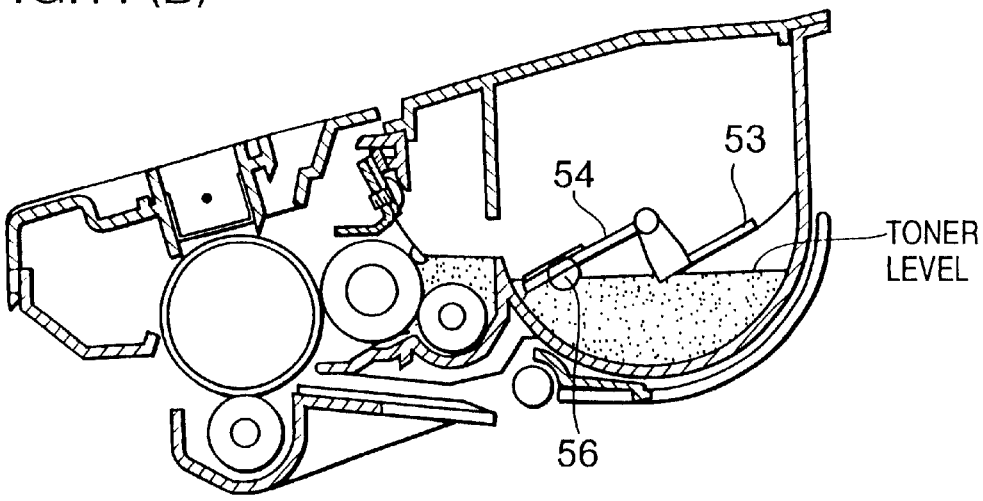
Figure 12:
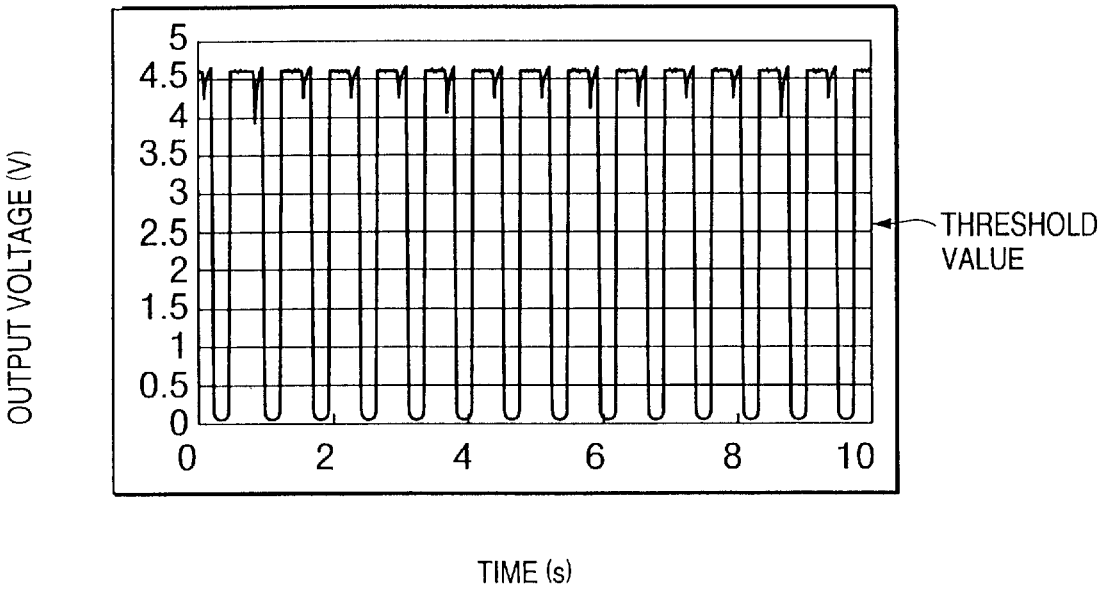
FIG. 12(A) is a graphical representation showing change in voltage output from the light receiving element, caused by rotation of the wiper when only 70 g of toner remain in the toner holding chamber.
FIG. 12(B) is a cross-sectional view showing level of toner in the toner holding chamber when 70 g of toner remain in the toner holding chamber.
Figure 12:
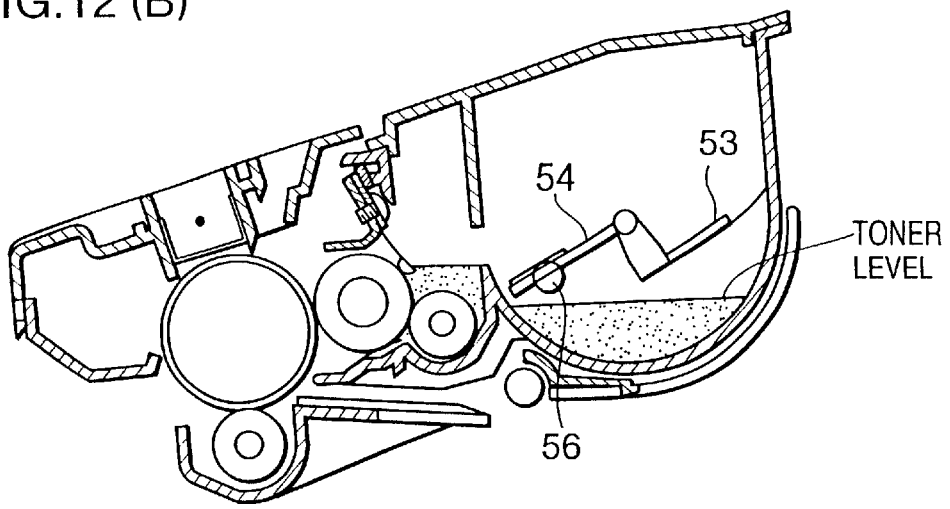

Next, an explanation will be provided for a first set of experiments performed using the device of the first embodiment to measure voltage output from the light receiving element 61*c*. At first, the toner holding chamber 52 was filled with 200 g of toner and image formation was consecutively performed. The value of voltage outputted from the light receiving element 61*c* was measured when the residual toner in the toner holding chamber 52 reached 90 g, 80 g, and 70 g. Also, the threshold value for judging low and high levels of the output voltage was set at 3V. That is, voltage values lower than the 3V were judged as low level. The sampling frequency was set to 6 microseconds and the measurement period was set to 6 seconds. The toner holding chamber 52 was judged to be empty, a condition referred to as a toner empty condition hereinafter, once the ratio of the total low level period during 6-second measurement period reached 37%. Experimental results are shown in FIGS. 10 to 12(B). FIGS. 10(A), 11(A), and 12(A) indicate changes in voltage output from the light receiving element 61*c* when toner amount was 90 g, 80 g, and 70 g, respectively. FIGS. 10(B), 11(B), and 12(B) show the uppermost surface of the toner (i.e., the toner surface) in the toner holding chamber 52, when 90 g, 80 g, and 70 g, respectively of toner remains in the toner holding chamber. It should be noted that in FIGS. 10(A), 11(A), and 12(A), the high level of voltage output from the light receiving element 61*c* is slightly less than 5V because of influence from resistance connected to the light receiving element 61*c* in order to adjust sensitivity of the light receiving element 61*c*.

First, when 90 g of toner remains in the toner holding chamber 52, then as shown in FIG. 10(B), the level of the toner surface is high enough so that toner covers almost all of the light transmission window 56. Therefore, even if the wiper wipes the light transmission window 56, the light transmission window 56 will be promptly covered with toner pushed up by the agitator 53. Accordingly as shown in FIG. 10(A), the voltage output from the light receiving element 61*c* only drops to about 4V each time the light transmission window 56 is wiped by the wiper 54*b*, so that the low level period, wherein the value is lower than the 3V threshold, is zero. The present embodiment is configured to display a toner empty notification on the LED of the display panel 220 shown in FIG. 6. However, when 90 g of toner remained in the toner holding chamber 52, no toner display was performed so it could be confirmed that detection of the remaining toner was properly performed.

When the amount of the remaining toner was 80 g, then as shown in FIG. 11(B), the level of the toner surface is lower so that toner only slightly covers the light transmission window 56. Accordingly, directly after the wiper 54*b* wipes the light transmission window 56, light emitted from the light emitting element 60*c* completely passing through the toner holding chamber 52 and is received by the light receiving element 61*c*. As shown in FIG. 11(A), the output voltage of the light receiving element 61*c* drops to nearly 0V each time the wiper 54*b* wipes off the 56. However, the total of the low level period in the measurement period of 6 seconds is 1.08 seconds, which is a ratio of only 18%. Since the LED did not display a toner empty notification, it could be confirmed that detection of the remaining toner amount was properly performed.

When the amount of remaining toner was 70 g, as shown in FIG. 12(B) the level of the toner surface was lower than the light transmission window 56. Therefore, in the same manner as when 80 g of toner remains as shown in FIG. 11(A), directly after the wiper 54*b* wiped the light transmission window 56, the light emitted from the light emitting element 60*c* completely passes through the opening portions 62*a* and 62*b*, and is received by the light receiving element 61*c*. However, the light receiving condition is maintained longer when only 70 g of toner remains, than when 80 g of toner remains. Accordingly, not only does the output voltage from the light receiving element 61*c* drop to nearly 0V each time the wiper 54*b* wipes the light transmission window 56, but also each near 0V period lasts much longer when only 70 g of toner remains as shown in FIG. 12(A), than when 80 g of toner remains as shown FIG. 11(A). When only 70 g of toner remained in the toner holding chamber 52, the total low level period lasted 2.2 seconds of the measured period of 6 seconds, which is a ratio of 37%. The LED displayed a toner empty notification, confirming that remaining toner amount was properly detected.

These experimental results showed that the laser beam printer of the present embodiment could stably and accurately detect the remaining toner amount until the toner empty condition was reached, and could accurately judge when a toner empty condition was reached. Also, the measured results shown in FIGS. 10(A), 10(A), and 11(A) show that the output from the light receiving element 61*c* included very little noise when output from the light receiving element 61*c* was at a low level. This is because the relative positional relationship of the agitator 53 and the cleaning member 54 is fixed so that the agitator 53 will always be positioned on the imaginary second region, i.e., opposite side of the vertical plane G than the opening A while the wiper 54*b* is wiping the light transmission window 56. That is, any toner that has billowed up after the agitator 53 supplies toner into the opening A, will already have settled down by the time the wiper 54*b* starts wiping the light transmission window 56. Because the toner is in a stable condition, the surface of the light transmission window 56 will be uncontaminated by toner after being wiped clean by the wiper 54*b*.

The above-described experiments were repeatedly performed and a toner empty condition was constantly judged when 70 g of toner remained in the toner holding chamber 52. Also, even when the initial toner amount was increased to 250 g and 300 g, and consecutive image formation was repeatedly performed in the above-described manner, a toner empty condition was accurately judged when 70 g of toner remained in the toner holding chamber 52. In this way, in the laser beam printer 1 according to the present embodiment, it was confirmed that the detection of the remaining toner amount was stably performed even over long periods of use.

The device of the first embodiment can accurately detect the residual toner amount at a timing when the toner surface has dropped to slightly lower than the upper edge of the light transmission window 56. As the toner is further consumed, and the toner surface becomes lower, the low level periods of output from the light receiving element 61*c* will increase in duration. This feature can be used to notify the user of the amount of remaining toner in stepwise manner, so that the user will have a better grasp of how much toner is in the toner holding chamber 52. For example, the user will be able to easily judge whether toner needs to be replenished immediately or in the near future, and take appropriate action accordingly.

Experiment 2

Here an explanation will be provided for a second set of experiments performed to investigate the relationship in the device according to the present embodiment of external additive and toner fluidity, and the relationship of toner fluidity, generation of filming, and unevenness of toner.

A positively chargeable non-magnetic single-component toner was used in these experiments. The toner included toner base particles with a toner diameter of between 6 μm to 10 μm, with an average particle diameter of 8 μm. The toner base particles were formed by adding a nigrosine charge control agent, carbon black and wax, to a styrene acryl resin formed into a spherical shape by suspension polymerization. Four different toner samples were prepared by adding different types and amounts of silica to the toner base particles, each in an amount equivalent to 1.0% by weight of the toner base particles. The fluidity of each toner sample was measured. In the first toner sample, silica having a BET value of 150 was added to the toner base particles in an amount equivalent to 1.0% by weight of the toner base particles. In the second toner sample, two types of silica were added to the toner base particles. That is, silica having a BET value of 150 and silica having a BET value of 50 were both added, each in an amount equivalent to 1.0% by weight of toner base particles. In the third sample, only silica having a BET value of 50 was added to the toner base particles in an amount equivalent to 1.0% by weight of the toner base particles. In the fourth sample, silica having a BET value of 150 and silica having a BET value of 100 were both added to the toner base particles, each in an amount equivalent to 1.0% by weight of the toner base particles.

A PTN powder tester manufactured by Hosokawa Micron Corporation was used to measure fluidity of the toner samples. Three types of sifters, having 149 μm, 74 μm, and 44 μm mesh respectively, were stacked into three levels, and 4 g of each toner sample was shaken for 15 seconds. The total percent of toner remaining in the three shifters was used as the cohesion rate. The cohesion rate subtracted from 100 was used as the index for indicating fluidity. The experimental results are shown in FIG. 13.

Further, fluidity of the toner samples was also measured subjectively in the following manner. Using the laser beam printer of the present embodiment, 15,000 postcards were printed in succession with each of the toner samples, while observing the interior of the toner holding chamber 52 to investigate unevenness of the toner in the toner holding chamber 52. When printing on the narrow-width postcards, toner was consumed from the toner holding chamber 52 at a region that corresponds to the narrow width of the postcards. Toner fluidity was judged by investigating unevenness in the toner level in the toner holding chamber 52 after printing on the postcards. If the level of toner is quite uneven, then this will adversely affect detection of the remaining toner amount. Therefore, by investigating the unevenness in toner using these experiments, the proper combination of toner and external additive appropriate for detecting the amount of remaining toner can be determined.

Furthermore, printing was consecutively performed using each sample until a toner empty condition was judged. The amount of the toner that remained in the toner holding chamber 52 at this time was investigated. It should be noted that when 70 g of new toner was housed in the toner holding chamber 52 of the developing device used in these experiments, the light receiving means 61 outputted a low level output for a total of 2.22 seconds during each 6-second measurement period. In other words, the light receiving element 61*c* output a low level for 37% of the time when 70 g of toner remained in the toner holding chamber 52. Therefore, during these experiments, the total of the low level period was calculated for each 6-second measurement period, and a toner empty condition was determined once the ratio of the total low level period to the 6 second period reached 37%. Accordingly, assuming fluidity of the toner remains stable, then 70 g of toner should remain in the toner holding chamber 52 when a toner empty condition is judged.

The fluidity shown in FIG. 13 is the index of each toner in its initial condition. As shown, the fluidity index is 89 for the toner that includes external additive with a BET value of 150. This is much higher than the fluidity index of 66 for the toner that includes the external additive with a BET value of 50. This shows that the fluidity of toner can increased by adding external additive with a BET value of 100 or more.

The fluidity index is 80 for toner including both external additive with a BET value of 150 and external additive with a BET value of 50. This is slightly lower than the fluidity of the toner including only an external additive having a BET value of 150. This shows that toner including both an external additive with a BET value of 100 or more and an external additive with a BET value of less than 100 has a lower fluidity than toner using only an external additive with a BET value of 100 or more. One possible explanation for this is that external additive having a BET value of less than 100 catch on other toner particles when toner particles rub against each other.

In contrast to this, the fluidity index is 90 for toner including both external additive having a BET value of 150 and external additive having a BET value of 100. This fluidity index is slightly higher than that for toner with only external additive having a BET value of 150. One possible explanation for this is that the external additive having a BET value of 100 is not large enough to catch on other toner particles when the toner particles rub together, and so is sufficiently utilized without hindering the fluidity of the external additive having a BET value of 150.

The filming condition on the surface of the light transmission windows 56*a*, 56*b*, the toner unevenness, and the amount of toner at toner empty were as follows for each different sample.

First, toner including external additive with a BET value of 150 showed high fluidity in its initial condition, so little unevenness in the toner level was observed during printing at first. However, unevenness in the toner level appeared when the toner empty condition was approached. Although a slight amount of filming was confirmed on the surface of the light transmission windows 56*a*, 56*b*, the filming was within a range that still enabled proper detection of the remaining toner amount. Also, 60 g of toner remained when the toner empty condition was judged.

One possible explanation for the reduction in toner fluidity is that because the external additive used has a small particle diameter and so became embedded into the toner base particle over long periods of use. Also, it is conceivable that filming was generated because the small diameter external additives could not properly remove toner that got under the wiper 54*b* and was scraped against the light transmission windows 56*a*, 56*b* over a long period of time. Further, it is conceivable that the precision in remaining toner amount detection dropped because the fluidity of toner increased unevenness of the toner.

It was confirmed that when toner having two types to external additive, one with a BET value of 150 and one with a BET value of 50, was used, filming was greatly reduced and printing could be performed from the start of printing until a toner empty condition was reached without any unevenness in the toner level. Also, the amount of the toner remaining when the toner empty condition was judged was 70 g, thus confirming that detection of remaining toner amount could be maintained in a high precision level.

The toner that included both 50 BET value external additive and 150 BET value external additive had a lower fluidity than toner including only external additive with a BET value of 150. However, the toner fluidity was not reduced over a long period of time, conceivably because the 50-BET-value (large particle diameter) external additive properly functioned as a spacer that reliably prevented the 150-BET-value (small particle diameter) external additive from being embedded into the toner base particle. Also, it is conceivable that toner that got under the edge portion of the wiper 54*b* and scraped against the surface of the light transmission windows 56*a*, 56*b* is reliably removed by the large particle external additive, so that filming could be greatly reduced.

The toner sample including only the 50-BET-value external additive had the lowest initial fluidity. Therefore, a rather large amount of unevenness of toner was observed at the start of printing. However, there was extremely little filming. Only 50 g of toner remained when the toner empty condition was judged, which indicates a low precision in detection of the remaining toner amount.

It is conceivable that filming was so low because the 50-BET-value (large particle diameter) external additive reliably removed any toner scraped onto the surface of the light transmission windows 56*a*, 56*b*. However, when only the 50-BET-value (large paritcle diameter) external additive was used, the fluidity of toner was extremely low so that unevenness in toner level was generated.

The toner including both 150-BET-value and 100-BET-value external additive showed the highest initial fluidity. Therefore, there was little unevenness in toner at start of printing. However, when the toner empty condition was approached, some of unevenness of toner was observed. Also, slightly more filming was observed on the surface of the light transmission windows 56*a*, 56*b* than when toner including both 150-BET-value and 50-BET-value external additive was used. Also, 65 g of toner remained when the toner empty condition was judged, which is a slightly reduced precision in detection of remaining toner amount.

When two types of external additive were used, the larger particle diameter external additive somewhat suppressed the problem of smaller diameter particle external additive being embedded into the toner base particle. However, 100-BET-value (larger particle diameter) external additive functioned only poorly as a spacer, so that some external additive became embedded into the toner base particle. As a result, fluidity of the toner is somewhat lower, so that unevenness in toner level is generated and precision in detection of remaining toner amount is somewhat lower. Also, 100-BET-value external additive has less ability than 50-BET-value external additive to remove toner that gets under the edge portion of the wiper 54*b* and is scraped against the surface of the light transmission windows 56*a*, 56*b*.

From the results of experiments such as those described above, it can be understood that the toner fluidity can be best maintained in a good condition over a long period of time, so that detection of the remaining toner amount can be always properly performed, when the developing roller 59 and the contact portion 64*b* of the layer thickness regulation blade 64 are formed from silicone rubber, polymerized toner having an average particle diameter of 8 $\mu$m is used, and two types of external additive are included, one type having a BET value of 150 and the other type having a BET value of 50.

Incidentally, when thickness of the toner is regulated using a corner of a bent piece of stainless steel, then unevenness in the toner level increased and inaccurate detection of remaining amount was worse than any of the situations shown in FIG. 13.

Further, when pulverized toner was used, fluidity at the start of printing was worse than any of the situations shown in FIG. 13, regardless of what combination of external additive was used. Moreover, the toner level was even more uneven at the end of experiments than when toner with only 50-BET-value external additive was used as shown in FIG. 13. In other words, high precision detection of remaining toner amount could not be performed.

The present invention is not limited to the combinations of external additives described above. Any combination of external additives is acceptable. Also, the types of combined external additives is not limited to two types. More than two types can be combined.

Experiment 3

Next, while referring to FIGS. 14(A) through 14(D), an explanation will be provided for a third set of experiments performed to measure the value of voltage outputted from the light receiving element 61*c* in the device according to the present embodiment. The examples shown in FIGS. 14(A) to 14(D) show the condition of change in voltage outputted from the light receiving element 61*c* when the space W2 between the light transmission windows 56*a*, 56*b* and the side end of the slide contact member 53*b* was changed to 1 mm, 2 mm, 3 mm, and 5 mm, respectively. The experimental result in FIGS. 14(A) to 14(D) show voltage values from the light receiving element 61*c* when about 70 g of toner remained in the toner holding chamber 52, which is about the toner level indicated by solid line in FIGS. 8(A) and 9(A). It should be noted that in FIGS. 14(A) to 14(D), the reason the highest output level is smaller than 5V is because of influence of resistance connected to the light receiving element 61*c* for adjusting sensitivity of the light receiving element 61*c*.

Figure 14A:
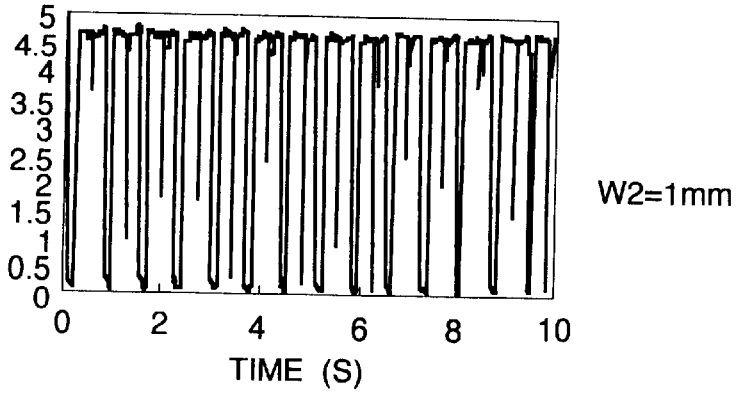
FIG. 14(A) is a graph representing change in voltage output from the light receiving element with rotation of the wiper, when the agitator is separated from the light transmission windows by 1 mm.
Figure 14B:
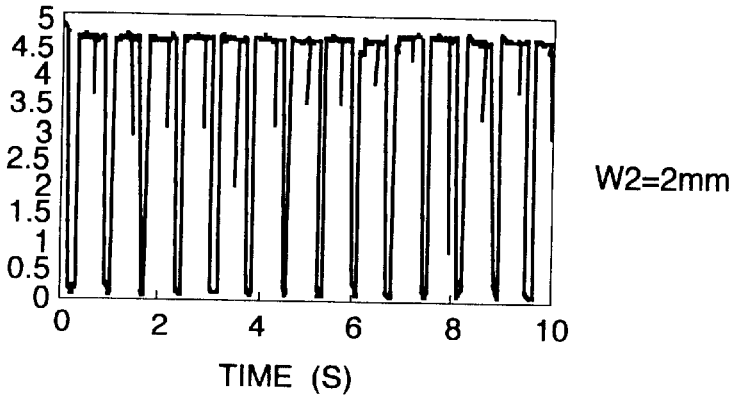
FIG. 14(B) is a graph representing change in voltage output from the light receiving element with rotation of the wiper, when the agitator is separated from the light transmission windows by 2 mm.
Figure 14C:
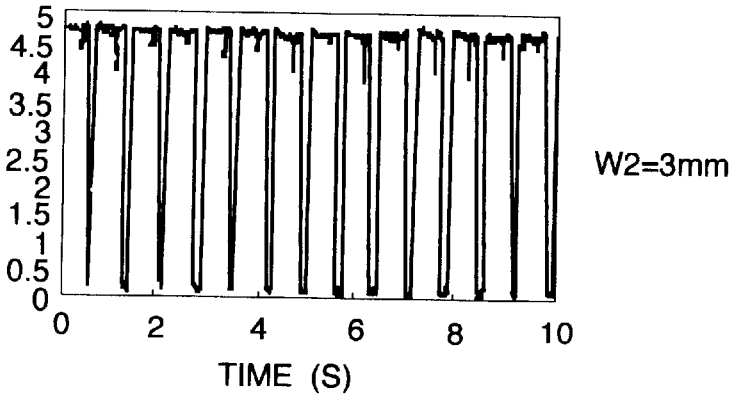
FIG. 14(C) is a graph representing change in voltage output from the light receiving element with rotation of the wiper, when the agitator is separated from the light transmission windows by 3 mm.
Figure 14D:
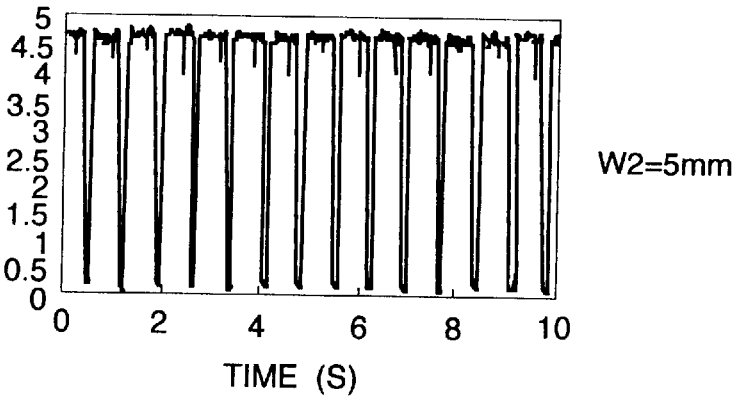
FIG. 14(D) is a graph representing change in voltage output from the light receiving element with rotation of the wiper, when the agitator is separated from the light transmission windows by 5 mm.

When the space W2 is set to 5 mm, then as shown in FIG. 14(D) the voltage output from the light receiving element 61*c* drops to nearly 0V each time the wiper 54*b* wipes off the light transmission windows 56*a*, 56*b*. At almost all other times the output voltage is in a high level. Although a slight amount of noise can be seen even during the high level periods, this noise does not result in erroneous detection if the threshold is set to, for example, 3V.

In contrast to this, when the space W2 is set to a smallest value of 1 mm, then as shown in FIG. 14(A) the voltage output from the light receiving element 61*c* has a large amount of noise during the high level periods. This noise can result in poor detection precision. As described above, this noise is caused by light being transmitted through the light transmission windows 56*a*, 56*b* at the instant that the side end of the slide contact member 53*b* removes toner from the light transmission windows 56*a*, 56*b* in association with rotation of the agitator 53.

As shown in FIGS. 14(B) and 14(C), the level of noise generated during high level periods is gradually reduced with increase in width of the space W2. However, when the space W2 is 2 mm wide, the fluctuation in noise can reach the threshold value of 3V. When the width of the space W2 is set to 3 mm, a slight amount of noise is observed but it does not reach the threshold value of 3V, so detection precision is not adversely effected. From this, it can be said that it is desirable to set the width W2 of the value of 3 mm or greater.

Figure 15:
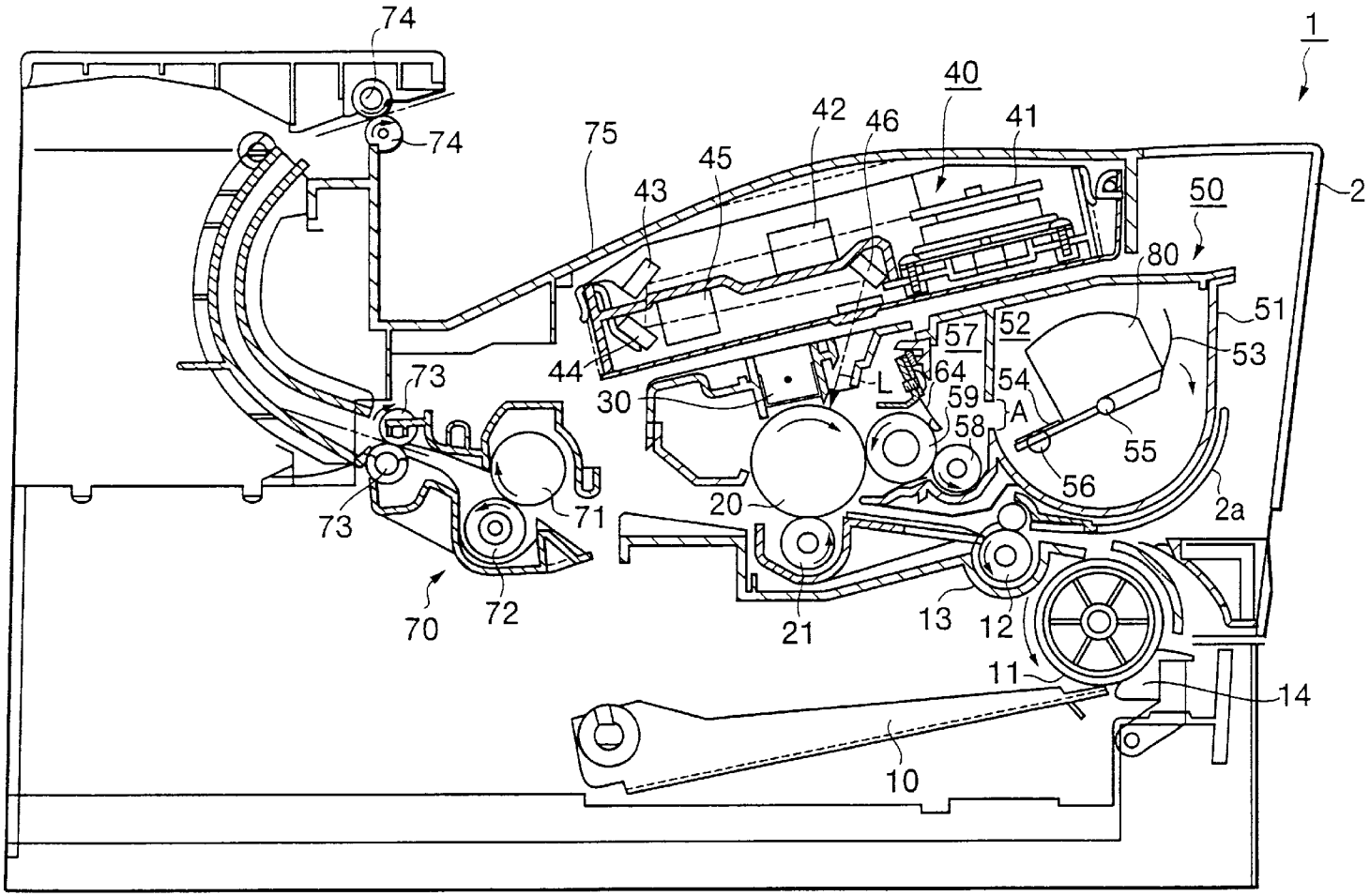
FIG. 15 is a cross-sectional view showing a laser beam printer according to a second embodiment of the present invention.

Next, a laser beam printer according to a second embodiment will be described while referring to FIGS. 15 to 21. As shown in FIG. 15, the laser beam printer according to the second embodiment includes a light blocking member 80 provided rotatable around a rotation shaft 65. Other configuration of the laser beam printer according to the second embodiment is substantially the same as in the laser beam printer 1 according to the first embodiment. Like components between the first and second embodiments are indicated by the same numbering and their explanation is omitted.

Figure 16:
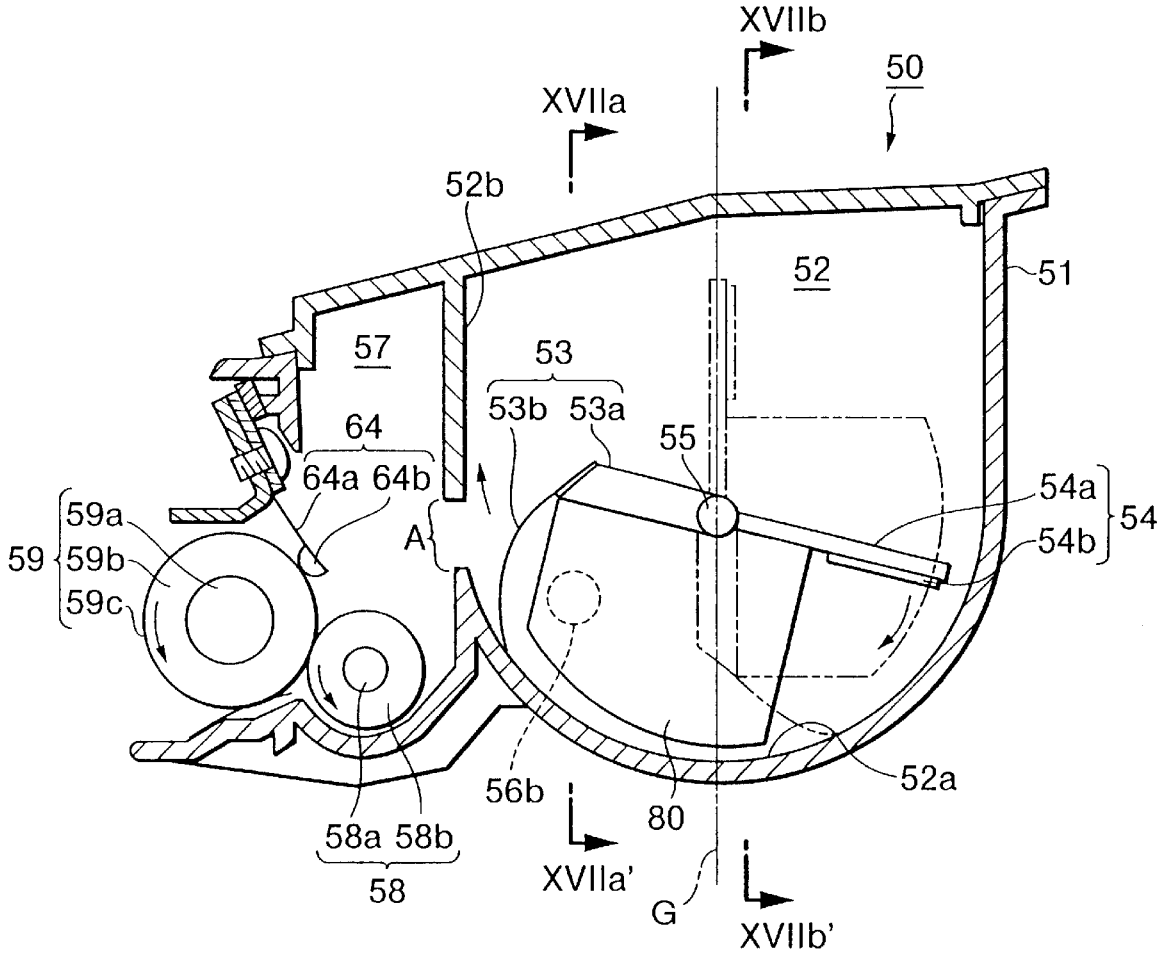
FIG. 16 is a cross-sectional view showing a developing device of the laser beam printer of FIG. 15, taken along line XVI–XVI' of FIG. 17.
Figure 17:
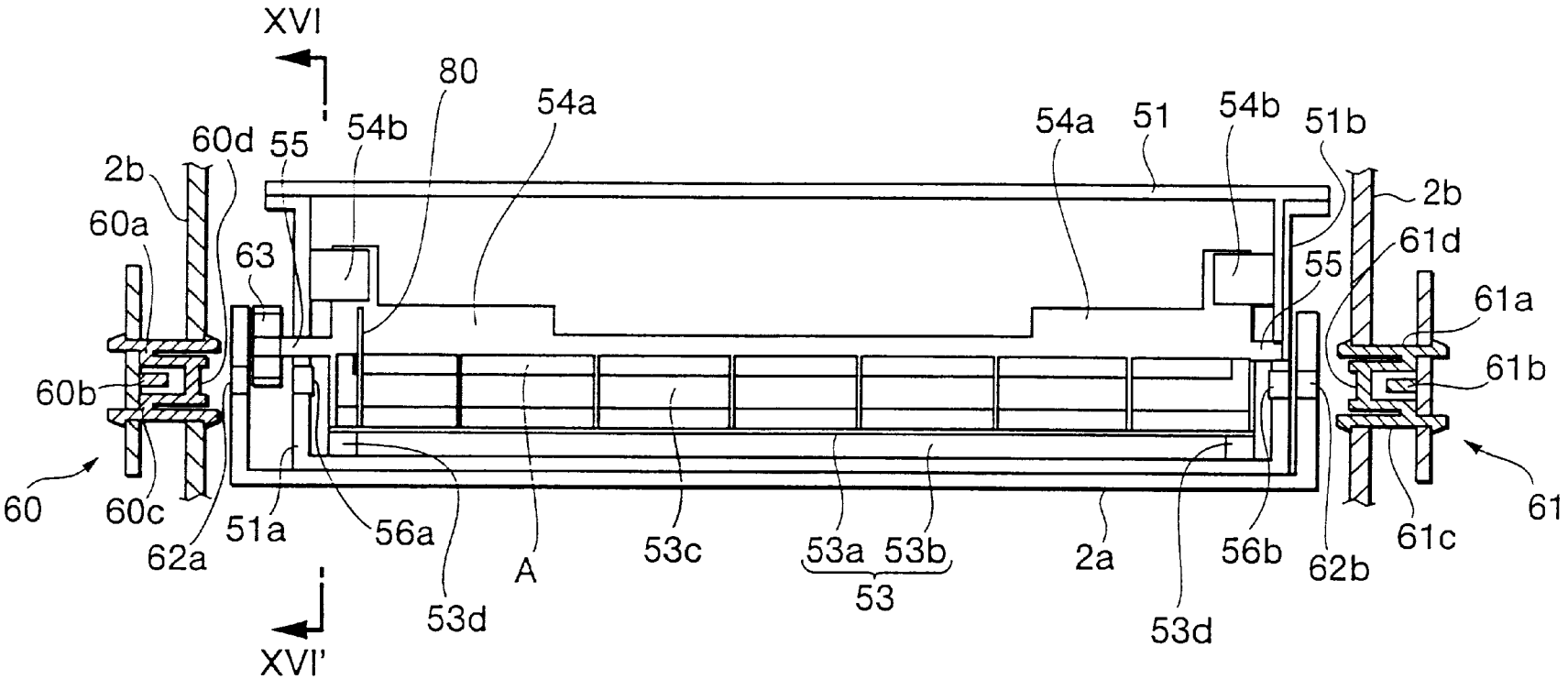
FIG. 17 is a cross-sectional view showing light emitting and receiving elements of FIG. 16 taken along line XVIIa–XVIIa' of FIG. 16, and the developing device of FIG. 16 taken along line XVIIb–XVIIb' of FIG. 16.
Figure 18:
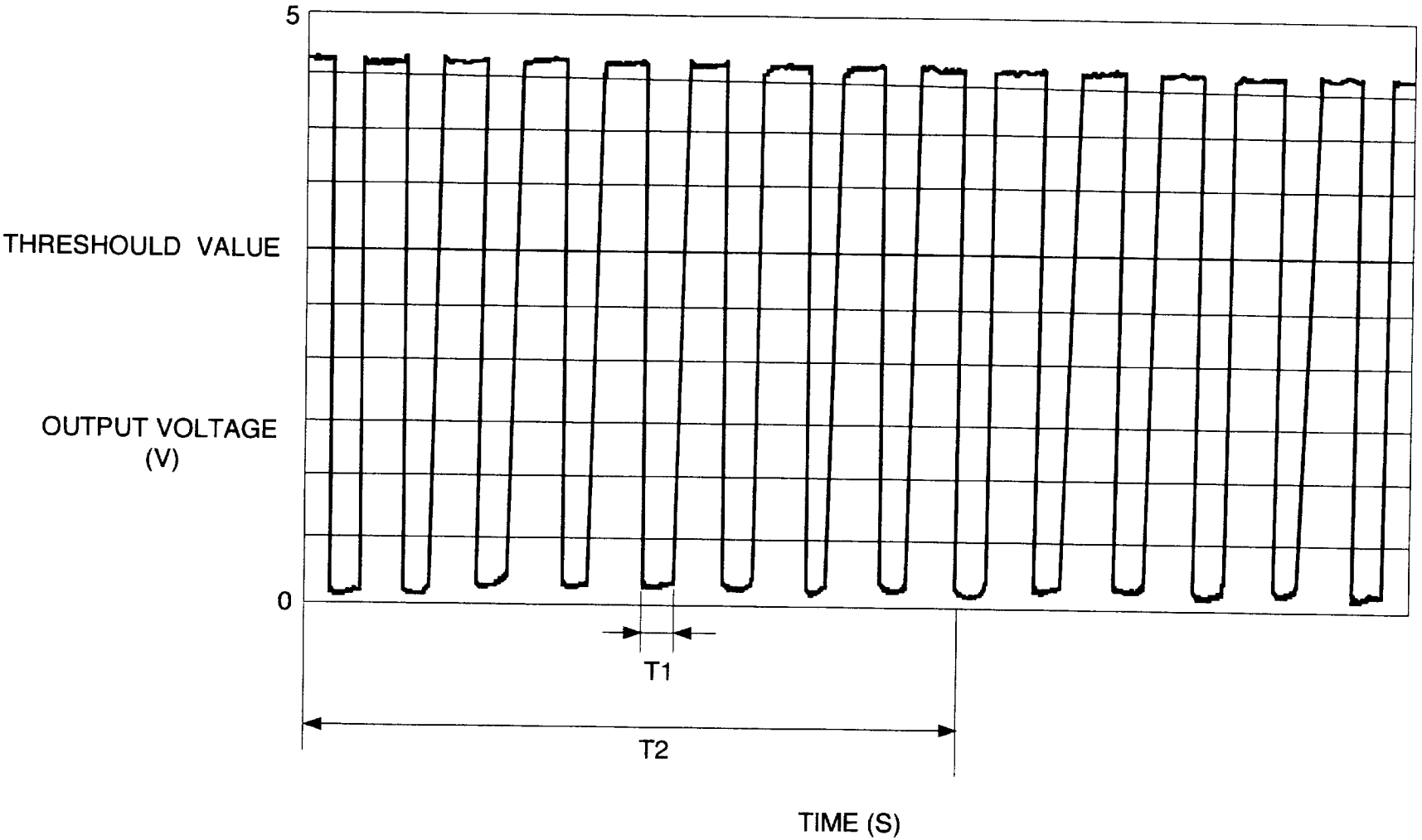
FIG. 18 is a graph showing changes in output of a light receiving element of the laser beam printer of FIG. 15, with rotation of a cleaning member.

As shown in FIG. 16, the light blocking member 80 is a blade shape member provided between the support member 53*a* of the agitator 53 and the support member 54*a* of the cleaning member 54. The light blocking member 80 is formed from resin, such as ABS resin. The light blocking member 80 is formed integrally with the agitator 53, the cleaning member 54, and the rotational shaft 55 so as to rotate around the axial center of the rotational shaft 55 with rotation of the rotational shaft 55. As shown in FIG. 17, the light blocking member 80 is provided only on one end of the rotational shaft 55, that is, the end nearest the light generating means 60.

As shown in FIG. 16, the light blocking member 80 has a large light blocking surface that blocks light from the light transmission window 56*b* immediately after the agitator 53 passes the position of the light transmission window 56*b* (56*a*), and that stops blocking light immediately before the cleaning member 54 starts cleaning the light transmission window 56*b* (56*a*). According to the present embodiment, toner housed in the toner holding chamber 52 is substantially the same as that described in the first embodiment. Silica used as the external additive has an average particle diameter of 10 nm and is added in the amount equivalent to 0.6% by weight of the toner base particle. The toner is suspension polymerized toner having a nearly perfectly spherical shape. Moreover, silica is added as external additive by 0.6% by weight. The silica has an average particle diameter of 10 nm and is processed to enhance hydrophobic nature. Addition of such silica provides the toner with excellent fluidity. For this reason, sufficient charge amount can be obtained by friction charging. Therefore, high transfer rate can be provided and high quality images can be formed.

As shown in FIG. 17, two cutout portions 53d are provided in the slide contact member 53*b*, one at either end of the slide contact member 53*b* in confrontation with an end of the opening A. Therefore, a portion of the slide contact member 53*b* between the two cutout portions 53d, 53d serves as a main transport portion, which resiliently enters into the opening A with a snap, so that the toner is flicked into the developing chamber 57. It should be noted that in FIG. 17, the opening A is represented by a fully blackened region.

The cleaning member 54 is configured to simultaneously clean both of the light transmission windows 56*b*, 56*a*. Also, the light blocking member 80 blocks the light pathway only during the last half of the interval between consecutive cleansings of the light transmission windows 56*b*, 56*a*. The light receiving condition of the light receiving element 61*c* is graphically shown in FIG. 18.

Figure 19:
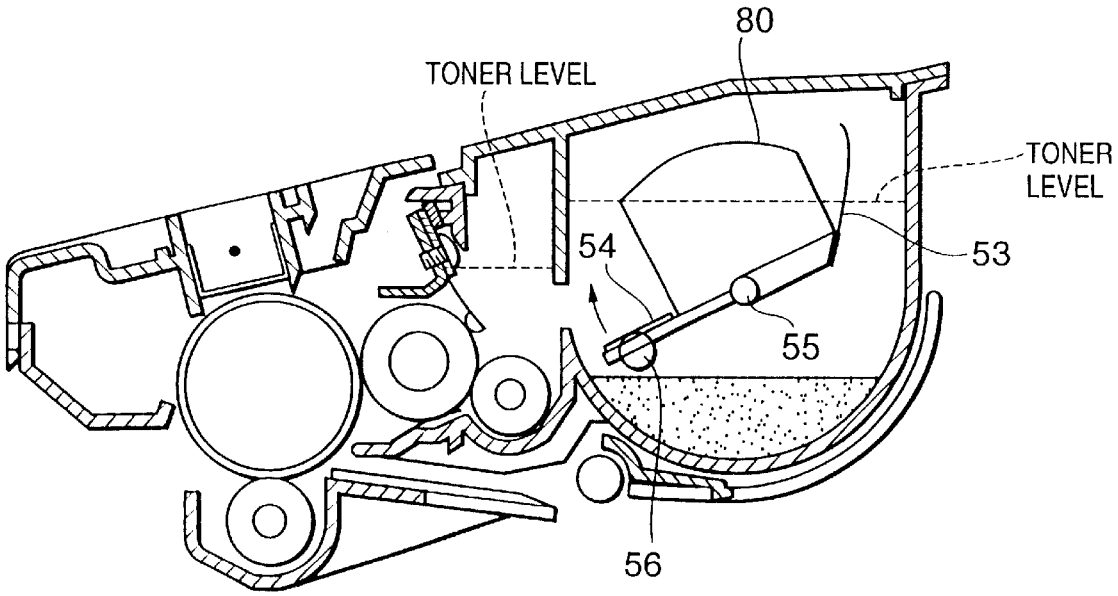
FIG. 19 is a cross-sectional view showing the cleaning member rotated into a position for wiping a light transmission window according to the second embodiment.
Figure 20:
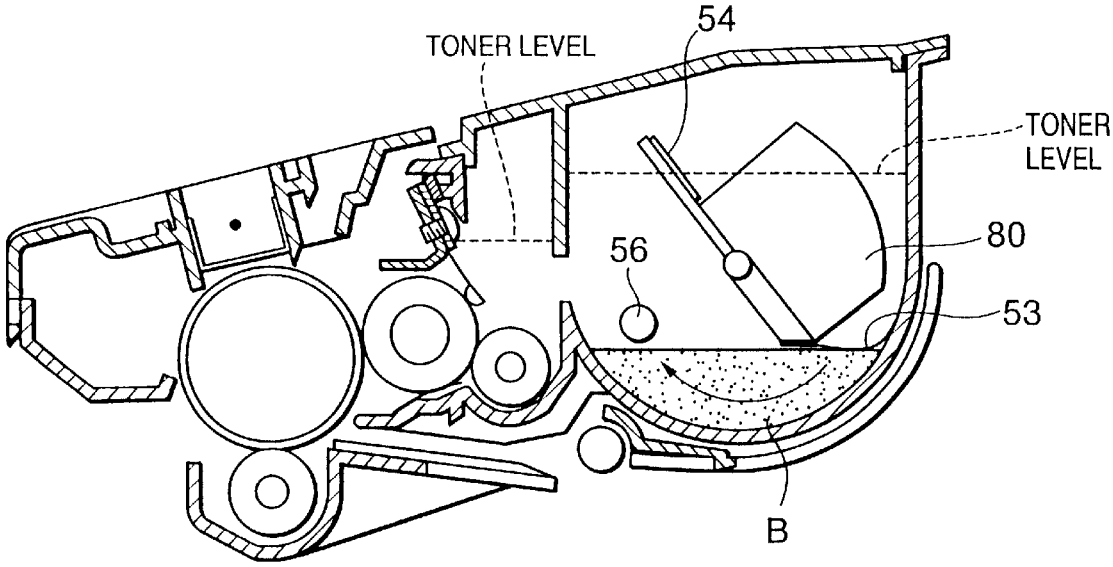
FIG. 20 is a cross-sectional view showing the cleaning member rotated away from the light transmission window according to the second embodiment.

The configuration of the second embodiment will be described in more detail below while referring to FIGS. 19 through 21. FIG. 19 shows the condition when the cleaning member 54 simultaneously cleans the two light transmission windows 56*b*, 56*a*. The period TO is used to represent the time period from the condition shown in FIG. 19 until the cleaning member 54 rotates 360 degrees again into the same condition shown in FIG. 19 to start the next cleaning operation. The period TO is divided into a front half period TO/2 and a latter half period TO/2.

The light blocking member 80 according to the second embodiment is configured to only cover the light transmission windows during the latter half period TO/2, and not during the front half period TO/2. The reason for this configuration is that it would be impossible to accurately detect the amount of the remaining toner if something other than toner (such as the light blocking member 80) blocked the light transmission windows 56*b*, 56*a* during the front half portion of the period TO/2. On the other hand, during the latter half period TO/2, there is a possibility that the agitator 53 might wipe toner off the light transmission windows 56*b*, 56*a* when the agitator 53 passes by the light transmission windows 56*b*, 56*a* during the latter half period TO/2. If light is allowed to pass through the light transmission windows 56*b*, 56*a* to the light receiving element during the latter half period, then it becomes impossible to reliably detect amount of remaining toner. However, because the light blocking member 80 according to the second embodiment is disposed to block the light transmission windows 56*b*, 56*a* during the latter half period TO/2, accurate detection is possible even if the agitator 53 may wipe toner off the light transmission windows 56*b*, 56*a*. With the configuration of the present embodiment, the amount of remaining toner can be reliably detected regardless of environmental conditions or length of use.

Also, the agitator 53, the light blocking member 80, and the cleaning member 54 are all disposed on the same rotational shaft 55 separated by a fixed angular phase difference. Therefore, the configuration can be simplified. Also, light can be blocked by the light blocking member 80 periodically at a cycle equivalent to the cleaning cycle performed by the cleaning member 54. The light blocking member 80 is disposed on the rotational shaft 55 at a position immediately upstream from the agitator 53 with respect to the rotational direction of the rotational shaft 55. Moreover, the light blocking member 80 is disposed downstream from the cleaning member 54 on the rotational shaft 55 with respect to the rotational direction of the rotational shaft 55. Further, as shown in FIG. 17, the light blocking member 80 is disposed at the tip end of the opening A with respect to the axial direction of the rotational shaft 55. Because the light blocking member 80 is disposed in an area that does not influence circulation transport of toner, the light blocking member 80 does not act as a barrier that blocks transport of toner. Therefore, unevenness in the toner transport amount can be prevented. The light blocking member 80 can alternatively be disposed at a position outside the tip position of the opening portion A in the lengthwise direction of the opening A.

Next, a detailed explanation will be provided for operations performed by the third embodiment, centering on detection of remaining toner, and operation of the agitator 53 and the cleaning member 54.

If sufficient amount of toner fills the toner holding chamber 52, that is, when the toner surface is higher than the light transmission windows 56*a*, 56*b* as indicated by dotted line in FIG. 19, even though the wiper 54*b* of the cleaning member 54 operates to wipe off the surface of the light transmission windows 56*a*, 56*b*, light emitted from the light emitting element 60*c* does not pass through the toner holding chamber 52 because a sufficient amount of toner is held between the light transmission windows 56*a*, 56*b*. Therefore, the output from the light receiving element 61*d* will not fluctuate.

Figure 21:
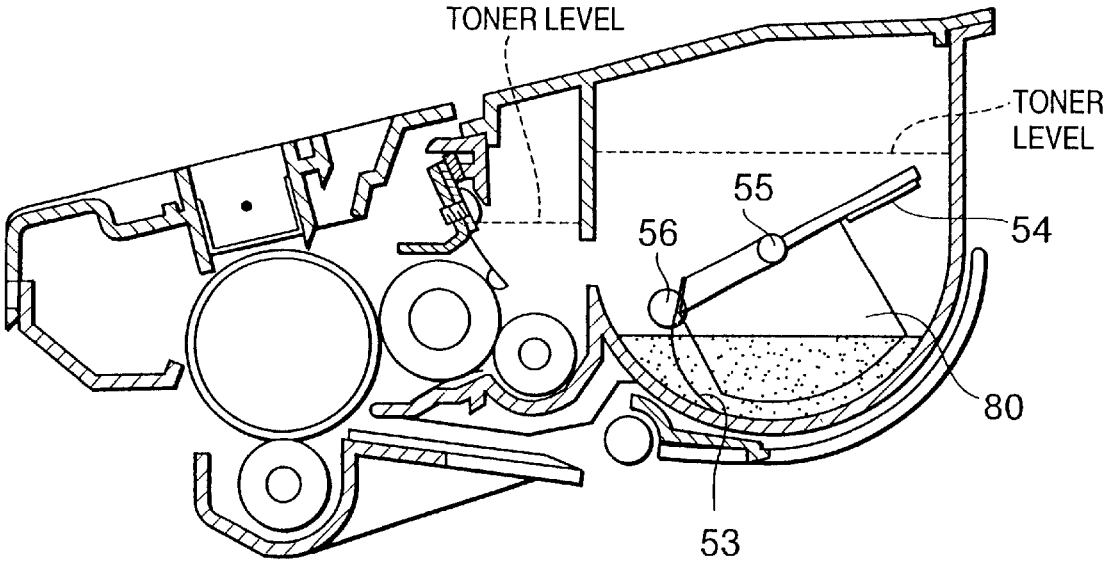
FIG. 21 is a cross-sectional view showing an agitator rotated to a position adjacent to the light transmission window according to the second embodiment.

If the toner has been used for a long time or environmental conditions are poor, then it is conceivable for the agitator 53 to transport toner at the vicinity of the light transmission windows 56*a*, 56*b* to provide an open space between the light transmission windows 56*a* and 56*b* when the agitator 53 passes by the position of the light transmission windows 56*a*, 56*b* as a result of rotation of the agitator 53 from the position shown in FIG. 21 to the position shown in FIG. 16. However, as shown in FIG. 16, the light blocking member 80 blocks the light pathway between the light transmission windows 56*a*, 56*b* while the agitator 53 moves from the position indicated in FIG. 21 to the position indicated in FIG. 16. Accordingly, even if the agitator 53 transports toner in the vicinity of the light transmission windows 56*a*, 56*b* when the agitator passes by, the output of the light receiving element 61*c* will remain at a high level so that the output will not change into a noise condition.

Next, an explanation will be provided for operations performed with toner level near the position of the light transmission windows 56*a*, 56*b* as indicated by a solid line of FIG. 19. In this case also, when the wiper 54*b* reaches the position shown in FIG. 20, then the transport surface of the slide contact member 53*b* presses the toner in the direction indicated by the arrow B in FIG. 20, so that toner covers the light transmission windows 56*a*, 56*b*. The duration of time that the pressed up toner covers the light transmission windows 56*a*, 56*b* depends on the amount of toner.

Light passes through the light transmission windows 56*a*, 56*b* until the agitator 53 rotates into the position shown in FIG. 21. Then, according to the second embodiment, the light blocking member 80 as shown in FIG. 16 blocks the light pathway between the light transmission windows 56*a*, 56*b* while the agitator 53 rotates from the position shown in FIG. 21 to the position shown in FIG. 16. Because the light blocking member 80 blocks the light pathway between the light transmission windows 56*a*, 56*b* at the same cycle as the cleaning cycle period of the cleaning member 54 regardless of the level of the toner surface, the output from the light receiving element 61*c* is maintained at a high level until the cleaning member 54 reaches the light transmission windows 56*a*, 56*b*. Therefore, there will be a sharper partition between the period for measuring the amount of remaining toner and the period where this measurement does not occur, so that the amount of remaining toner can be reliably detected.

It should be noted that in the second embodiment the light blocking member is disposed within the developing device 50. However, the light blocking member can be provided on a main frame of the image forming device. In this case, a shutter that blocks transmission of light through the light transmission windows can be provided on the main frame of the image forming device and the shutter can be configured to open and close the transparent windows in the same cycle as the cleaning cycle of the cleaning member 54. Also, in the foregoing embodiments a light pathway between the light emitting element 60*c* and the light receiving element 61*c* is substantially horizontal. However, the light pathway having a vertical orientation is also available.

Next, a developing device according to a third embodiment of the present invention will be described with reference to FIGS. 22(A) to 22(C). Like parts and components are designated by the same reference numerals as those shown in the first embodiment.

Figure 22:
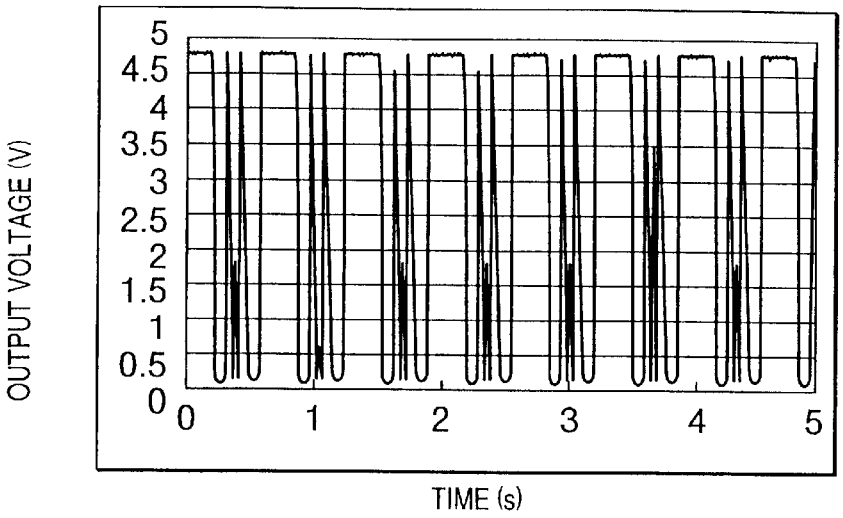
FIG. 22(A) is a graph representing changes in voltage output from the light receiving element of a developing device according to a third embodiment of the present invention.
FIG. 22(B) is a cross-sectional view showing the developing device according to the third embodiment.
FIG. 22(C) is a schematic view showing position of an agitator when a wiper of the developing device of FIG. 22(B) is wiping a light transmission window.
Figure 22:
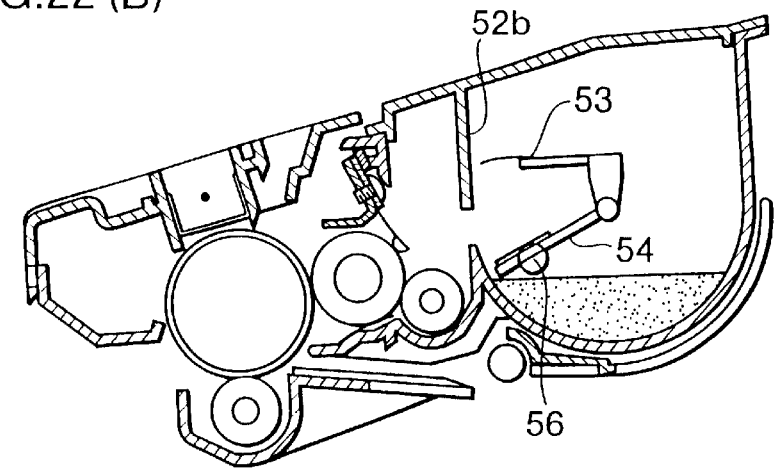
Figure 22:
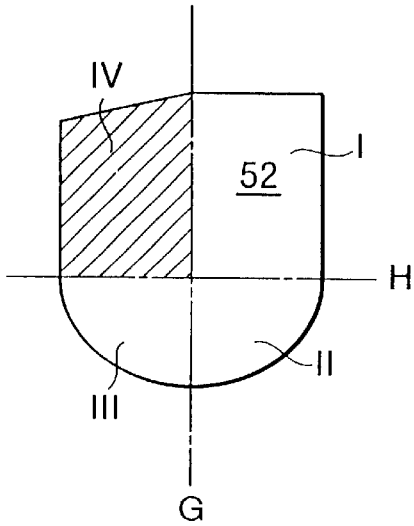

The third embodiment differs from the first embodiment in that, as shown in FIG. 22(B), the agitator 53 and the cleaning member 54 orient the same direction with respect to the vertical plane G. With this configuration, when the wiper 54*b* is wiping the light transmission window 56, the agitator 53 is positioned above the light transmission window horizontal plane H, that is, the agitator 53 is positioned in a region IV as indicated by a hatching in FIG. 22(C).

The device according to the third embodiment was subjected to the same experiments and under that same experimental conditions as the device of the first embodiment. That is, the toner holding chamber 52 was initially filled with 200 g of toner and image formation was consecutively performed until only 70 g of toner remaining in the toner holding chamber 52. The output voltage value of the light receiving element 61*c* was measured while only 70 g of toner remaining in the toner holding chamber 52, and the measurements are shown in FIG. 22(A). FIG. 22(B) schematically shows positional relationship between the agitator 53, the cleaning member 54, and the position of the toner surface when the toner reached 70 g. Also, in the same manner as FIG. 8(B), FIG. 22(C) divides the inside of the toner holding chamber 52 into four regions I to IV by the vertical plane G and the light transmission window horizontal plane H for explaining the position of the agitator 53 when the wiper 54*b* is wiping the light transmission window 56.

According to the third embodiment, the agitator 53 does not press toner toward the light transmission window 56 while the wiper 54*b* is wiping the light transmission window 56. Therefore, low level periods appear in the output from the light receiving element as shown in FIG. 22(A), which indicate detection of an toner empty condition. However, as shown in FIG. 22(B), the slide contact member 53*b* will snap out of its bent condition when the slide contact portion 53*b* separates from the front wall 52*b* of the toner holding chamber 52. Any toner on the slide contact member 53*b* will billow up into a cloud condition with the snapping action, and then drop down afterward. Accordingly, as shown in FIG. 22(A), the output of the light receiving element 61*c* of the present embodiment will include much more noise than the light receiving element 61*c* of the device of the first embodiment as shown in FIG. 7.

Next, a developing unit according to a fourth embodiment of the present invention will be described with reference to FIGS. 23(A) to 23(C).

Figure 23:
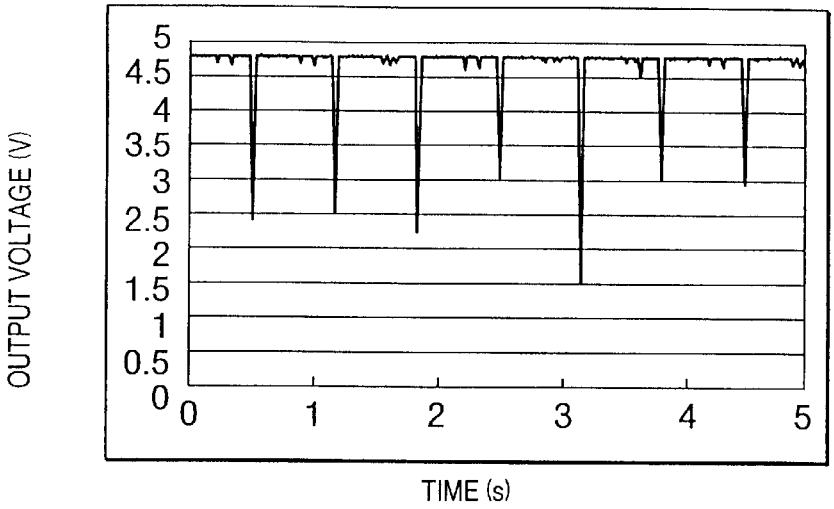
FIG. 23(A) is a graph representing changes in voltage output from the light receiving element of a developing device according to a fourth embodiment of the present invention.
FIG. 23(B) is a cross-sectional view showing the developing device according to the fourth embodiment.
FIG. 23(C) is a schematic view showing position of an agitator when a wiper of the developing device of FIG. 23(B) is wiping a light transmission window.
Figure 23:
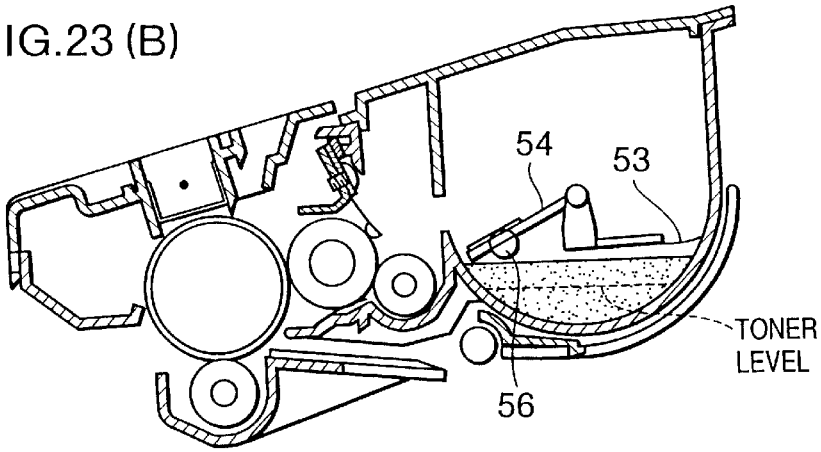
Figure 23:
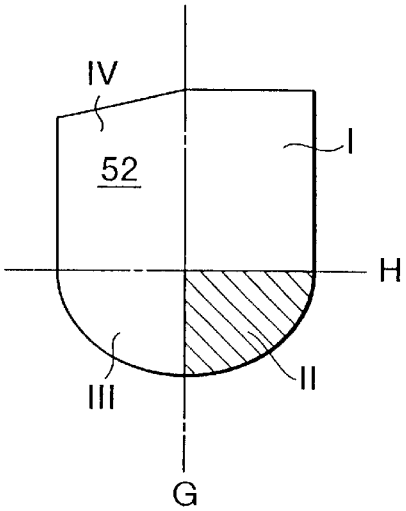

The present embodiment differs from the first embodiment in that, as shown in FIG. 23(B), the agitator 53 and the cleaning member 54 have a phase angle of more than 180 degrees. With this configuration, the agitator 53 will be positioned in the region II as indicated by hatching in FIG. 23(C) while the wiper 54*b* is wiping the light transmission window 56.

The device according to the fourth embodiment was subjected to the same experiments and under that same experimental conditions as the device of the first embodiment. That is, the toner holding chamber 52 was initially filled with 200 g of toner and image formation was consecutively performed until only 70 g of toner remaining in the toner holding chamber 52. The output voltage value of the light receiving element 61*c* was measured while only 70 g of toner remains in the toner holding chamber 52, and the measurements are shown in FIG. 23(A). FIG. 23(B) schematically shows positional relationship between the agitator 53, the cleaning member 54, and the level of the toner surface when the toner reached 70 g.

With the configuration of the fourth embodiment, toner does not drop off the agitator 53 while the wiper 54*b* is wiping off the light transmission window 56. Therefore, as shown in FIG. 23(A), almost no noise is generated in the output from the light receiving element 61*c*. However, when the level of the toner surface is directly below the light transmission window 56 as shown by a solid line in FIG. 23(B), then the agitator 53 will push toner toward the light transmission window 56 immediately after the wiper 54*b* wipes off the light transmission window 56. Therefore, as shown in FIG. 23(A), no low level period appears in the output from the light receiving element, and a toner empty condition is not detected while the level of the toner is immediately below the light transmission window 56. However, when the toner surface is sufficiently below the light transmission window 56 as indicated by the two-dot chain line in FIG. 23(B), then a low level period will appear in the voltage output from the light receiving element, and a toner empty condition can be stably detected. Therefore, although the fourth embodiment enables detection of remaining toner amount, it is not as easy to manage the details of the remaining toner level as with the configuration of the first embodiment.

Figure 24:
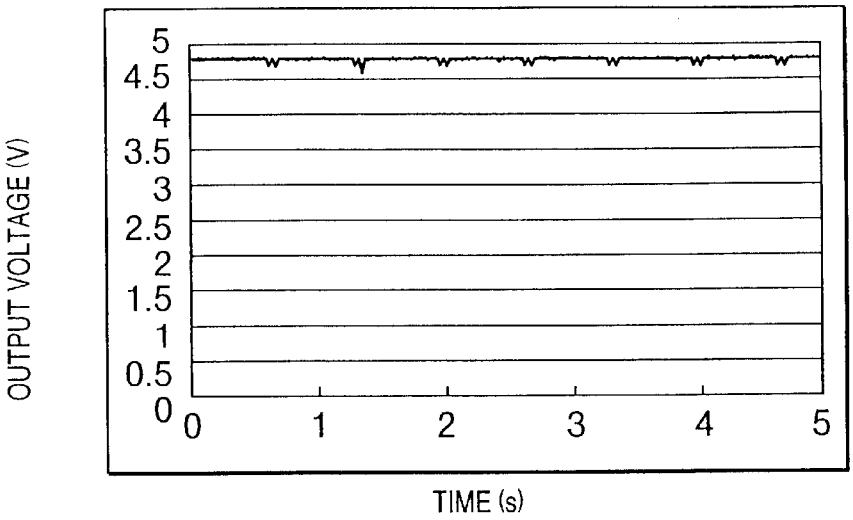
FIG. 24(A) is a graph representing changes in voltage output from the light receiving element of a developing device according to a comparative example.
FIG. 24(B) is a cross-sectional view showing the developing device according to the comparative example.
FIG. 24(C) is a schematic view showing position of an agitator when a wiper of the developing device of FIG. 24(B) is wiping a light transmission window.
Figure 24:
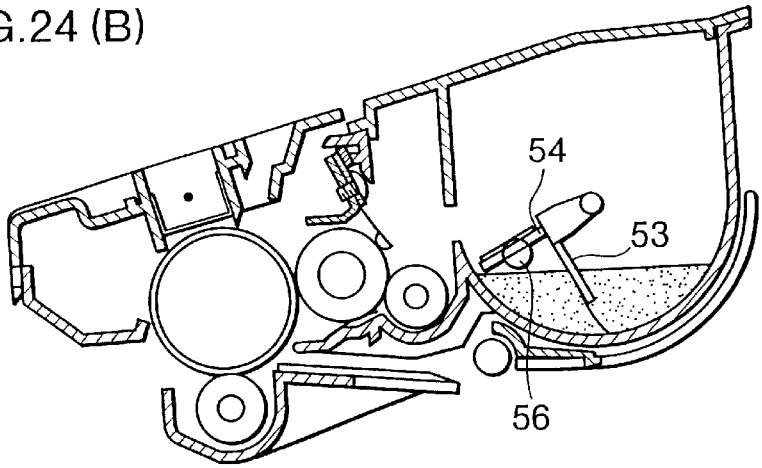
Figure 24:
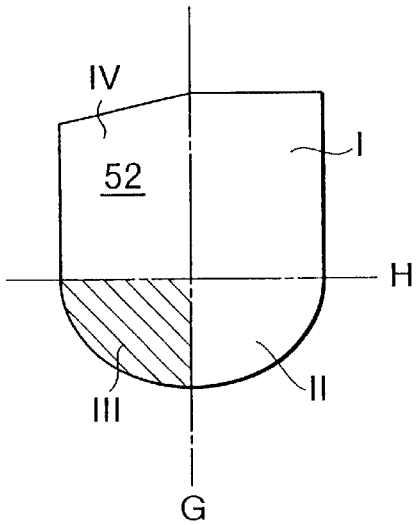

Next, a comparative example will be described to compare with the first to fourth embodiments while referring to FIGS. 24(A) to 24(C). In this comparative example, a device was used with configuration similar to the device of the first embodiment, except that the positionally relationship of the agitator and the cleaning member is different from the that of the agitator 53 and the cleaning member 54 in the first embodiment. In particular, the comparative example differs from the first embodiment in that, as shown in FIG. 24(B), the agitator 53 and the cleaning member 54 have a phase angle of 270 degrees so that the agitator 53 is disposed in the region III as indicated by hatching in FIG. 24(C) while the wiper 54*b* is wiping the light transmission window 56.

The device of the comparative example was subjected to the same experiments under the same conditions as the device of the third embodiment. The experimental results of the comparative example are shown in FIG. 24(A). FIG. 24(A) shows changes in output voltage from the light receiving element 61*c* when 70 g of toner filled toner holding chamber.

With the configuration of the comparative example, toner does not fall from the agitator 53 while the wiper 54*b* is wiping the light transmission window 56. Therefore, as shown in FIG. 24(A), almost no noise is generated in the output of the light receiving element 61*c*. However, because the agitator 53 pushes up the toner during the time the wiper 54*b* is wiping the light transmission window 56. Even if the wiper 54*b* properly wipes the light transmission window 56, the pushed up toner will promptly dirty the light transmission window 56 so that light is prevented from passing through the window. Accordingly, as shown in FIG. 24(A), no low level periods will appear in the output from the light receiving element, and no toner empty condition will be detected, until almost no toner remains in the toner holding chamber. Therefore, this comparative example will only notifies the user that a toner empty condition exists after printed images have already started to become faint.

It should be noted that although each of the above-described embodiments described the light transmission window 56 as being disposed on the same side of the vertical plane G as the opening A, i.e., the imaginary first region, the light transmission window 56 can be disposed on the opposite side of the vertical plane G from the opening A, i.e., the imaginary second region provided that (1) the agitator 53 is positioned on the opposite side of the vertical plane G than the opening A, i.e., in the imaginary second region while the wiper 54*b* is wiping off the light transmission window 56, (2) the release of bending of the slide contact member 53*b* only occurs in the imaginary first region. With this arrangement, the agitator 53 is positioned above the light transmission window 56. However, any toner on the slide contact member 53*b* will be almost completely removed when the slide contact member 53*b* is snaps out of its bent condition while the agitator 53 is in the imaginary first region. Therefore, the light transmission window 56 will not be contaminated by toner falling from the slide contact member 53*b*.

Next, a developing device according to a fifth embodiment of the present invention will be explained while referring to FIGS. 25 to 29.

Figure 25:
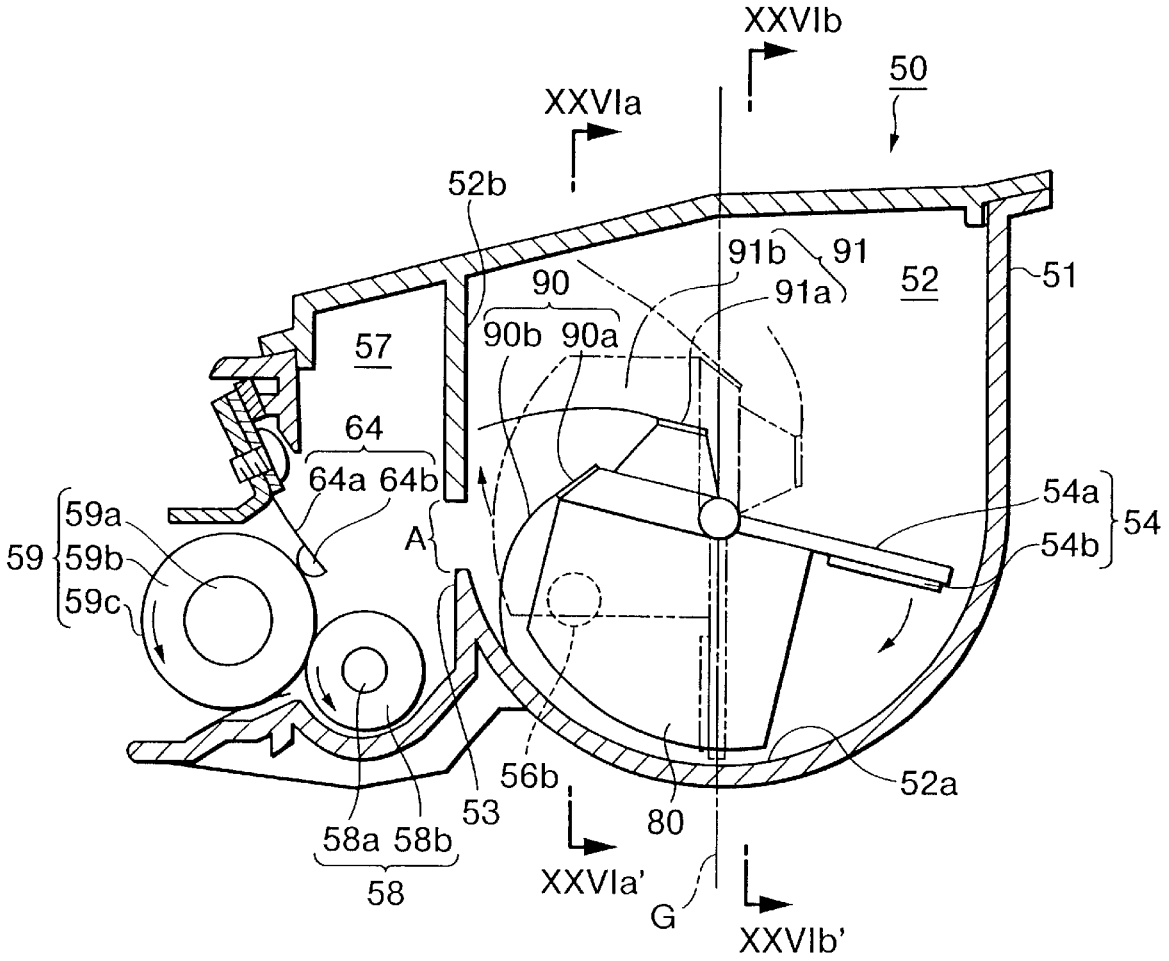
FIG. 25 is a cross-sectional view showing a developing device according to a fifth embodiment of the present invention, taken along line XXV–XXV' of FIG. 26.
Figure 26:
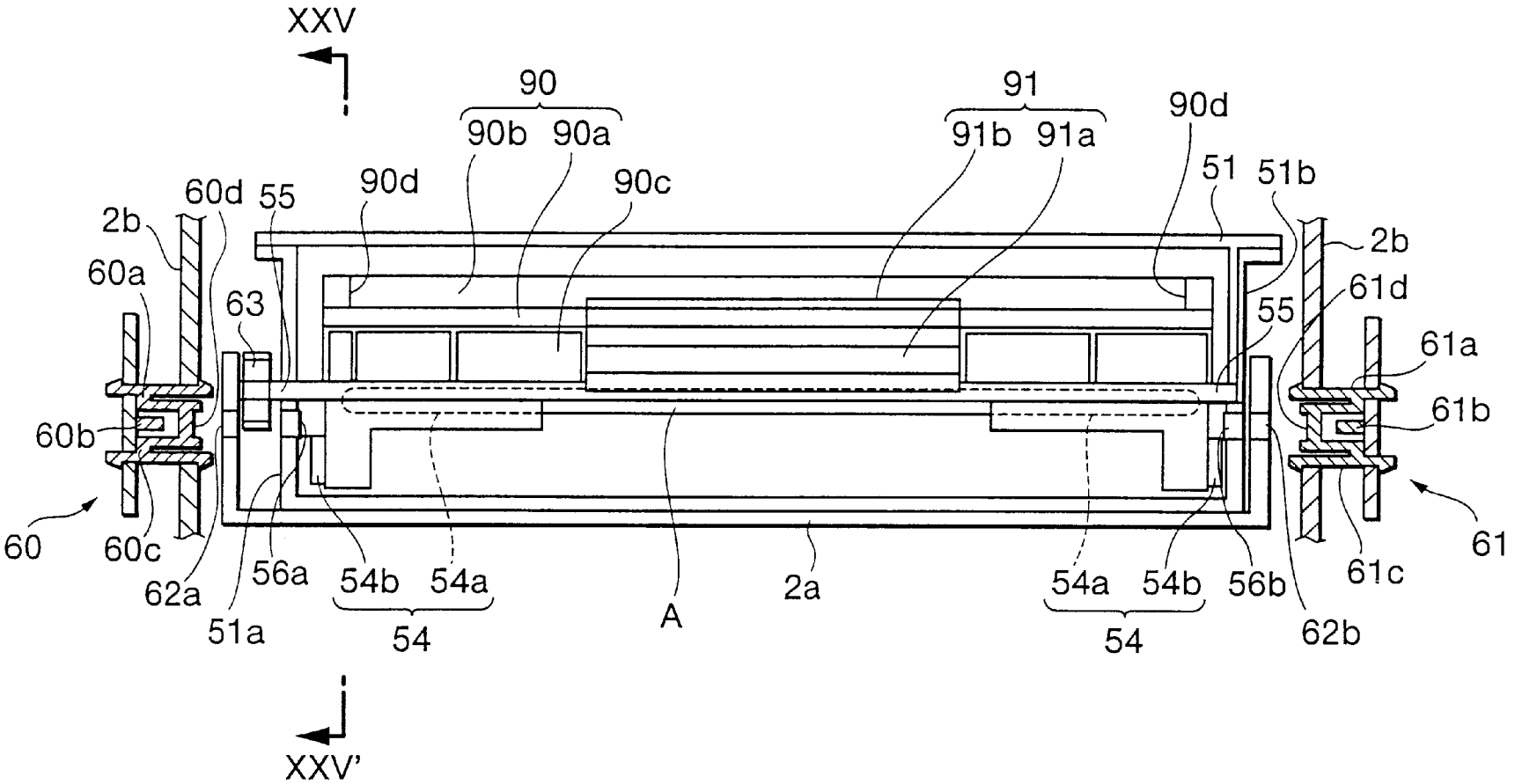
FIG. 26 is a cross-sectional view showing light emitting and receiving elements of FIG. 25 taken along line XXVIa–XXVIa' of FIG. 25, and the developing device of FIG. 26 taken along line XXVIb–XXVIb' of FIG. 25.

As shown in FIG. 25, the developing device according to the fifth embodiment has substantially the same configuration as the device of the second embodiment. Like components between the fifth and second embodiments will be indicated using the same numbering, and explanation omitted.

As shown in FIG. 25, the developing device according to the fifth embodiment has a first agitator 90, which has the same configuration as the agitator 53 of the first embodiment, and also a second agitator 91. The second agitator 91 is formed integrally with a support member 90*a* of the first agitator 90, and includes a support member 91*a* and a transport portion or a second blade 91*b*. The support member 91*a* is formed from a resin, such as ABS resin, and rotates in association with rotation of the support member 90*a*. As seen best in FIG. 26, the support member 91*a* is attached at the lengthwise center of the support member 90*a* (widthwise center portion of the toner holding chamber 51). The transport member 91*b* is formed from PET into a sheet shape attached to the support member 91*a*. As the rotational shaft 55 rotates, the transport member 91*b* raises toner in the toner holding chamber 52 upward to the opening A before the sliding contact portion 90*b* does. Therefore, the configuration of the fifth embodiment has a greater capability to transport toner from the toner holding chamber 52 to the developing chamber 57 in the central portion than at the end portions in the lengthwise direction of the support member 90*a*.

Figure 27:
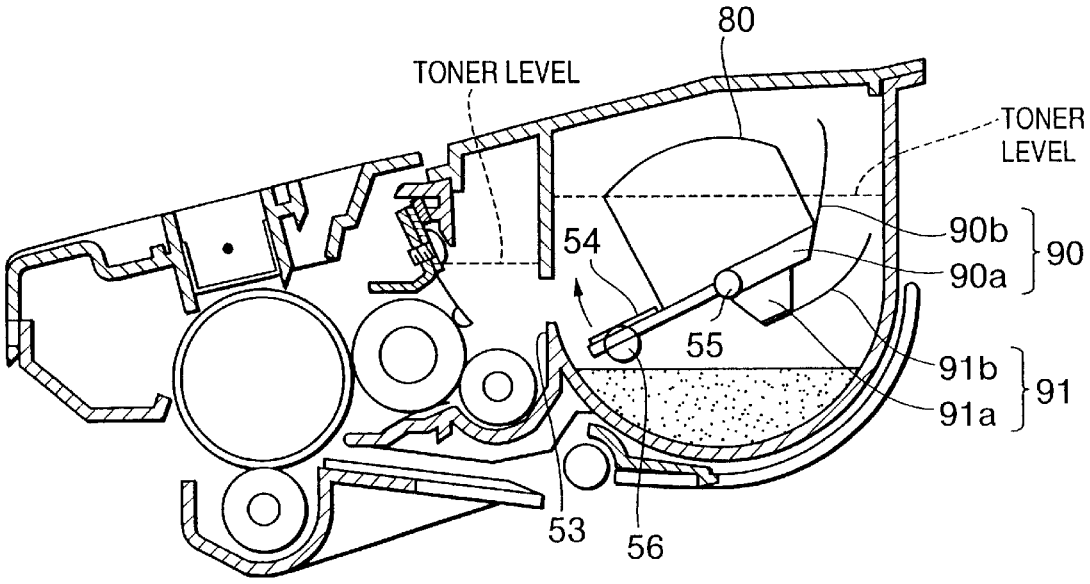
FIG. 27 is a cross-sectional view showing the developing device of FIG. 25, with a cleaning member rotated into confrontation with a light transmission window.
Figure 28:
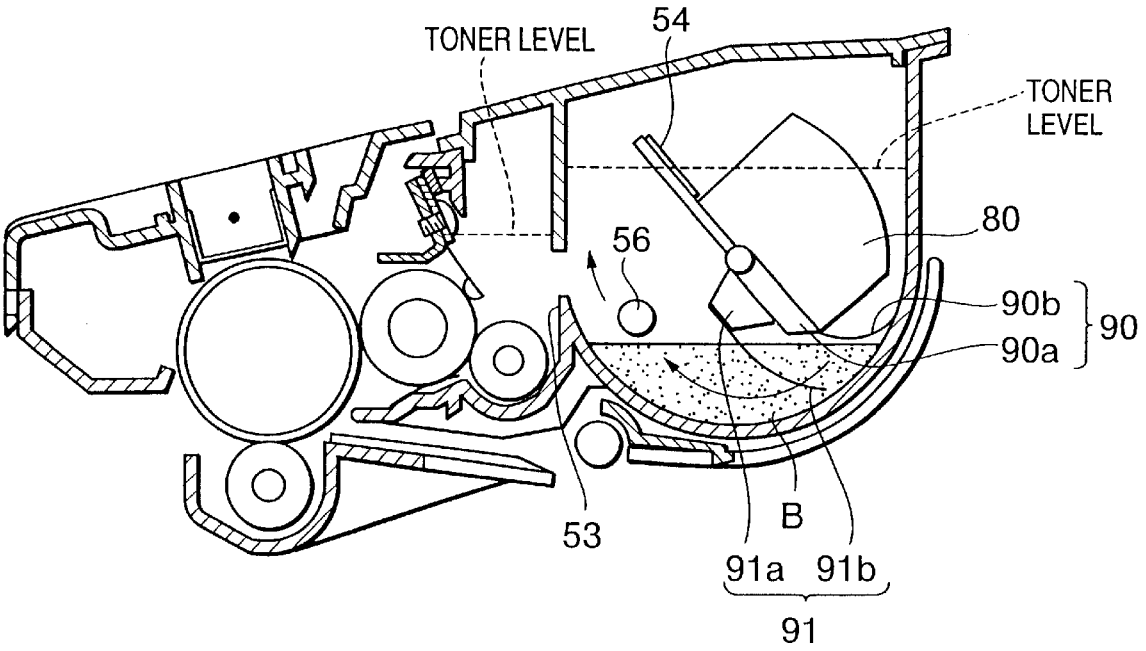
FIG. 28 is a cross-sectional view showing the developing device of FIG. 25, with the cleaning member rotated past the light transmission window.
Figure 29:
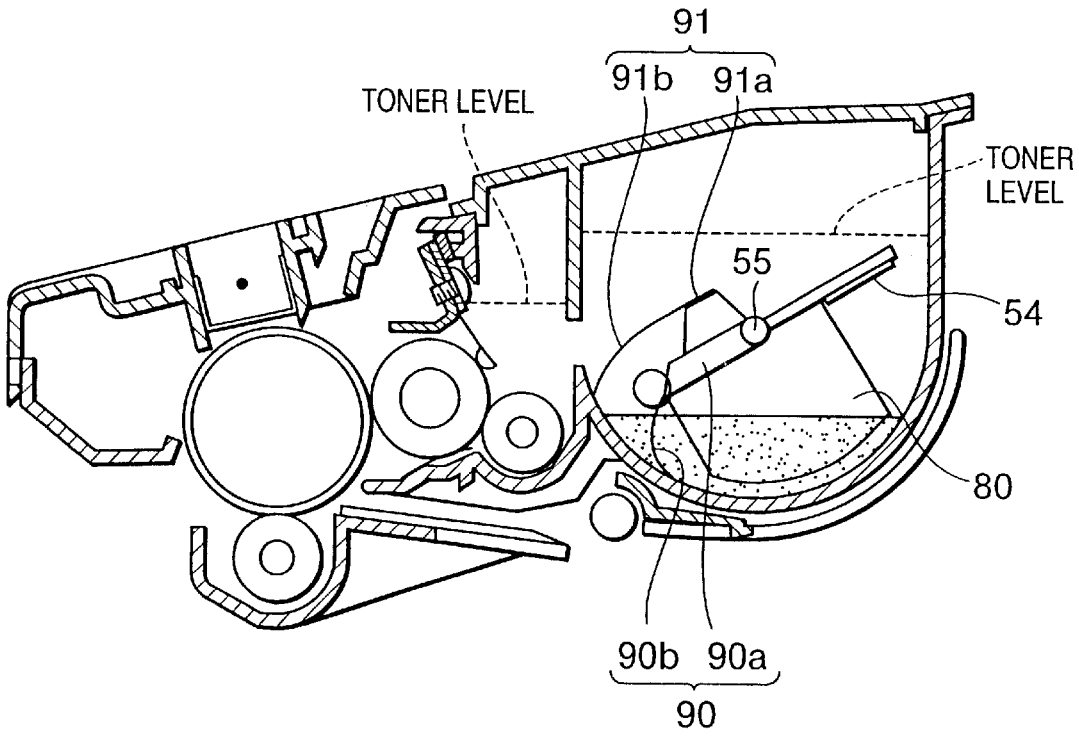
FIG. 29 is a cross-sectional view showing the developing device of FIG. 25, with a slide contact member of a first agitator rotated into confrontation with the light transmission window.

First, an explanation will be provided for when toner holding chamber 52 is filled with a sufficient amount of toner, and the level of the toner surface is higher than the light transmission windows 56*a*, 56*b* as indicated by dotted line in FIG. 27. In this case, as shown in FIG. 29, the transport member 91*b* presses toner up toward the opening A before the first agitator 90. Therefore, toner is first pressed up toward the opening A at the widthwise center of the toner holding chamber 52. Next, after the second agitator 91 passes the opening A, then the second agitator 91 transports toner in the widthwise center the toner holding chamber 52 into the developing chamber 57. At this time, the slide contact member 90*b* of the first agitator 90 pushes up toner from the entire widthwise region of the toner holding chamber 52 while contacting the inner surface of the toner holding chamber 52, and approaches the opening A. Once the slide contact member 90*b* of the first agitator 90 passes the opening A, toner along the entire region in the widthwise direction of the toner holding chamber 52 is transported to the developing chamber 57.

Accordingly, the second agitator 91 first supplies toner to the widthwise center of the developing chamber 57. Immediately afterwards, the first agitator 90 supplies toner across the entire widthwise region of the developing chamber 57. Therefore, pressure at which toner is pressed into the developing chamber is strongest at the widthwise center of the developing chamber 57. The polymerized toner, which is used in this fifth embodiment, has extremely high fluidity as described above. When the polymerized toner is pressed with a high pressure at the center, toner at the ends of the developing chamber 57 flows back into the toner holding chamber 52 from the ends of the opening A. In other words, the toner circulates from the center to the widthwise ends of the developing chamber 57, that is, in the lengthwise direction of the developing roller 59. Toner can be reliably circulated out from lengthwise end portions of the developing chamber 57, where toner is consumed in only small amounts by printing. As a result, good printing can be performed without degradation of the toner due to accumulation at the lengthwise end portions of the developing chamber 57 for long periods before being used for printing.

According to experiments, if the second agitator 91 is formed less than ¼ the width of the opening A, then toner does not circulate from the lengthwise center to the lengthwise end portions of the developing chamber 57. Also, if the second agitator 91 is formed greater than ¾ the width of the opening A, then toner stops circulating in the lengthwise direction. Experimental results proved that it is desirable for the second agitator 91 to be formed to about ½ the width of the opening A. In the present embodiment, the second agitator 91 is formed to about ⅘ the width of the opening A. In experiments performed for investigating the relationship between the widths of the second agitator 91 and the opening A, a developing unit was prepared by cutting off the top of the toner holding chamber to visually confirm internal toner circulation. Durability tests, such as printing 10,000 sheets were also performed. Upon evaluating the resultant images, print fogging was observed at the edges of the sheets when the second agitator was smaller that ¼ the width of the opening A or when the second agitator was larger than ¾ the width of the opening A. Some slight fogging was observed at the edges of sheets printed during durability tests wherein the second agitator had a width ¼ or ¾ the width of the opening A, but in sufficiently small amounts to enable practical use of such a printer. Also, some toner circulation was observed when new toner was used in a device with a second agitator smaller than ¼ or larger than ¾ the width of the opening A. However, when fluidity of the toner decreased during the durability tests, sometimes the circulation became unstable or stopped altogether. As described above, it was understood that it is desirable to form the second agitator 91 to a width that is ¼ or more, or ¾ or less the width of the opening A.

The configuration of the present embodiment can improve toner circulation without reducing the height of a partition wall 53 indicated in FIGS. 25, that is, the lower edge of the opening A between the developing chamber 57 and the toner holding chamber 52. Therefore, sufficient toner will always be supplied to the developing roller 59 so that images can be formed with a stable density.

Because the upper edge of the wall 53 of the opening A is higher than an upper end of the toner supply roller 58, the amount of polymerized toner that returns from the development chamber 57 back into the toner holding chamber 52 by gravity is suppressed. Toner will always be supplied in sufficient amounts to the developing roller 59. Furthermore, toner can be properly circulated along the entire width of the development chamber 57, even if the upper edge of the wall 53 of the opening A is low. Therefore, toner can be reliably prevented from dwelling in pockets of the development chamber 57, where it could become old and defective.

Also, because the first agitator 90 is configured to have a width larger than the width of the opening A, toner will always be sufficiently supplied across the entire width of the developing chamber 57. Moreover, because toner is properly circulated along the length of the developing roller 59, unevenness in toner supply will not be generated and line-shaped unevenness in image density will not be generated during printing. Furthermore, the free end of the transport member 91*b* of the second agitator 91 and the free end of the slide contact member 90*b* of the first agitator 90 are configured to penetrate into the developing chamber 57 through the opening A upon release of deformation of the transport member 91*b* and the slide contact member 90*b*. Therefore, toner will be suitably pushed into the developing chamber 57 so that the toner circulation can be improved.

The free end portion of the transport member 91*b* of the second agitator 91 and the slide contact member 90*b* of the first agitator 90 are formed from a resin sheet of PET, and these sheets are formed thicker than 50 μm, because experimental results showed that toner is insufficiently supplied to the developing chamber 57 when the sheet is formed thinner than 50 μm. In the illustrated embodiment, the slide contact member 90*b* is formed thicker than 50 μm, and therefore, toner can be sufficiently supplied to the developing chamber 57. Also, the slide contact member 90*b* is formed thinner than 100 μm, otherwise the slide contact member 90*b* generates noise when its deformation is released. It was understood from experimental results that 75 μm is the optimum thickness of the slide contact member 90*b*.

Assuming that the toner is transported more to the widthwise ends than to the widthwise center of the developing chamber 57, then toner supplied from widthwise ends meet at the widthwise center. Unevenness in image density appears at the widthwise center of printed images. On the contrary according to the fifth embodiment, toner does not collide against itself at the widthwise center, and therefore, unevenness in image density can be reliably prevented.

The fifth embodiment provides the second agitator 91 to strengthen supply of toner to the widthwise center of the developing roller 59. However, various modifications may be conceivable to this effect. For example, more agitators can be provided in the widthwise center. Also, there is no need to provide a plurality of agitators. For example, a single agitator can be provided with a radial length, that is, the length from the rotational axis to the free end of the sliding contact portion, longer at the widthwise center than at the widthwise ends. Alternatively, a single agitator can be provided with the surface of the sliding contact portion machined in a mesh, wherein the mesh is more open at the widthwise ends than at the widthwise center.

While the invention has been described in detail and with reference to specific embodiments thereof, it would be apparent to those skilled in the art that various changes and modifications may be made therein without departing from the spirit and scope of the invention.

What is claimed is:

1. A developing device, comprising:

a developing housing;

a developing agent container connected to and positioned beside the developing housing and formed with an opening in communication with the developing housing, the developing agent container having a container wall and an inner surface defining a developing agent accumulation space, the developing agent container having a width extending in a widthwise direction of an image recording sheet;

a light transmission window provided at the container wall to permit a detection light to pass through the light transmission window so as to detect an amount of the developing agent in the developing agent container;

a cleaning member disposed in the developing agent container and ratable at a constant angular velocity about a rotation axis in a direction to move upward when passing beside the opening, the cleaning member being movable to a cleaning position in sliding contact with the light transmission window for cleaning the light transmission window, the developing agent accumulation space being divided into an imaginary first region and an imaginary second region by an imaginary vertical plane passing through the rotation axis and extending in an axial direction of the rotation axis, the imaginary first region being in communication with the opening, and the imaginary second region being positioned opposite the opening with respect to the imaginary vertical plane; and a developing agent agitating and transferring member disposed in the developing agent container for agitating the developing agent in the developing agent container and transferring the developing agent to the developing housing, the developing agent agitating and transferring member comprising a blade movable with respect to the inner surface of the developing agent container, the blade being ratable about the rotation axis of the cleaning member at a constant angular velocity equal to the angular velocity of the cleaning member, the blade being spaced away from the cleaning member in such a manner that the blade is positioned in the imaginary second region when the cleaning member is in the cleaning position, and wherein the container wall of the developing agent container includes confronting side walls at widthwise ends in the widthwise direction, the light transmission window being disposed at each side wall to allow the detection light to pass through the respective light transmission windows.

2. The developing device as claimed in claim 1, wherein the blade is formed of a flexible material and is deformable in sliding contact with the inner surface of the developing agent container, a release of deformation of the blade occurring only when the blade is in the imaginary first region.

3. The developing device as claimed in claim 1, wherein the window is positioned in the imaginary first region.

4. The developing device as claimed in claim 1, wherein the developing agent container has a width extending in a widthwise direction of an image recording sheet, and the light transmission window has a window plane extending in a direction perpendicular to the widthwise direction, the developing agent agitating and transferring member being positioned spaced away from the light transmission window by a predetermined distance in the widthwise direction.

5. The developing device as claimed in claim 4, wherein the blade and the inner surface of the developing agent container provides a first friction coefficient, and the cleaning member and the light transmission window provide a second friction coefficient higher than the first friction coefficient.

6. The developing device as claimed in claim 4, wherein the blade provides a first pressure with respect to the inner surface of the developing agent container, and the cleaning member provides a second pressure with respect to the light transmission window, the first pressure being lower than the second pressure.

7. The developing device as claimed in claim 4, wherein the cleaning member has a width in the widthwise direction, the width of the cleaning member being greater than the predetermined distance.

8. The developing device as claimed in claim 4, wherein the predetermined distance is ranging from 3 mm to 10 mm.

9. The developing device as claimed in claim 1, further comprising a developing agent carrying member disposed in the developing housing and having a longitudinal length extending in a widthwise direction of an image recording sheet, the opening having a length corresponding to the longitudinal length of the developing agent carrying member, and wherein the developing agent comprises polymerized toners produced by polymerization method.

10. The developing device as claimed in claim 9, wherein the developing agent comprises non magnetic single component toners in which are added to the polymerized toners at least two kinds of external additives including additive having a BET value less than 100.

11. The developing device as claimed in claim 9, wherein the developing agent comprises non magnetic single component toners in which are added to the polymerized toners at least first kind of additive having a minimum particle diameter and a second kind of additive having a particle diameter greater than that of the first kind of additive, addition of the first and second additives to the polymerized toners providing a fluidity lower than a fluidity provided by the addition of only the first kind of additive to the polymerized toners.

12. The developing device as claimed in claim 1, wherein the light transmission window is protruded inwardly with respect to the container wall toward a center of the developing agent accumulation space.

13. The developing device as claimed in claim 12, wherein the cleaning member comprises a cleaning segment made from a resilient material and in sliding contact with the light transmission window with a first flexed shape, the cleaning segment being also in sliding contact with the inner surface of the developing agent container with a second flexed shape whose flexing degree is lower than that of the first flexed shape.

14. The developing device as claimed in claim 12, further comprising a developing agent carrying member disposed in the developing housing and having a longitudinal length extending in a widthwise direction of an image recording sheet, the opening having a length corresponding to the longitudinal length of the developing agent carrying member, and wherein the container wall of the developing agent container includes confronting side walls at widthwise ends in the widthwise direction, the light transmission window being disposed at each side wall to allow the detection light to pass through the respective light transmission windows.

15. The developing device as claimed in claim 12, wherein an angled step is provided at a boundary between the inner surface of the developing agent container and the light transmission window.

16. The developing device as claimed in claim 12, wherein the developing agent comprises developing toners and at least two kinds of additives having particle diameter different from each other, and wherein the light transmission window is formed of a glass at a portion in contact with the cleaning member.

17. The developing device as claimed in claim 16, wherein the at least two kind of additives comprise a first kind of additive having a minimum particle diameter and a second kind of additive having a particle diameter greater than that of the first kind of additive, addition of the first and second additives to the developing toners providing a fluidity lower than a fluidity provided by the addition of only the first kind of additive to the developing toners.

18. The developing device as claimed in claim 17, wherein the second kind of additive include a main component formed of an oxide material selected from the group consisting of silica, alumina, and titanium oxide.

19. The developing device as claimed in claim 12, wherein the developing agent comprises polymerized toners produced by polymerization method.

20. The developing device as claimed in claim 19, wherein the cleaning member comprises a cleaning segment made from a resilient material and having an angled free end in sliding contact with the light transmission window, the cleaning segment being flexed in sliding contact with the light transmission window.

21. The developing device as claimed in claim 20, wherein the cleaning segment is made from an urethane rubber.

22. The developing device as claimed in claim 1, wherein the developing toner comprises a non magnetic single component toner, and the developing device further comprising:

a developing agent carrying member disposed in the developing housing for carrying thereon the developing agent supplied from the developing agent container into the developing housing through the opening; and a thickness regulation member disposed in confrontation with the developing agent carrying member to regulate a thickness of a layer of the developing agent formed on the developing agent carrying member, the thickness regulation member having a pressing segment formed of a rubber pressing against the developing agent carrying member.

23. The developing device as claimed in claim 22, wherein the developing agent carrying member is formed of an electrically conductive rubber material.

24. The developing device as claimed in claim 22, wherein the developing agent comprises developing toners and at least two kinds of additives having particle diameter different from each other.

25. The developing device as claimed in claim 24, wherein the at least two kind of additives comprise a first kind of additive having a minimum particle diameter and a second kind of additive having a particle diameter greater than that of the first kind of additive, addition of the first and second additives to the developing toners providing a fluidity lower than a fluidity provided by the addition of only the first kind of additive to the developing toners.

26. The developing device as claimed in claim 22, wherein the pressing segment is formed of a silicone rubber.

27. The developing device as claimed in claim 22, wherein the developing agent comprises a polymerized toners produced by polymerization method.

28. The developing device as claimed in claim 1, wherein the developing agent comprises polymerized toner produced by a polymerization method, and wherein the developing agent agitating and transferring member further comprises means for promoting a transferring efficiency of the developing agent from the developing agent container to the developing housing at a center portion of the opening in comparison with the efficiency at end portions of the opening, the center and the end portions being referred in terms of a widthwise direction of an image recording sheet.

29. The developing device as claimed in claim 28, wherein the promoting means comprises a supplemental blade provided rotatably about the rotation axis of the cleaning member, the blade having a length in the widthwise direction equal to or greater than a widthwise length of the opening, and the supplemental blade having a length in the widthwise direction smaller than the widthwise length of the opening, and positioned at a center portion thereof.

30. The developing device as claimed in claim 29, wherein the blade and the supplemental blade have free ends insertable into the opening when these blades pass through the opening.

31. The developing device as claimed in claim 29, further comprising:

a developing agent carrying member disposed in the developing housing; and a developing agent supplying member disposed in the developing housing and positioned between the opening and the developing agent carrying member for supplying the developing agent transferred through the opening to the developing agent carrying member, the developing agent supplying member having an upper end; and wherein the opening has a rectangular cross-section having a lower horizontal edgeline positioned higher than the upper end of the developing agent supplying member.

32. The developing device as claimed in claim 29, wherein the blade and the supplemental blade are in the form of flexible resin sheet having a thickness ranging from 50 to 100 micron meters.

33. A process cartridge detachably assembled in a cartridge accommodation space of an image recording device, the cartridge comprising:

a latent image carrying member;

a developing agent carrying member positioned in confrontation with the latent image carrying member; and the developing device of claim 1, the latent image carrying member and the developing agent carrying member being disposed in the developing housing.

34. An image recording device, comprising:

means for detecting a residual amount of a developing agent; and the developing device according to claim 1, the detecting means detecting the residual amount of the developing agent accumulated in the developing agent container and including a light emitting element and a light receiving element positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

35. A developing device, comprising:

a developing agent container having a container wall and an inner surface defining a developing agent accumulation space;

a light transmission window provided at the container wall to permit a detection light to pass through the light transmission window so as to detect an amount of the developing agent in the developing agent container;

a cleaning member rotatable provided about its rotation axis in the developing agent container and performing cleaning to the light transmission window at a predetermined cycle;

a developing agent agitating and transferring member rotatably provided in the developing agent container for agitating the developing agent in the container and transferring the developing agent; and a shielding member movably disposed in the developing agent container and shielding the light transmission window for a predetermined period in timed relation with the predetermined cycle, the shielding member being rotatable about the rotation axis of the cleaning member.

36. The developing device as claimed in claim 35, wherein the light transmission window comprises a light emission side window and a light receiving side window in confrontation therewith, and wherein the cleaning member is in contact with the light emission side window and the light receiving side window, and wherein one cleaning cycle starts when the cleaning member is brought into contact with the light emission side and the light receiving side windows and is ended upon 360 degree rotation from the start, a front half cleaning cycle and a rear half cleaning cycle being defined in the one cleaning cycle, the shielding member being angularly spaced away from the cleaning member in such a manner that the shielding member shields the light transmission windows at the rear half cleaning cycle.

37. The developing device as claimed in claim 36, wherein the shielding member is angularly spaced away from the blade, and is positioned rearwardly of the blade in the direction of rotation of the blade and the shielding member.

38. The developing device as claimed in claim 35, wherein an opening has an elongated rectangular cross section having a vertical edgeline, and the shielding member is positioned at a position at the vertical edgeline or at a position outwardly of the vertical edgeline with respect to a widthwise direction of an image recording sheet.

39. A process cartridge detachably assembled in a cartridge accommodation space of an image recording device, the cartridge comprising:

a latent image carrying member;

a developing agent carrying member positioned in confrontation with the latent image carrying member; and the developing device of claim 35, the latent image carrying member and the developing agent carrying member being disposed in the developing housing.

40. An image recording device, comprising:

means for detecting a residual amount of a developing agent; and the developing device according to claim 35, the detecting means detecting the residual amount of the developing agent accumulated in the developing agent container and including a light emitting element and a light receiving element positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

41. A developing device, comprising:

a developing housing;

a developing agent container connected to and positioned beside the developing housing and formed with an opening in communication with the developing housing, the developing agent container having a container wall and an inner surface defining a developing agent accumulation space;

a light transmission window provided at the container wall to permit a detection light to pass through the light transmission window so as to detect an amount of the developing agent in the developing agent container;

a cleaning member disposed in the developing agent container and rotatable at a constant angular velocity about a rotation axis in a direction to move upward when passing beside the opening, the cleaning member being movable to a cleaning position in sliding contact with the window for cleaning the light transmission window, the developing agent accumulation space being divided into an imaginary first region and an imaginary second region by an imaginary vertical plane passing through the rotation axis and extending in an axial direction of the rotation axis, the imaginary first region including the opening, and the imaginary second region being positioned opposite the opening with respect to the imaginary vertical plane; and a developing agent agitating and transferring member disposed in the developing agent container for agitating the developing agent in the developing agent container and transferring the developing agent to the developing housing, the developing agent agitating and transferring member comprising a blade movable with respect to the inner surface of the developing agent container, the blade being rotatable about the rotation axis of the cleaning member at a constant angular velocity equal to the angular velocity of the cleaning member, the light transmission window being positioned in the imaginary first region, and the blade being spaced away from the cleaning member in such a manner that the blade is positioned higher than the light transmission window when the cleaning member is in the cleaning position, wherein the container wall of the developing agent container includes confronting side walls at widthwise ends in the widthwise direction, the light transmission window being disposed at each side wall to allow the detection light to pass through the respective light transmission windows.

42. The developing device as claimed in claim 41, wherein the developing agent comprises polymerized toners produced by a polymerization method.

43. The developing device as claimed in claim 41, wherein the developing agent comprises non magnetic single component toners, and at least two kinds of additives having particle diameter different from each other.

44. The developing device as claimed in claim 43, wherein the at least two kind of additives comprise a first kind of additive having a minimum particle diameter and a second kind of additive having a particle diameter greater than that of the first kind of additive, addition of the first and second additives to the developing toners providing a fluidity lower than a fluidity provided by the addition of only the first kind of additive to the developing toners.

45. The developing device as claimed in claim 41, wherein the developing agent container has a width extending in a widthwise direction of an image recording sheet, and the light transmission window having a window plane extending in a direction perpendicular to the widthwise direction, the developing agent agitating and transferring member being positioned spaced away from the light transmission window by a predetermined distance in the widthwise direction.

46. The developing device as claimed in claim 41, further comprising a developing agent carrying member disposed in the developing housing and having a longitudinal length extending in a widthwise direction of an image recording sheet, the opening having a length corresponding to the longitudinal length of the developing agent carrying member, and wherein the developing agent comprises polymerized toners produced by polymerization method.

47. The developing device as claimed in claim 41, wherein the light transmission window is protruded inwardly with respect to the container wall toward a center of the developing agent accumulation space.

48. The developing device as claimed in claim 41, wherein the developing toner comprises a non magnetic single component toner, and the developing device further comprising:

a developing agent carrying member disposed in the developing housing for carrying thereon the developing agent supplied from the developing agent container into the developing housing through the opening; and a thickness regulation member disposed in confrontation with the developing agent carrying member to regulate a thickness of a layer of the developing agent formed on the developing agent carrying member, the thickness regulation member having a pressing segment formed of a rubber pressing against the developing agent carrying member.

49. The developing device as claimed in claim 41, wherein the cleaning member performs cleaning to the light transmission window at a predetermined cycle, and the developing device further comprising a shielding member movably disposed in the developing agent container and shielding the light transmission window for a predetermined period in timed relation with the predetermined cycle.

50. The developing device as claimed in claim 41, wherein the developing agent comprises polymerized toner produced by a polymerization method, and wherein the developing agent agitating and transferring member further comprises means for promoting a transferring efficiency of the developing agent from the developing agent container to the developing housing at a center portion of the opening in comparison with the efficiency at end portions of the opening, the center and the end portions being referred in terms of a widthwise direction of an image recording sheet.

51. A process cartridge detachably assembled in a cartridge accommodation space of an image recording device, the cartridge comprising:

a latent image carrying member;

a developing agent carrying member positioned in confrontation with the latent image carrying member; and the developing device of claim 41, the latent image carrying member and the developing agent carrying member being disposed in the developing housing.

52. An image recording device, comprising:

means for detecting a residual amount of a developing agent; and the developing device according to claim 41, the detecting means detecting the residual amount of the developing agent accumulated in the developing agent container and including a light emitting element and a light receiving element positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

53. A developing device, comprising:

a developing housing;

a developing agent container connected to and positioned beside the developing housing and formed with an opening in communication with the developing housing, the developing agent container having a container wall and an inner surface defining a developing agent accumulation space;

a light transmission window provided at the container wall to permit a detection light to pass through the light transmission window so as to detect an amount of the developing agent in the developing agent container;

a cleaning member disposed in the developing agent container and movable to a cleaning position in sliding contact with the light transmission window for cleaning the light transmission window; and a developing agent agitating and transferring member disposed in the developing agent container for agitating the developing agent in the developing agent container and transferring the developing agent to the developing housing, the developing agent agitating and transferring member comprising a blade movable with respect to the inner surface of the developing agent container, the developing agent container having a width extending in a widthwise direction of an image recording sheet, and the light transmission window having a window plane extending in a direction perpendicular to the widthwise direction, the developing agent agitating and transferring member being positioned spaced away from the light transmission window by a predetermined distance in the widthwise direction, the predetermined distance being in a range of from 3 mm to 10 mm.

54. A process cartridge detachably assembled in a cartridge accommodation space of an image recording device, the cartridge comprising:

a latent image carrying member;

a developing agent carrying member positioned in confrontation with the latent image carrying member; and the developing device of claim 53, the latent image carrying member and the developing agent carrying member being disposed in the developing housing.

55. An image recording device, comprising:

means for detecting a residual amount of a developing agent; and the developing device according to claim 53, the detecting means detecting the residual amount of the developing agent accumulated in the developing agent container and including a light emitting element and a light receiving clement positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

56. A developing device, comprising:

a developing housing;

a developing agent container connected to and positioned beside the developing housing and formed with an opening in communication with the developing housing, the developing agent container having a container wall and an inner surface defining a developing agent accumulation space, the developing agent container having a width extending in a widthwise direction of an image recording sheet;

a light transmission window provided at the container wall to permit a detection light to pass through the light transmission window so as to detect an amount of the developing agent in the developing agent container; and a cleaning member disposed in the developing agent container and movable to a cleaning position in sliding contact with the light transmission window for cleaning the light transmission window, the light transmission window protruding inwardly with respect to the container wall toward a center of the developing agent accumulation space, wherein the developing agent comprises polymerized toners produced by polymerization method, wherein the cleaning member comprises a cleaning segment made from a resilient material and having an angled free end in sliding contact with the light transmission window, the cleaning segment being flexed in sliding contact with the light transmission window, and wherein the container wall of the developing agent container includes confronting side walls at widthwise ends in the widthwise direction, the light transmission window being disposed at each side wall to allow the detection light to pass through the respective light transmission windows.

57. A process cartridge detachably assembled in a cartridge accommodation space of an image recording device, the cartridge comprising:

a latent image carrying member;

a developing agent carrying member positioned in confrontation with the latent image carrying member; and the developing device of claim 56, the latent image carrying member and the developing agent carrying member being disposed in the developing housing.

58. An image recording device, comprising:

means for detecting a residual amount of a developing agent; and the developing device according to claim 56, the detecting means detecting the residual amount of the developing agent accumulated in the developing agent container and including a light emitting element and a light receiving element positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

59. A developing device, comprising:

a developing housing;

a developing agent container connected to and positioned beside the developing housing and formed with an opening in communication with the developing housing, the developing agent container having a container wall and an inner surface defining a developing agent accumulation space;

a light transmission window provided at the container wall to permit a detection light to pass through the light transmission window so as to detect an amount of the developing agent in the developing agent container;

a cleaning member disposed in the developing agent container and ratable at a constant angular velocity about a rotation axis in a direction to move upward when passing beside the opening, the cleaning member being movable to a cleaning position in sliding contact with the light transmission window for cleaning the light transmission window; and a developing agent agitating and transferring member disposed in the developing agent container for agitating the developing agent in the developing agent container and transferring the developing agent to the developing housing, the developing agent agitating and transferring member comprising a blade movable with respect to the inner surface of the developing agent container, the blade being ratable about the rotation axis of the cleaning member at a constant angular velocity equal to the angular velocity of the cleaning member, wherein the cleaning member comprises a cleaning segment made from a resilient material and having an angled free end in sliding contact with the light transmission window, the cleaning segment being flexed in sliding contact with the light transmission window.

60. The developing device as claimed in claim 59, wherein the developing agent comprises polymerized toners produced by polymerization method.

61. The developing device as claimed in claim 59, wherein the light transmission window is protruded inwardly with respect to the container wall toward a center of the developing agent accumulation space.

62. The developing device as claimed in claim 61, wherein the cleaning member is in sliding contact with the light transmission window with a first flexed shape, the cleaning segment being also in sliding contact with the inner surface of the developing agent container with a second flexed shape whose flexing degree is lower than that of the first flexed shape.

63. The developing device as claimed in claim 61, further comprising a developing agent carrying member disposed in the developing housing and having a longitudinal length extending in a widthwise direction of an image recording sheet, the opening having a length corresponding to the longitudinal length of the developing agent carrying member, and wherein the container wall of the developing agent container includes confronting side walls at widthwise ends in the widthwise direction, the light transmission window being disposed at each side wall to allow the detection light to pass through the respective light transmission windows.

64. The developing device as claimed in claim 61, wherein an angled step is provided at a boundary between the inner surface of the developing agent container and the light transmission window.

65. The developing device as claimed in claim 61, wherein the developing agent comprises developing toners and at least two kinds of additives having particle diameter different from each other, and wherein the light transmission window is formed of a glass at a portion in contact with the cleaning member.

66. The developing device as claimed in claim 65, wherein the at least two kinds of additives comprise a first kind of additive having a minimum particle diameter and a second kind of additive having a minimum particle diameter and a second kind of additive having a particle diameter greater than that of the first kind of additive, addition of the first and second additives to the developing toners providing a fluidity lower than a fluidity provided by the addition of only the first kind of additive to the developing toners.

67. The developing device as claimed in claim 66, wherein the second kind of additive includes a main component formed of an oxide material selected from the group consisting of silica, alumina, and titanium oxide.

68. The developing device as claimed in claim 59, wherein the cleaning segment is made from a urethane rubber.

69. A process cartridge detachably assembled in a cartridge accommodation space of an image recording device, the cartridge comprising:

a latent image carrying member;

a developing agent carrying member positioned in confrontation with the latent image carrying member; and the developing device of claim 59, the latent image carrying member and the developing agent carrying member being disposed in the developing housing.

70. An image recording device, comprising:

means for detecting a residual amount of a developing agent; and the developing device according to claim 59, the detecting means detecting the residual amount of the developing agent accumulated in the developing agent container and including a light emitting element and a light receiving element positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

71. A developing device, comprising:

a developing housing;

a developing agent container connected to and positioned beside the developing housing and formed with an opening in communication with the developing housing, the developing agent container having a container wall and an inner surface defining a developing agent accumulation space;

a light transmission window provided at the container wall to permit a detection light to pass through the light transmission window so as to detect an amount of the developing agent in the developing agent container;

a cleaning member disposed in the developing agent container and rotatable at a constant angular velocity about a rotation axis in a direction to move upward when passing beside the opening, the cleaning member being movable to a cleaning position in sliding contact with the light transmission window for cleaning the light transmission window, the developing agent accumulation space being divided into an imaginary first region and an imaginary second region by an imaginary vertical plane passing through the rotation axis and extending in an axial direction of the rotation axis, the imaginary first region being in communication with the opening, and the imaginary second region being positioned opposite the opening with respect to the imaginary vertical plane; and a developing agent agitating and transferring member disposed in the developing agent container for agitating the developing agent in the developing agent container and transferring the developing agent to the developing housing, the developing agent agitating and transferring member comprising a blade movable with respect to the inner surface of the developing agent container, the blade being rotatable about the rotation axis of the cleaning member at a constant angular velocity equal to the angular velocity of the cleaning member, the blade being spaced away from the cleaning member in such a manner that the blade is positioned in the imaginary second region when the cleaning member is in the cleaning position, wherein the developing agent comprises polymerized toner produced by a polymerization method, and wherein the developing agent agitating and transferring member further comprises means for promoting a transferring efficiency of the developing agent from the developing agent container to the developing housing at a center portion of the opening in comparison with the efficiency at end portions of the opening, the center and the end portions being referred in terms of a widthwise direction of an image recording sheet.

72. The developing device as claimed in claim 71, wherein the promoting means comprises a supplemental blade provided rotatably about the rotation axis of the cleaning member, the blade having a length in the widthwise direction equal to or greater than a widthwise length of the opening, and the supplemental blade having a length in the widthwise direction smaller than the widthwise length of the opening, and positioned at a center portion thereof.

73. The developing device as claimed in claim 72, wherein the blade and the supplemental blade have free ends insertable into the opening when these blades pass through the opening.

74. The developing device as claimed in claim 72, further comprising:

a developing agent carrying member disposed in the developing housing; and a developing agent supplying member disposed in the developing housing and positioned between the opening and the developing agent carrying member for supplying the developing agent transferred through the opening to the developing agent carrying member, the developing agent supplying member having an upper end, wherein the opening has a rectangular cross-section having a lower horizontal edgeline positioned higher than the upper end of the developing agent supplying member.

75. The developing device as claimed in claim 72, wherein the blade and the supplemental blade are in the form of flexible resin sheet having a thickness ranging from 50 to 100 micron meters.

76. A process cartridge detachably assembled in a cartridge accommodation space of an image recording device, the cartridge comprising:

a latent image carrying member;

a developing agent carrying member positioned in confrontation with the latent image carrying member; and the developing device of claim 71, the latent image carrying member and the developing agent carrying member being disposed in the developing housing.

77. An image recording device, comprising:

means for detecting a residual amount of a developing agent; and the developing device according to claim 71, the detecting means detecting the residual amount of the developing agent accumulated in the developing agent container and including a light emitting element and a light receiving element positioned in alignment with the light transmission window, wherein the detection means further comprises:

means for measuring light receiving period of the light receiving element;

means for judging whether the light receiving period exceeds a predetermined period; and means for alarming consumption of the developing agent in the developing agent container when the light receiving period exceeds the predetermined period as a result of judgment of the judging means.

* * * * *